US012529231B2

(12) United States Patent
Lange

(10) Patent No.: US 12,529,231 B2
(45) Date of Patent: Jan. 20, 2026

(54) DOUBLE-SKIN FAÇADE ELEMENT

(71) Applicant: PROF. MICHAEL LANGE INGENIEURGESELLSCHAFT MBH, Hannover (DE)

(72) Inventor: Michael Lange, Hannover (DE)

(73) Assignee: PROF. MICHAEL LANGE INGENIEURGESELLSCHAFT MBH, Hannover (DE)

( * ) Notice: Subject to any disclaimer, the term of this patent is extended or adjusted under 35 U.S.C. 154(b) by 18 days.

(21) Appl. No.: 18/292,841

(22) PCT Filed: Jul. 26, 2022

(86) PCT No.: PCT/EP2022/070905
§ 371 (c)(1),
(2) Date: Jan. 26, 2024

(87) PCT Pub. No.: WO2023/006723
PCT Pub. Date: Feb. 2, 2023

(65) Prior Publication Data

US 2024/0271425 A1 Aug. 15, 2024

(30) Foreign Application Priority Data

Jul. 27, 2021 (DE) ..... 20 2021 103 997.3

(51) Int. Cl.
*E04F 13/00* (2006.01)

(52) U.S. Cl.
CPC ..... *E04F 13/007* (2013.01); *E04F 2290/04* (2013.01)

(58) Field of Classification Search
CPC ..... E04F 13/007; E04F 2290/04; E06B 1/36; E06B 1/366; E06B 3/66361;
(Continued)

(56) References Cited

U.S. PATENT DOCUMENTS 2,880,475 A * 4/1959 Mills ..... E06B 3/677 29/520
4,952,430 A * 8/1990 Bowser ..... E06B 3/677 52/786.13

(Continued)

FOREIGN PATENT DOCUMENTS

DE 10 2013 202 719 A1 8/2013
EP 0345211 A2 12/1989

(Continued)

*Primary Examiner* — Rodney Mintz
(74) *Attorney, Agent, or Firm* — Seed Intellectual Property Law Group LLP

(57) ABSTRACT

A double-skin façade element comprises a planar outer glazing element and a planar inner glazing element which are held at a distance from one another in a thermally insulated surrounding frame profile; at least one pressure equalization device which is in air-conducting connection with the outside atmosphere and with a façade intermediate space which is provided between the outer glazing element and the inner glazing element; at least one drying device fillable with desiccant, is either located in the façade intermediate space or is integrated into the surrounding frame profile and exchanges air with the façade intermediate space; wherein the at least one pressure equalization device and the at least one drying device are positioned and dimensioned such that they do not extend into a transparent region of the façade element. The at least one drying device is designed to make it possible to replace the desiccant.

36 Claims, 50 Drawing Sheets

(58) Field of Classification Search
CPC ..... E06B 3/2605; E06B 3/667; E06B 2003/2615; E06B 3/263; E06B 3/5427; E04B 2/90
See application file for complete search history.

(56) References Cited

U.S. PATENT DOCUMENTS

| | | | | |
|---|---|---|---|---|
| 7,975,442 | B1 * | 7/2011 | Frey | E04B 2/967 52/204.5 |
| 7,997,037 | B2 * | 8/2011 | Crandell | E06B 3/24 52/204.593 |
| 8,530,010 | B2 * | 9/2013 | Lenhardt | E06B 3/66361 52/786.13 |
| 8,769,889 | B2 * | 7/2014 | Lenhardt | E06B 3/66342 52/204.593 |
| 8,782,971 | B2 * | 7/2014 | Milburn | E06B 3/24 52/204.593 |
| 9,238,936 | B2 * | 1/2016 | Milburn | E06B 3/677 |
| 9,290,986 | B2 * | 3/2016 | Kotowski | E06B 3/66304 |
| 9,822,581 | B2 * | 11/2017 | Clarahan | E06B 3/6715 |
| 10,125,537 | B2 * | 11/2018 | Clarahan | E06B 3/66347 |
| 10,227,817 | B2 * | 3/2019 | Ting | E06B 3/6715 |
| 11,174,670 | B2 * | 11/2021 | Schreiber | E06B 3/66314 |
| 11,293,212 | B2 * | 4/2022 | Vaidya | E06B 3/64 |
| 11,441,351 | B2 * | 9/2022 | Nüsser et al. | E06B 3/66342 |
| 11,585,146 | B2 * | 2/2023 | Lange | E06B 3/2605 |
| 11,739,586 | B2 * | 8/2023 | Vaidya | E06B 3/549 160/90 |
| 11,781,372 | B2 * | 10/2023 | Vaidya | E06B 3/72 160/90 |
| 12,044,063 | B2 * | 7/2024 | Nikitin | E06B 3/66366 |
| 12,209,453 | B2 * | 1/2025 | Valderrama Chaparro | F24S 20/63 |
| 2005/0034386 | A1 * | 2/2005 | Crandell | E06B 3/677 52/204.5 |
| 2010/0330310 | A1 * | 12/2010 | Lenhardt | E06B 3/66361 428/34 |
| 2011/0296796 | A1 * | 12/2011 | Lenhardt | E06B 3/66361 52/786.13 |
| 2012/0017524 | A1 * | 1/2012 | Milburn | E06B 3/66 52/204.593 |
| 2014/0345211 | A1 * | 11/2014 | Milburn | E06B 7/12 52/172 |
| 2015/0322708 | A1 * | 11/2015 | Kotowski | E06B 3/66304 52/745.16 |
| 2016/0168902 | A1 * | 6/2016 | Clarahan | E06B 7/14 52/172 |
| 2018/0038151 | A1 * | 2/2018 | Clarahan | E06B 7/02 |
| 2018/0252021 | A1 * | 9/2018 | Frank | E06B 3/677 |
| 2018/0320433 | A1 * | 11/2018 | Ting | E06B 3/64 |
| 2020/0270934 | A1 * | 8/2020 | Vaidya | E06B 9/264 |
| 2021/0071466 | A1 * | 3/2021 | Nüsser | E06B 3/677 |
| 2021/0172242 | A1 | 6/2021 | Schreiber et al. | |
| 2021/0230929 | A1 * | 7/2021 | Lange | E06B 3/66376 |
| 2021/0285278 | A1 * | 9/2021 | Kuster | E06B 3/66314 |
| 2022/0136317 | A1 * | 5/2022 | Vaidya | E06B 3/64 160/90 |
| 2022/0186549 | A1 * | 6/2022 | Nikitin | E06B 3/6617 |
| 2022/0228427 | A1 * | 7/2022 | Vaidya | E06B 3/66 |
| 2024/0117669 | A1 * | 4/2024 | Rapp | E06B 3/66328 |
| 2024/0167326 | A1 * | 5/2024 | Valderrama Chaparro | H02S 20/26 |

FOREIGN PATENT DOCUMENTS

| | | | |
|---|---|---|---|
| EP | 1970525 | A2 | 9/2008 |
| EP | 3404190 | A2 | 11/2018 |
| WO | WO 2019110409 | A1 | 6/2019 |

* cited by examiner

DOUBLE-SKIN FAÇADE ELEMENT

FIELD OF THE INVENTION

The invention relates to a double-skin façade element comprising a planar outer glazing element and a planar inner glazing element which are held at a distance from one another in a thermally insulated surrounding frame profile.

PRIOR ART

Façade construction frequently involves the use of double-skin façade systems in which the façade intermediate space is often rear-ventilated. However, this measure reduces thermal insulation, so that double-skin façades are increasingly designed with a substantially closed air cushion. This design is known as a CCF façade (closed cavity façade) and has a number of advantages. For example, sound insulation is improved compared to double-skin façade elements through which air flows. Furthermore, there is no ingress of dirt. Finally, thermal insulation is improved due to the insulating air cushion in the façade intermediate space between the outer and inner filling elements of the double-skin façade. However, pressure differences can occur, for example due to temperature fluctuations, so that suitable measures are required to achieve pressure equalization. There is also a possible risk of condensation in the façade intermediate space. Condensation forms when the air in the façade intermediate space falls below the dew point.

DE 10 2013 202719 A1 describes a CCF façade with single glazing on the outside and thermal insulation glazing on the inside. Solar shading is provided in the pressure-equalized façade intermediate space. Adsorbents can be placed in the façade intermediate space to reduce the risk of condensation. The adsorbents can be regenerated through heating, using either solar radiation or electric heating.

The double-skin glass façade element according to EP 1970525A2 also has solar shading in the façade intermediate space and a device for at least partially dehumidifying the façade intermediate space.

DESCRIPTION OF THE INVENTION

The problem of the invention is to propose a façade element for a façade construction that requires no external technical measures and is able to guarantee both pressure equalization in the system and condensation prevention in the system over a prolonged period of time with high energy efficiency.

This problem is solved by a double-skin façade element with the features of any of claim 1, 9, 14 or 15. Preferred embodiments follow from the other claims.

The double-skin façade element according to a first aspect of the invention comprises a planar outer glazing element and a planar inner glazing element which are held at a distance from one another in a thermally insulated surrounding frame profile, at least one pressure equalization device which is in air-conducting connection with the outside atmosphere and with a façade intermediate space which is provided between the outer glazing element and the inner glazing element, and at least one drying device fillable with desiccant which is integrated either into the façade intermediate space or into the surrounding frame profile and exchanges air with the façade intermediate space. Furthermore, at least one capillary element is provided, which is an integral part of the surrounding frame profile and is preferably formed in part by a portion of the surrounding frame profile. The pressure equalization device and the drying device are positioned and dimensioned such that they do not extend into a transparent region of the planar outer glazing element or planar inner glazing element, i.e. are not located in a transparent region of the planar outer glazing element or planar inner glazing element. The at least one drying device is designed to allow the desiccant to be replaced and preferably comprises a replacement opening configured to allow the desiccant to be replaced from the room side.

The room side refers to the installation position of the façade element and is located on the side of the inner glazing facing away from the façade intermediate space.

The transparent region of the outer glazing element and inner glazing element is understood to be the region within which an observer can see through the outer glazing element and inner glazing element in a viewing direction perpendicular to the main planes of the outer glazing element and inner glazing element, because in this region both the outer glazing element and inner glazing element are not covered by other components such as sealing strips. The dimensioning and positioning of the pressure equalization device and drying device according to the invention therefore have the advantage that these devices are fully integrated into the area of the surrounding frame profile and are thus entirely concealed from an outside observer.

The drying device can exchange air with the façade intermediate space either by the pressure equalization device interacting with the drying device, the drying device, like the pressure equalization device, being integrated into the air-conducting connection between the outside atmosphere and the façade intermediate space, or by a direct exchange of air taking place between the façade intermediate space and the drying device in parallel with the air-conducting connection between the outside atmosphere and the façade intermediate space.

"Integral part of the surrounding frame profile" means that the capillary element already forms a pre-assembled unit with the surrounding frame profile and no longer needs to be installed separately during the manufacture of a façade.

A capillary element is characterized in that it has an inner cavity whose cross-sectional dimensions are significantly smaller than its length. The inner cavity does not have to have a constant cross-section over its length, nor does it have to have a linear longitudinal extension. The capillary element is used for pressure equalization.

The façade element according to the invention contains all essential features in a manner inherent to the system. No external technical measures are required to achieve pressure equalization in the system. The pressure equalization in the system can be designed to prevent moisture ingress, to be watertight and dustproof, and/or to dampen pressure amplitudes. Furthermore, the provision of the pressure equalization device and the drying device prevents condensation in the system. The pressure equalization device can be fully integrated into the surrounding frame profile so that no visible protrusions or air ducts are required outside the façade element. The double-skin façade element is also highly energy-efficient in both winter and summer. In winter the very good thermal insulation comes into play, while in summer material temperatures no higher than 80° C. can be achieved in the façade intermediate space, so that no fogging occurs when using materials with possibly volatile components. This helps to meet the comfort criteria in summer. Compliance with the comfort criteria also depends on the degree of energy transmission between the façade intermediate space and the room interior and is influenced in particular by the planar inner glazing element and the thermal separation of the surrounding frame profile. A further contribution to meeting the room comfort criteria is made by optional solar shading provided in the façade intermediate space.

Thus, according to a preferred embodiment, the at least one capillary element may comprise a membrane with a capillary tube, the capillary tube having a length of at most 60 mm and preferably of at most 20 mm, and particularly preferably of at most 10 mm, and an inner diameter of at most 1.5 mm and preferably of at most 1.0 mm. Such a so-called short capillary tube is distributed by the company Swisspacer, for example. The operating principle is described in WO2019/110409 A1. A short capillary tube is preferably arranged in the area of the pressure relief openings. A short capillary tube can be provided that interacts with the drying device or without interaction with the drying device.

Alternatively, according to a preferred embodiment, the at least one capillary element comprises a capillary tube which has a length of at least 200 mm and optionally has a membrane or a filter or a strainer at the opening of the capillary tube to the outside atmosphere. A capillary tube with the above dimensions is referred to below as a long capillary tube. A long capillary tube can be provided as a separate component and be made of glass or metal, preferably aluminum or hard or flexible plastic.

Where long capillary tubes are provided, they have a clear cross-section of less than 1 $mm^2$, preferably less than 2 $mm^2$, more preferably less than 4 $mm^2$ and most preferably less than 6 $mm^2$. The length of the capillary tube and the clear cross-section of the capillary tube are matched to one another. An increasing capillary tube length allows an increasing clear cross-section.

A clear cross-section of any shape can be chosen. However, it is preferably circular, semi-circular, square, rectangular, triangular, diamond-shaped or elliptical.

The wall thickness of a long capillary tube provided as a separate component is between 0.5 mm and 5 mm and is preferably a maximum of 2 mm.

Where a long capillary tube is used, a membrane or filter can be provided in the area of the pressure relief opening. The length of a long capillary tube can be chosen up to the width, height or circumference of the façade element, depending on the orientation. The basic rule for a pressure equalization device with a long capillary tube is that the inlet opening of the capillary tube must be connected to the outside atmosphere. The outlet opening of the capillary tube is connected to the façade intermediate space, either without interaction with the drying device or with interaction with the drying device. The inlet opening can be arranged on the enclosure frame in the region of a main frame profile or of a sub-frame profile towards the expansion joint, and is advantageously arranged in such a way that it is protected against water ingress.

The design of a long capillary tube depends on the location of the building and the prevailing weather data consisting of the outside temperature, air pressure, relative humidity and the intensity of solar radiation, which can be generated hourly for a defined location anywhere in the world using Meteonorm software. The temperature in the space between the panes depends on the pane construction, the energy absorption coefficients of the individual panes, the use of solar shading, the intensity of the solar radiation and the air temperatures outside and inside the building, and can be calculated from the hourly weather data in accordance with EN 16612:2019, Annex C. A capillary tube presents a flow resistance to the incoming or outgoing air, which is included in the calculation model based on the capillary inner diameter and the capillary length. The calculation model is used to determine the moisture transfer via the volume flow through the capillary tube. The volume flow through the capillary tube is assumed to be directly proportional to the prevailing pressure difference.

Using the volume flow through each capillary tube of a façade element according to the invention depending on the hourly weather data, the amount of water vapor that penetrates from the outside atmosphere via the capillary tubes into the façade intermediate space and is adsorbed by the desiccant can be estimated over a defined period of time, e.g. one year.

According to a preferred embodiment, the capillary element comprises a capillary tube that is fully integrated into the surrounding frame profile of the façade element, preferably clipped into the surrounding frame profile.

According to an alternative preferred embodiment, the drying device comprises a desiccant container, and the at least one capillary element comprises a capillary tube which is integrated into the desiccant container.

According to an alternative preferred embodiment, the drying device comprises a desiccant container, and the at least one capillary element comprises a capillary tube formed from a groove in the desiccant container and a wall of the surrounding frame profile.

A further, preferred embodiment of the double-skin façade element is characterized in that the capillary element comprises a groove in the surrounding frame profile and an end profile made of plastic, a cavity being formed between the end profile and at least one inner wall of the groove. The groove can be provided in the sub-frame profile or in the main frame profile in partial areas or all around the respective frame profile.

The end profile consists of a thermoplastic material or an elastomer with high vapor tightness. Preferred materials are EPDM, butyl, polytetrafluoroethylene or polyvinylidene fluoride.

Alternatively, open-cell foam bodies can be provided as a valve and strainer interacting with the desiccant in the area of the drying device.

A further alternative design of the at least one pressure equalization device consists in the fact that is that it is provided as a capillary tube integrated into the main frame profile in partial areas or all around the main frame profile.

A further alternative design of the at least one pressure equalization device involves a capillary tube integrated into the sub-frame profile of the façade element in partial areas or all around the sub-frame profile.

The at least one pressure equalization device preferably comprises an elastic profile with at least one opening which forms part of an air-conducting connection path between the façade intermediate space and the outside atmosphere.

Finally, if a capillary tube is provided, the opening to the outside atmosphere can be placed in an elevated position, i.e. with the inlet opening to the outside atmosphere at the top of a vertical frame portion of the surrounding frame profile.

Plastic or metal can be used as the material for the capillary tube if a short capillary tube is provided. Aluminum is preferred. If a long capillary tube is provided, it can be made of glass, metal, preferably aluminum, or plastic, preferably an elastomer such as polyethylene, polypropylene, polyvinylidene fluoride or ethylene-propylene copolymer.

According to a second aspect of the invention, the double-skin façade element comprises a planar outer glazing element and a planar inner glazing element which are held at a distance from one another in a thermally insulated surrounding frame profile, at least one pressure equalization device which is in air-conducting connection with the outside atmosphere and with a façade intermediate space which is provided between the outer glazing element and the inner glazing element, and at least one drying device fillable with desiccant which is integrated either into the façade intermediate space or in the surrounding frame profile and exchanges air with the façade intermediate space, wherein the double-skin façade element further comprises means for reducing vapor diffusion, wherein the means for reducing vapor diffusion comprise wet glazing and/or comprise at least one insulation web for thermal separation in the thermally insulated surrounding frame profile made of a plastic with high vapor tightness and/or with a coating material with high vapor tightness. The pressure equalization device and the drying device are positioned and dimensioned such that they do not extend into a transparent region of the planar outer glazing element or planar inner glazing element. The drying device is designed to allow the desiccant to be replaced and preferably comprises a replacement opening configured to allow the desiccant to be replaced from the room side.

Examples of an insulation web with a coating material with high vapor tightness include the application of a vapor-tight or highly vapor-retardant foil made of thin stainless steel on the insulation web made of plastic or the application of a metalized plastic foil or butyl foil on the insulation web made of plastic or the provision of an insulation web made of a metalized plastic.

If an insulation web made of a plastic with high vapor tightness is provided, polyvinylidene fluoride can be used as the material for the insulation web.

In a double-skin façade element according to the second aspect, too, the at least one pressure equalization device can comprise a capillary element.

Similarly, in a double-skin façade element according to the second aspect, an opening in one of the at least one pressure equalization devices can be in flow connection with a second opening in a cavity fillable with desiccant of one of the at least one drying devices.

The drying device preferably comprises a desiccant container fillable with desiccant that is removably attachable to the surrounding frame profile.

According to a third aspect of the invention, the double-skin façade element comprises a planar outer glazing element and a planar inner glazing element which are held at a distance from one another in a thermally insulated surrounding frame profile, at least one pressure equalization device which is in air-conducting connection with the outside atmosphere and with a façade intermediate space which is provided between the outer glazing element and the inner glazing element, and an air routing device, wherein the pressure loss of the air flow during pressure equalization is determinable and preferably adjustable by the length and/or the cross-sectional dimensions of the air routing device and/or the number of deflections of an air flow passing through the air routing device, at least one drying device fillable with a desiccant bed which is integrated into the surrounding frame profile, wherein the at least one drying device comprises at least one first opening which is in air-conducting connection with the façade intermediate space, the at least one pressure equalization device and the at least one drying device are positioned and dimensioned such that they do not extend into a transparent region of the façade element, and the drying device is designed to allow the desiccant to be replaced and preferably comprises a replacement opening configured to allow the desiccant to be replaced from the room side.

With this alternative design, too, no external technical measures are required to achieve pressure equalization in the system. The pressure equalization in the system can be configured to prevent moisture ingress, to be watertight and dustproof, and/or to dampen pressure amplitudes. Furthermore, the provision of the pressure equalization device and the drying device prevents condensation in the system. The pressure equalization device can be fully integrated into the surrounding frame profile so that no visible protrusions or air ducts are required outside the façade element.

In this alternative design of the façade element according to the invention, the use of a separately provided capillary tube is dispensed with and instead the air flow producing the pressure equalization is guided through an air routing device whose geometry can be used to determine the pressure loss of the incoming or outgoing air occurring as a flow loss.

According to a fourth aspect of the invention, the double-skin façade element comprises a planar outer glazing element and a planar inner glazing element which are held at a distance from one another in a thermally insulated surrounding frame profile, at least one pressure equalization device which comprises an air routing device and is in air-conducting connection with the outside atmosphere and with a façade intermediate space which is provided between the outer glazing element and the inner glazing element, and at least one drying device fillable with a desiccant bed which is integrated into the surrounding frame profile, wherein the at least one drying device comprises at least one first opening which is in air-conducting connection with the façade intermediate space, and at least one second opening which is in air-conducting connection with the air routing device, the pressure loss of the air flow during pressure equalization is determinable and preferably adjustable by the pressure loss on flowing through the at least one drying device and the at least one air routing device, the at least one pressure equalization device and the at least one drying device are positioned and dimensioned such that they do not extend into a transparent region of the façade element, and the at least one drying device is designed to allow the desiccant to be replaced and preferably comprises a replacement opening configured to allow the desiccant to be replaced from the room side.

In this alternative design of the façade element according to the invention, the use of a separately provided capillary tube is dispensed with and instead the air flow producing the pressure equalization is guided through the drying device and the path of the air flow through the desiccant bed is chosen in such a way that, on the one hand, the pressure loss is not so high as to prevent an exchange of air when pressure differences occur, but, on the other hand, the air flow during pressure equalization passes through the desiccant bed over as long a distance as possible in order to ensure that the desiccant becomes loaded with moisture as evenly as possible and thus increase the service life until the desiccant is replaced. An air-conducting connection is either a direct connection or an indirect connection. In the case of a direct connection, for example, the first opening leads directly into the façade intermediate space and/or the second opening connects the inside of the drying device with the air routing device. In the case of an indirect connection, other elements such as a filter, for example, can be interposed. Since the cost of capillary tubes increases the manufacturing costs of double-skin façade elements and additional costs are incurred for the maintenance and servicing of capillary tubes, façade elements that do not use capillary tubes represent a considerable simplification and improvement, though the increased flow of air through the desiccant means that the desiccant is loaded with moisture faster and, for a given mass of desiccant, the time interval for replacing the moisture-laden desiccant decreases. Additional measures are thus called for in this case to reduce moisture ingress.

Desiccant consumption can preferably be determined depending on the location of the façade element integrated into a façade, the type of desiccant and the design features of the façade element.

However, when designing the double-skin façade element without a capillary tube, it is essential that a sufficient quantity of desiccant is provided to prevent condensation in the façade intermediate space for a preselected desiccant replacement time, which is only possible if, for a given location and under the climatic conditions prevailing there, the desiccant is replaced at latest when fully loaded with water. The required quantity of desiccant is thus preferably calculated depending on the location of the building in which the double-skin façade element according to the invention is to be installed, as well as the orientation of the façade, which has a significant influence on the solar radiation. The weather data prevailing at a location anywhere in the world can be generated hourly with the help of Meteonorm software. The weather data includes the outside temperature, air pressure, relative humidity and the intensity of solar radiation. The temperature in the space between the panes depends on the pane construction, the energy absorption coefficients of the individual panes, the use of solar shading, the solar radiation and the air temperatures inside and outside the building, and can be calculated for every hour of the year from the weather data in accordance with EN 16612:2019, Annex C.

In this way it is possible to estimate the amount of water vapor which flows from the outside atmosphere into the façade intermediate space with the volume flow of air during pressure equalization over a defined period, for example over a year. This amount of water vapor must be adsorbed by the desiccant. If the desiccant is to be replaced every 10 years, for example, a sufficient quantity of desiccant must be provided so that the quantity of water vapor transported with the air flow into the façade space over the 10-year period during pressure equalization can be adsorbed in the desiccant until it is replaced with regenerated or fresh, non-moisture-laden desiccant. The maximum amount of water vapor that can be absorbed by a specific desiccant, for example a specific zeolite material, per unit of mass is known for individual desiccants. A suitable calculation model has been developed by ift Rosenheim.

Once the calculations described above have been carried out for a specific location, then if the structure of the double-skin façade element differs, for example if the volume of the façade intermediate space is smaller and the dimensions of the façade element have changed, the required quantity of desiccant can simply be derived from the existing calculations, because the air flow into the façade intermediate space during pressure equalization and thus the water vapor to be absorbed by the desiccant is proportional to the volume of the façade intermediate space.

Alternatively, a standard façade element can also be provided and the above calculation can be used to adjust the resulting desiccant replacement time depending on the location and orientation of the intended place of use of the double-skin façade element.

If the pressure equalization becomes insufficient, it may be necessary to limit the pressure loss/flow resistance. In the case of the air flow through the desiccant filling, this necessarily means that the path through the desiccant filling must be shortened. In addition to the embodiments described above with at least a second opening in the desiccant container halfway up, it may also be necessary to limit the path through the desiccant by reducing the desiccant filling level. This then has the desired effect of smaller pressure losses/smaller flow losses, but at the same time the effect of larger weather-related air volumes—and hence larger moisture volumes—and thus higher desiccant consumption. This is acceptable as long as the intentionally reduced desiccant supply has a reasonable service life until the desiccant supply is fully moisture-laden and a specified replacement interval for the desiccant supply can therefore be adhered to. Reducing the path through the desiccant by reducing the desiccant filling level therefore triggers two effects. This optimization task basically involves re-measuring the volume flow through the desiccant depending on the applied pressure and hence the pressure loss. This data is then converted into weather-dependent values for desiccant consumption as described above.

According to a preferred embodiment, the air routing device comprises deflector elements which can be used to create a winding flow path for the air through the air routing device. A flow path with a plurality of deflections to change the direction of the air flowing through on the one hand serves to increase the pressure loss, whilst on the other hand the deflections can also serve as inertial separators for dust carried in the air flow, which as a result does not enter the façade intermediate space. Another advantage of this measure is that there is no need to install filters, strainers or membranes in the air flow path.

The at least one drying device is preferably integrated into cavities in the elements of the surrounding frame profile that are arranged vertically in the installation position. This makes optimum use of the available installation space and ensures that the drying device is not visible even when viewed from a direction other than a direction perpendicular to the main plane of the glass elements.

In addition, according to a preferred embodiment, the at least one drying device can be integrated both into cavities of the elements of the surrounding frame profile arranged vertically in the installation position and into cavities of the elements of the surrounding frame profile arranged horizontally in the installation position.

Also in the embodiments according to the third and fourth aspects of the invention, the double-skin façade element may further comprise means for reducing vapor diffusion, the means for reducing vapor diffusion comprising wet glazing and/or at least one insulation web for thermal separation in the thermally insulated surrounding frame profile made of a plastic material with high vapor tightness and/or with a coating material with high vapor tightness.

In all alternative designs of the double-skin façade element according to the invention, a cover attachable to the surrounding frame profile can advantageously be provided, which is preferably screwed or clipped onto the sub-frame profile.

This cover attachable to the surrounding frame profile is preferably made of a plastic material with water adsorption capacity. In this way, part of the water vapor carried by air flowing from the outside atmosphere into the façade intermediate space is adsorbed in the plastic material of the cover, and desorbed again from the material of the cover when dried air flows out of the façade intermediate space into the outside atmosphere. This reduces the amount of moisture entering the façade intermediate space, thus increasing the service life of the desiccant.

All alternative solutions according to the invention ensure condensation prevention in the system over an extended period of time. The provision of means to reduce vapor diffusion also delays the entry of water vapor into the façade intermediate space, as does the provision of a capillary element which can be part of the pressure equalization device and at the same time has the function of reducing the entry of water vapor into the façade intermediate space. Both measures, which can be implemented individually or in combination with each other, extend the time until the adsorbents in the drying device are exhausted, as the adsorbents can bind a defined amount of water before they have to be replaced and regenerated under either reduced pressure or increased temperature.

The self-sufficient, pressure-relieved façade element according to the invention is a double-skin façade element, which is preferably designed as a sub-element of an element façade. The basic concept involves combining a double-skin façade element with a pressure equalization device and a drying device.

The pressure equalization devices preferably have at least one of the following properties: vapor diffusion inhibiting, waterproof, dustproof and pressure amplitude damping. Various configurations are possible to achieve these properties individually or in combination.

According to a preferred embodiment of the invention, the surrounding frame profile comprises a main frame profile and a sub-frame profile, the main frame profile and the sub-frame profile being detachably connected to each other via connecting means, and the sub-frame profile holding the outer glazing element. In this way, the double-skin façade element comprising the at least one pressure equalization device and the at least one drying device fillable with desiccant can be opened in the installed state in order to install solar shading, for example.

The sealing between the main frame profile and the sub-frame profile should preferably be vapor-tight. "Vapor-tight" means that the sealing material has only negligible vapor permeability. One example of a suitable material is thermoplastic butyl. The at least one pressure equalization device is preferably arranged in the main frame profile or in the sub-frame profile.

The double-skin façade element preferably comprises at least one solar shading device in the façade intermediate space between the outer glazing element and the inner glazing element. The solar shading device is preferably designed to be adaptive.

Providing a solar protection device serves to increase comfort in summer, but also in winter when the sun is low. Furthermore, the thermal insulation can be influenced by influencing the radiation and convection percentage.

According to a preferred embodiment, the inner glazing element comprises either multi-pane insulating glass, preferably with two or three panes, or vacuum insulating glass. The interior multi-pane insulating glass preferably has U-values of 0.5 to 1.4 $W/(m^2K)$. Alternatively, vacuum insulating glass with U-values of 0.7 $W/(m^2K)$ and less can be provided. The thermal insulation of the surrounding frame profile is located in the region of the thermally insulated inner glazing. In terms of building physics, it is important that the surrounding frame in the region of the outer glazing is not thermally insulated, as otherwise condensation problems would increasingly occur at position 2 of the outer glazing.

Furthermore, the outer glazing element is preferably provided as monoglass, preferably as laminated glass or laminated safety glass, and preferably comprises at least one functional layer, particularly preferably a wavelength-selective coating.

Alternatively or additionally, other functional layers can also be provided, such as solar and/or thermal protection layers. Examples of a wavelength-selective coating include an LE coating or a switchable coating. It is particularly advantageous to provide solar and/or thermal protection layers on the surfaces commonly referred to as position 1 and/or 2. If functional layers are provided at position 1 or 2, these can be applied over the entire surface or in partial areas. In the same way, however, it is also possible to provide double multi-pane insulating glass on the outside and, if necessary, also provide it with functional layers, in particular solar and/or thermal insulation layers.

The double-skin glass construction has an all-round, thermally insulated surrounding frame profile made of metal. Preferably, the surrounding frame profile is made of aluminum, which can particularly preferably be provided with hollow chambers. The surrounding frame profile should be largely vapor-tight. Various measures are possible individually or in combination, in particular measures on the insulation webs. The insulation webs are preferably provided all around with a vapor-tight or highly vapor-retardant foil applied to them, which is also led around the mitered corners of the surrounding frame profile to improve the vapor tightness of the entire surrounding frame profile in order to seal the mitered corner bonding at the same time. The glazing embedding area can be sealed by sealing with suitable sealants.

Preferably, an air-conducting connection path, preferably comprising a filter element, is provided between the at least one pressure equalization device and the façade intermediate space.

Preferably, an opening in one of the at least one pressure equalization devices is in flow connection with a second opening in a cavity fillable with desiccant of one of the at least one drying devices.

Preferably, the drying device comprises a cavity fillable with desiccant which is an integral part of the surrounding frame profile and has a replacement opening that is configured to allow the desiccant to be replaced.

Preferably, the pressure equalization device comprises a cavity that includes an opening into the façade intermediate space, and the cavity is filled with desiccant.

Preferably, the at least one pressure equalization device comprises an elastic profile with at least one opening which is arranged in an air-conducting connection path between the façade intermediate space and the outside atmosphere.

According to a preferred embodiment of the invention, the double-skin façade element comprises an opaque inner element and an outer element, which are held at a distance from one another. The outer element can also be opaque. In a preferred embodiment, however, the outer element is transparent.

According to an advantageous embodiment, the opaque inner element and the transparent outer element can be held in a further surrounding frame profile. This embodiment constitutes a so-called "shadow box".

The optionally provided opaque elements are preferably arranged in the spandrel area and can be designed as glass elements or as panel or sheet metal elements. If the transparent elements are provided as a glass element, this can be designed as monoglass, laminated glass, laminated safety glass or double multi-pane insulating glass, and either coated on the outside or inside or body-tinted to create the desired properties. If a panel or sheet metal element is provided, thermal insulation is preferably provided on the inside.

If a panel is provided on the room side, the transparent region and opaque region can be arranged in the surrounding frame profile. Alternatively, two separate surrounding frame profiles can be provided, the surrounding frame profile being provided for the transparent region and a further surrounding frame profile being provided for the opaque region. The thermal insulation of the further surrounding frame profile is preferably located in the area of the glass panes or the panel. If sheet metal elements are provided, thermal insulation on the inside is preferred.

Preferably, all components are accessible and can thus be maintained, repaired and even replaced. This also applies to any optional solar shading. However, it is also particularly preferable to design the façade elements such that the pressure equalization device and the glass panes are accessible in the same way and can therefore be replaced.

The pressure equalization device with moisture ingress limitation can be designed as required and thus adapted to local climatic conditions such as solar radiation, outside air temperature and wind stresses.

The purpose of the drying device is to provide an additional safeguard to the pressure equalization device that limits the ingress of moisture. The desiccant volume provided is based on the adsorption capacity of the desiccant, i.e. the maximum amount of water vapor that can be absorbed per unit volume of desiccant. However, the desiccant volume also depends on how effectively moisture ingress is limited by the pressure equalization device. Finally, the local climatic conditions and the enclosed volume of the façade intermediate space must also be taken into account.

The pressure equalization device and the drying device can interact. If no interaction is desired between the pressure equalization device and the drying device, the pressure equalization device can be arranged with a direct connection to the façade intermediate space in the sub-frame profile or in the main frame profile in a separate hollow chamber next to the drying device. Alternatively, it is also possible to arrange the pressure equalization device in the main frame profile or sub-frame profile without a flow connection to the drying device.

If the pressure equalization device and the drying device are to interact, this can be done either without direct physical contact between the pressure equalization device and the drying device, or with direct physical contact between the pressure equalization device and the drying device. If there is to be no physical contact between the pressure equalization device and the drying device, this can be done either with or without a pipe. If direct physical contact is to be provided between the pressure equalization device and the drying device, the pressure equalization device can be installed either in the main frame profile or sub-frame profile or in the desiccant container.

The pressure equalization device can be arranged in the horizontal surrounding frame profile and/or in the vertical surrounding frame profile. If the pressure equalization device is arranged in the horizontal surrounding frame profile, it is located either outside in the sub-frame profile at the bottom and/or top and/or to the side. The number of pressure equalization devices must be provided according to need. If a plurality of pressure equalization devices are provided, these are preferably arranged offset relative to one another.

This also applies if the pressure equalization device is arranged in the vertical main frame profile on one side and/or both sides. One or more pressure equalization devices can be provided and, if several pressure equalization devices are provided, these are preferably arranged offset relative to one another.

If the pressure equalization devices are arranged both in the horizontal main frame profile and in the vertical frame profile, they are arranged either horizontally at the bottom plus vertically on one or both sides, or horizontally at the top plus vertically on one or both sides. Alternatively, however, the pressure equalization device can also be arranged on all sides of the main frame profile.

The number of pressure equalization devices is according to need. The main influencing factors here are the volume of the façade intermediate space and the local climatic conditions, taking into account the orientation of the façade.

The drying devices with desiccant include a moisture-adsorbing substance to help prevent condensation. Examples include silica gel or zeolite-based adsorbents. The drying devices are located in hollow chambers of the frame profiles or separate containers. If the drying devices with desiccant are located in hollow chambers of the frame profiles, these can be arranged in a hollow chamber in the sub-frame profile and/or main frame profile in partial areas or in all hollow chambers. If the drying devices are provided in separate containers, these can be arranged either in the façade intermediate space between the outer and inner glass elements and attached to partial areas or to all parts of the surrounding frame. Alternatively, drying devices with separate containers can be arranged in the spandrel area of the façade elements and placed in air-conducting connection with the façade intermediate space.

Desiccant replacement can be carried out in different ways. On the one hand, the desiccants can be sucked out of the cavities of the frame profiles from the inside or outside and reintroduced by blowing in new material or after regeneration following appropriate treatment by desorption of water vapor. If the opening is located at the bottom, the exhausted desiccant can be discharged under the influence of gravity. It is particularly preferable to replace the desiccant through resealable openings in the frame profiles. Finally, it is also possible to completely replace containers of exhausted desiccant by removing the container after dismantling or opening glass panes to gain access to the façade intermediate space, and either immediately replacing it with a new container or by reinserting the container after regenerating the desiccant contained therein.

The outer glazing element is preferably removed, but it is also possible to remove the inner glazing element if the surrounding frame profile is designed accordingly, for example by removing an inner glazing bead.

There are various options for gaining access to the façade intermediate space from the outside and/or inside. On the one hand, the inner glass element and/or outer glass element can be removed. Alternatively, depending on the façade design, it may also be possible to open either the inner or outer glass element. For example, a pivot window could be provided for this purpose, which can be opened by unlocking a pivot fitting. The glass elements are accessible once the glazing beads or pressure bars have been removed.

If the outer glass pane is not held by a glazing bead but is firmly connected to the sub-frame profile, the outer glass element can be removed by loosening the screw connection that screws the sub-frame profile to the main frame profile. If a suspension method is used to connect the sub-frame profile to the main frame profile, the sub-frame profile can be detached from the main frame profile.

Accessibility to the façade intermediate space is advantageous in order to be able to replace damaged glass panes and to clean components and surfaces of the façade intermediate space. Another purpose is to be able to maintain, repair or replace components in the façade intermediate space. In particular, this includes optional solar shading, a drying device and components of the pressure equalization devices.

The façade element according to the invention is largely vapor-tight. Various measures are provided to achieve this. On the one hand, wet glazing of the glass panes inside and outside with the surrounding frame can be provided. An intermediate butyl sealant layer can be provided if necessary to improve vapor tightness. Another measure to achieve a high degree of vapor tightness is to provide vapor-diffusion-reducing measures on one or both insulation webs for thermal separation. For example, thin stainless steel foils with a thickness of no more than 0.050 mm or metalized plastic foils can be used. Alternatively, plastics with high vapor tightness such as butyl or polyvinylidene fluoride can be used for the insulation webs, or such a plastic can be applied to the surface of the insulation webs by coextrusion. The insulation webs can also be made entirely from a plastic with high vapor tightness, such as polyvinylidene fluoride. Another alternative or supplementary measure to improve vapor tightness is to seal off ducts and/or additionally seal frame corner connectors. Again, seals or bonded foils can be used as described in connection with the insulation webs. For this purpose, a vapor-diffusion-inhibiting foil can be applied all around the internal or external insulation web after manufacture of the surrounding frame profile, which also seals the miter corners.

The most preferred measure to increase vapor tightness is to apply a butyl layer to the insulation webs, preferably from the outside.

According to a preferred embodiment of the double-skin façade element, the pressure equalization device and the drying device in the façade intermediate space can be accessed by opening or removing the outer glazing element or an opaque outer element or the inner glazing element or an opaque spandrel element. In other words, by removing or opening the glazing element or panel arranged on the outside or inside of the façade, access to the façade intermediate space is possible in order to check the functioning of the pressure equalization device and drying device and to make them accessible for maintenance. For example, it may be necessary to clean the pressure equalization device by blowing through it. Moreover, the pressure equalization device and drying device can be repaired and replaced. So, for example, a capillary tube or a cover profile forming the capillary element together with a groove in the surrounding frame profile can be replaced. Similarly, if a separate desiccant container is provided, it can be entirely replaced or the desiccant in the drying device can be replaced.

To summarize, the basic variants are as follows:

Variant 1:
- A capillary tube is used
- The pressure loss of the air flow during pressure equalization is the pressure loss when air flows through the capillary tube.
- The desiccant interacts directly with the façade intermediate space and the pressure equalization air flow does not pass through it.
- The desiccant can be replaced by access from the outside, preferably from the room side.
- Further measures are optionally taken to increase the vapor tightness of the façade element.

Variant 2:
- A capillary tube is used
- The desiccant interacts directly with the capillary tube and the pressure equalization air flow passes through it.
- The total pressure loss of the air flow during pressure equalization is the sum of the pressure loss when air flows through the capillary tube and the pressure loss when air flows through the desiccant.
- The desiccant can be replaced by access from the outside, preferably from the room side.
- Further measures are optionally taken to increase the vapor tightness of the façade element.

Variant 3:
- No capillary tube is provided.
- An air routing device, which is led through the desiccant, is provided.
- The total pressure loss of the air flow during pressure equalization is the sum of the pressure loss when air flows through the air routing device and the pressure loss when air flows through the desiccant.
- The desiccant can be replaced by access from the outside, preferably from the room side.
- Further measures are optionally taken to increase the vapor tightness of the façade element.

Variant 4:
- No capillary tube is provided.
- Pressure equalization takes place via an air routing device without the flow through the desiccant.
- The total pressure loss of the air flow during pressure equalization is the pressure loss when air flows through the air routing device.
- The desiccant exchanges air with the façade intermediate space.
- The desiccant can be replaced by access from the outside, preferably from the room side.
- Further measures are optionally taken to increase the vapor tightness of the façade element.

Which of the variants is preferred depends on the specification in terms of the desired desiccant replacement interval, which can be estimated from the climatic conditions at the intended place of use, the volume of desiccant, the water absorption capacity of the desiccant and the design features of the façade element.

BRIEF DESCRIPTION OF THE DRAWINGS

In the following figures, the invention is described purely by way of example on the basis of various embodiments. These show the following.

Figure 29:
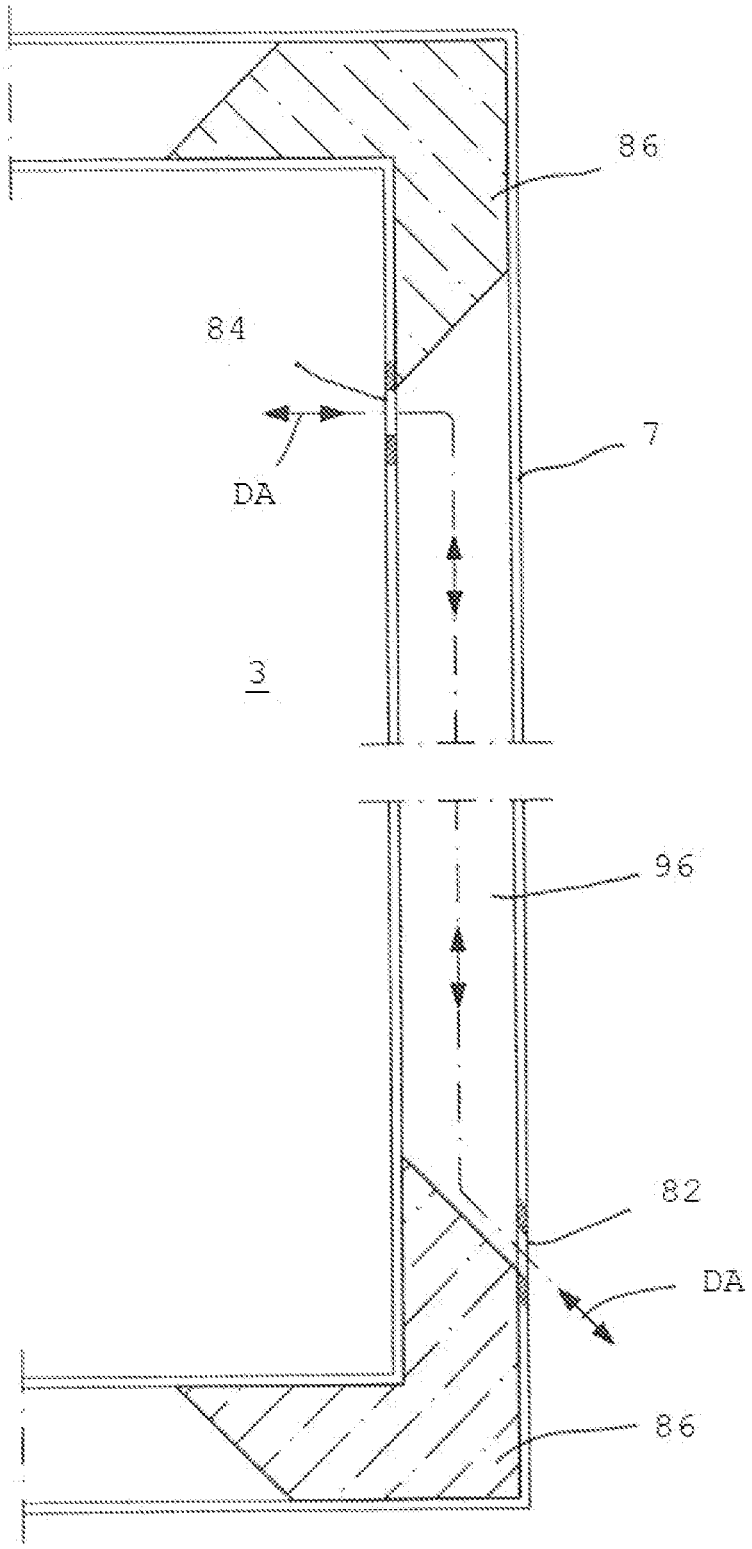
Figure 30:
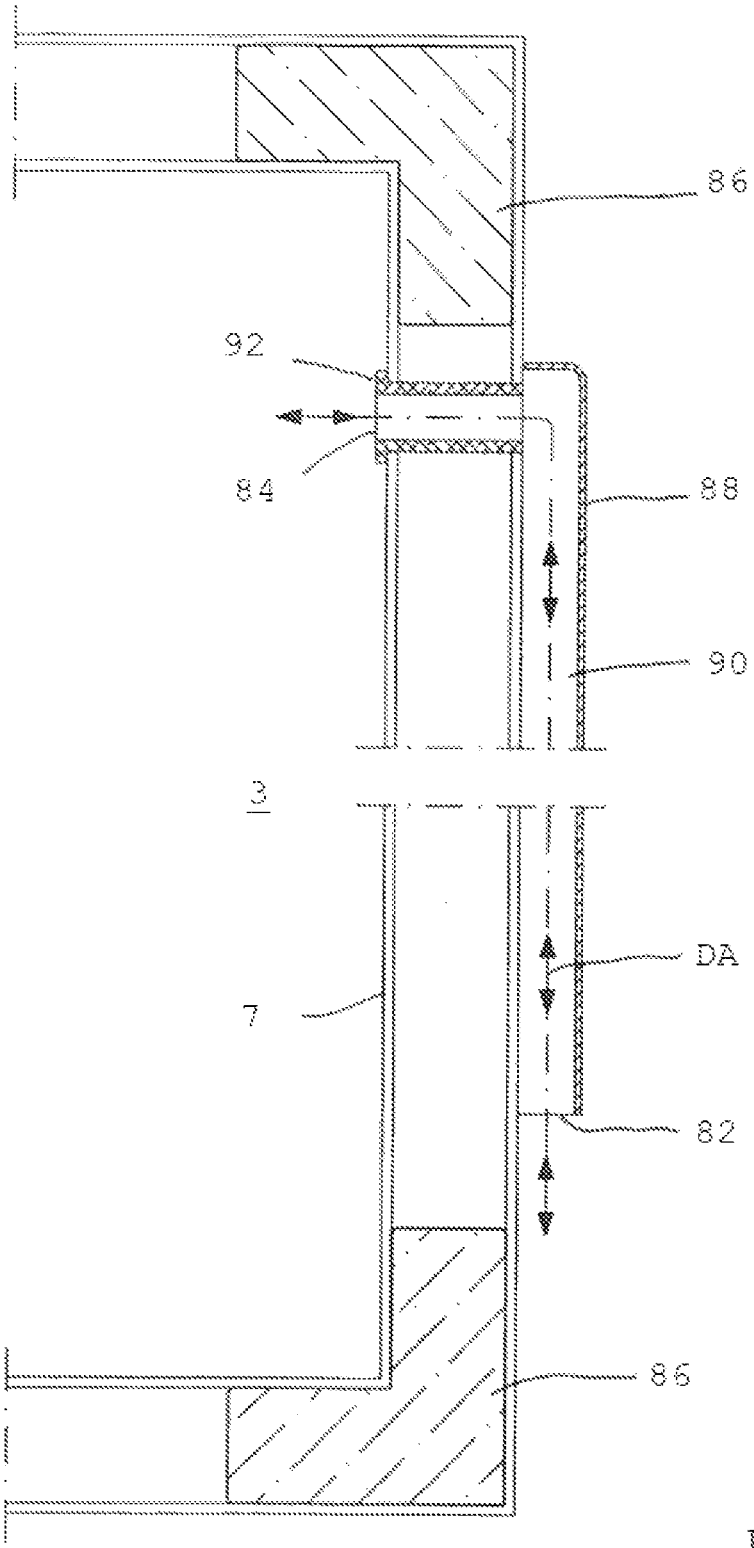
Figure 31:
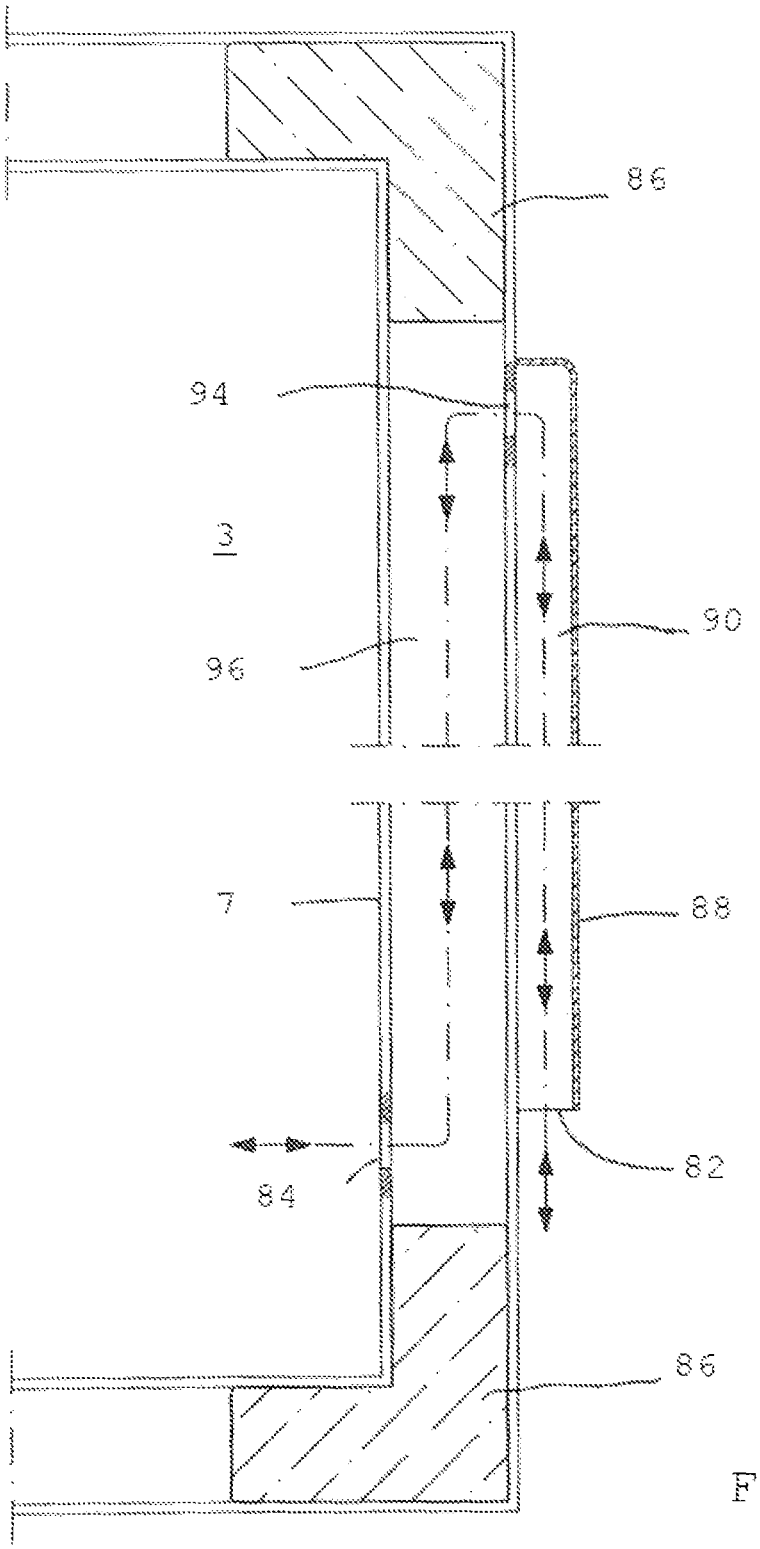
Figure 32:
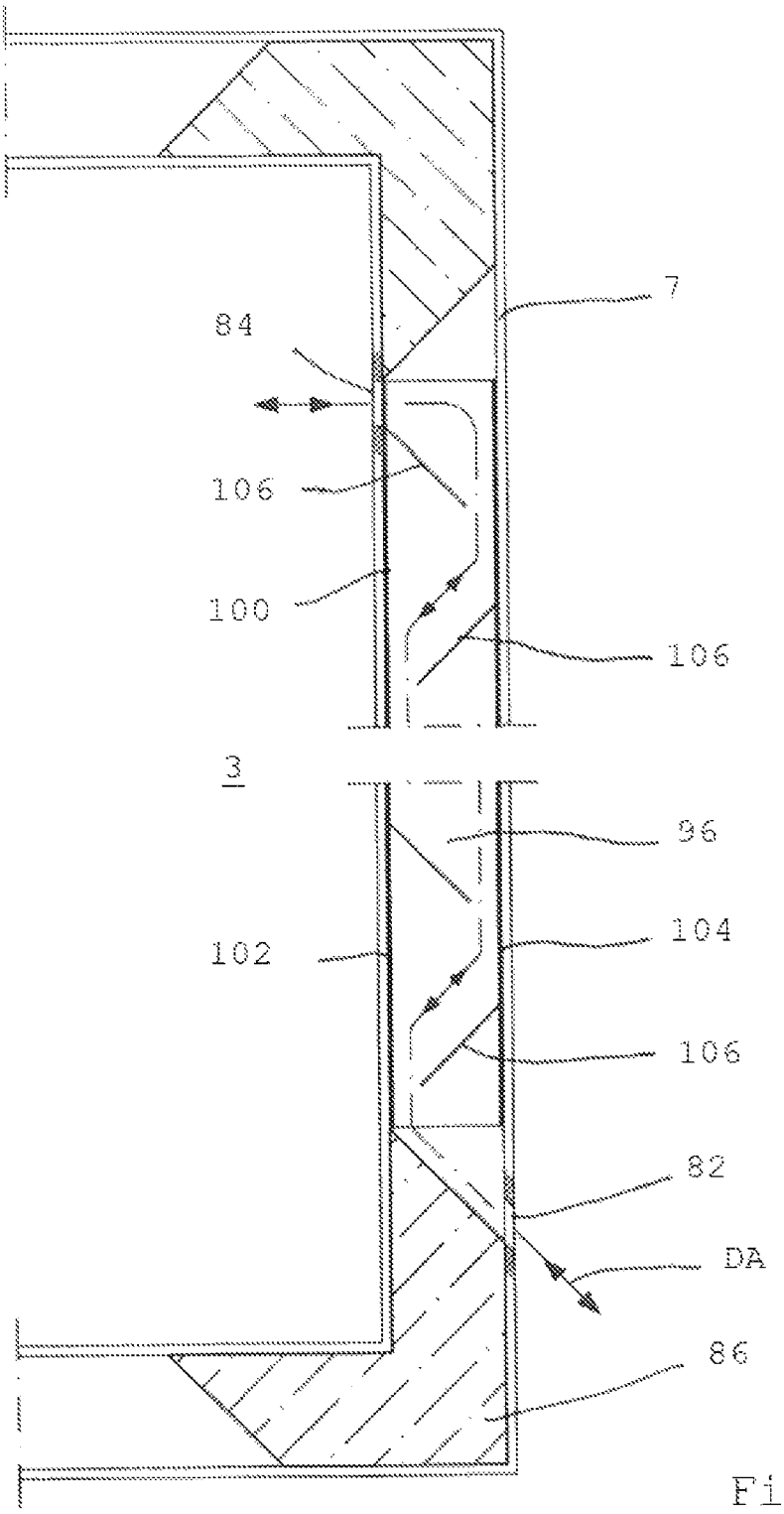
Figure 33A:
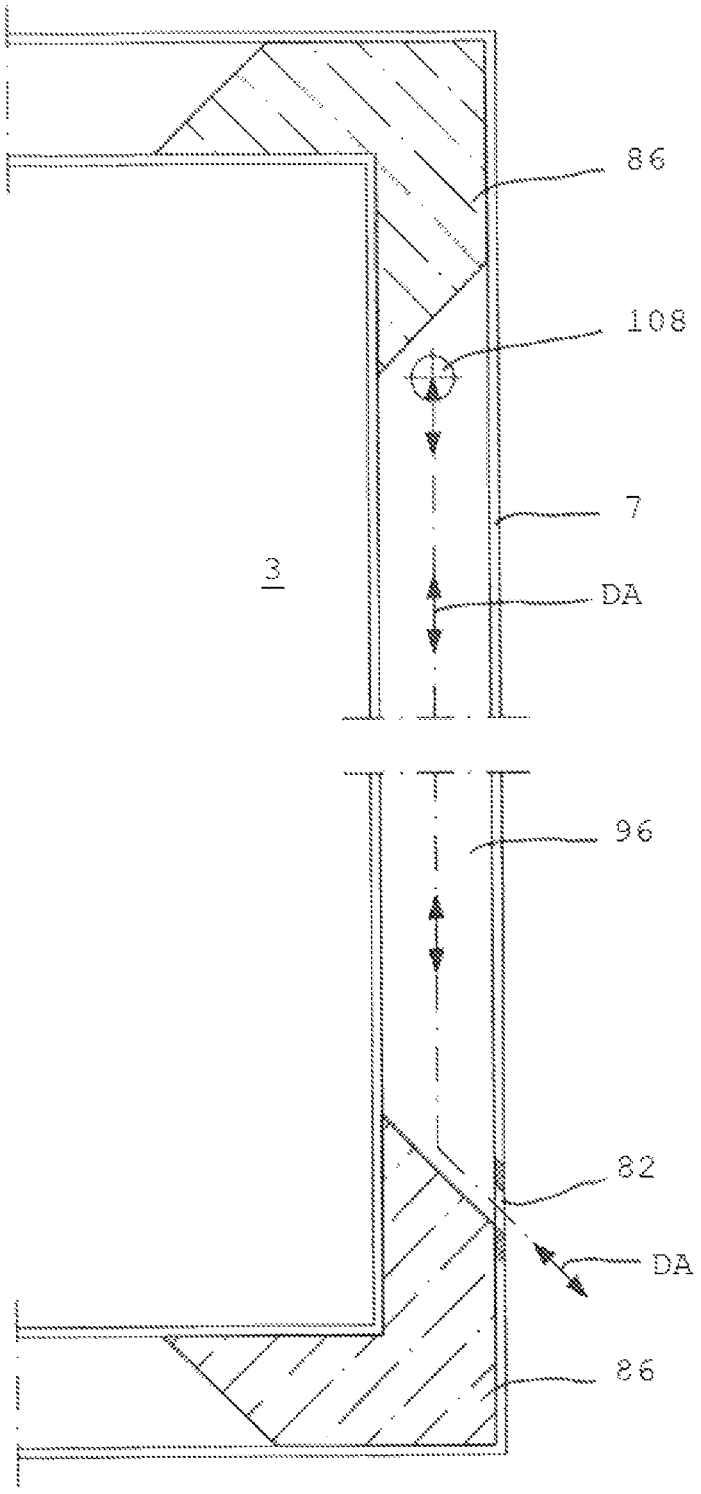
Figure 33B:
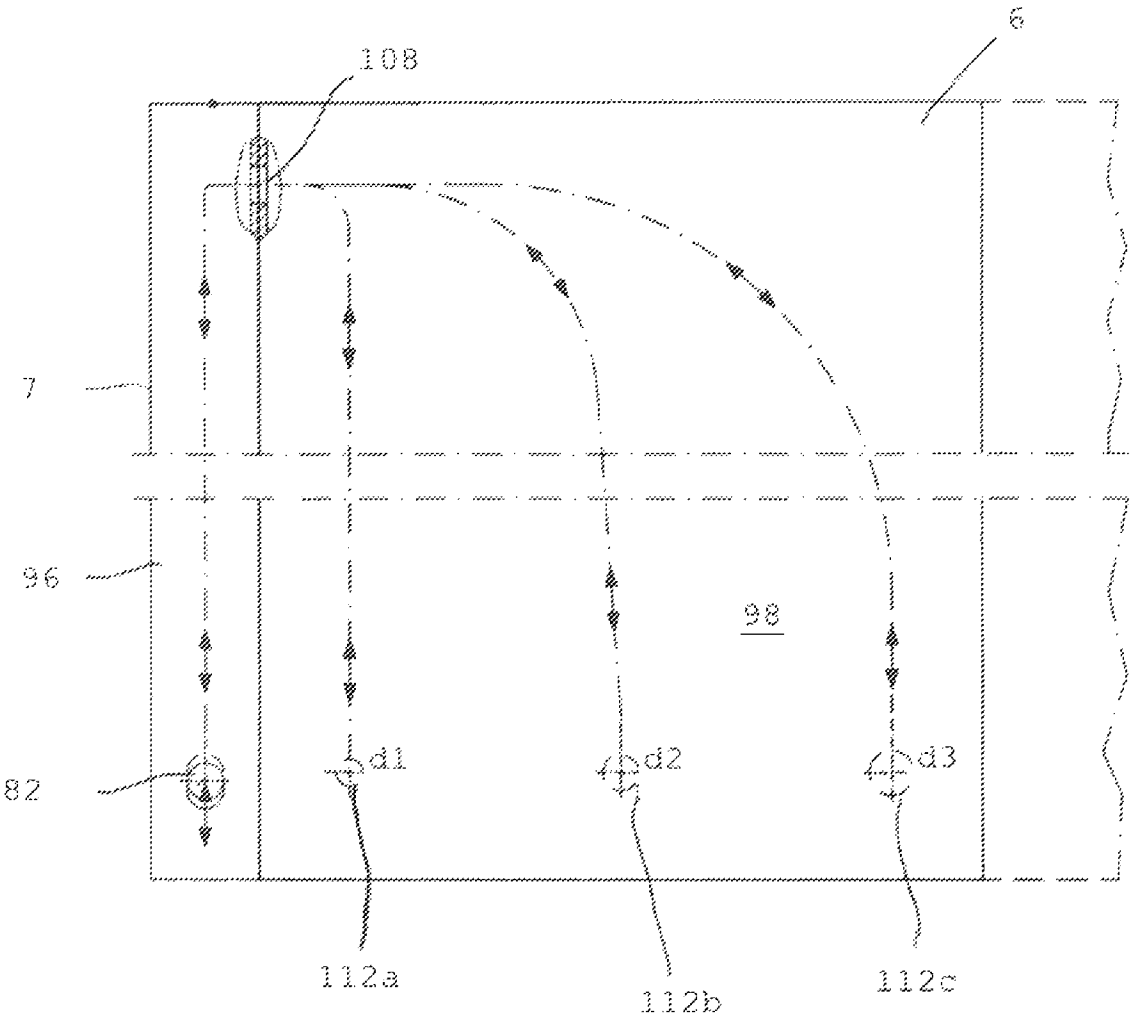
Figure 34A:
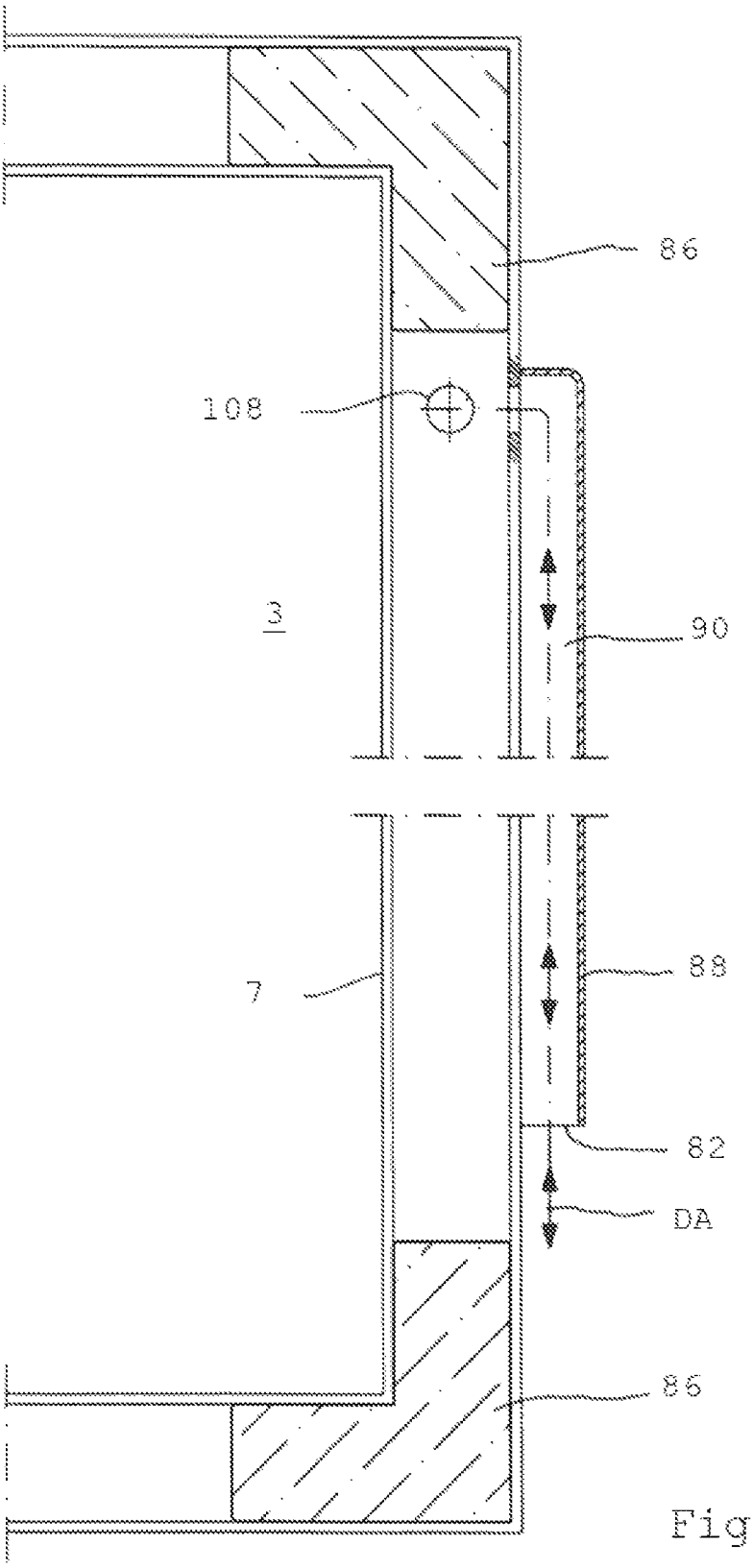
Figure 34B:
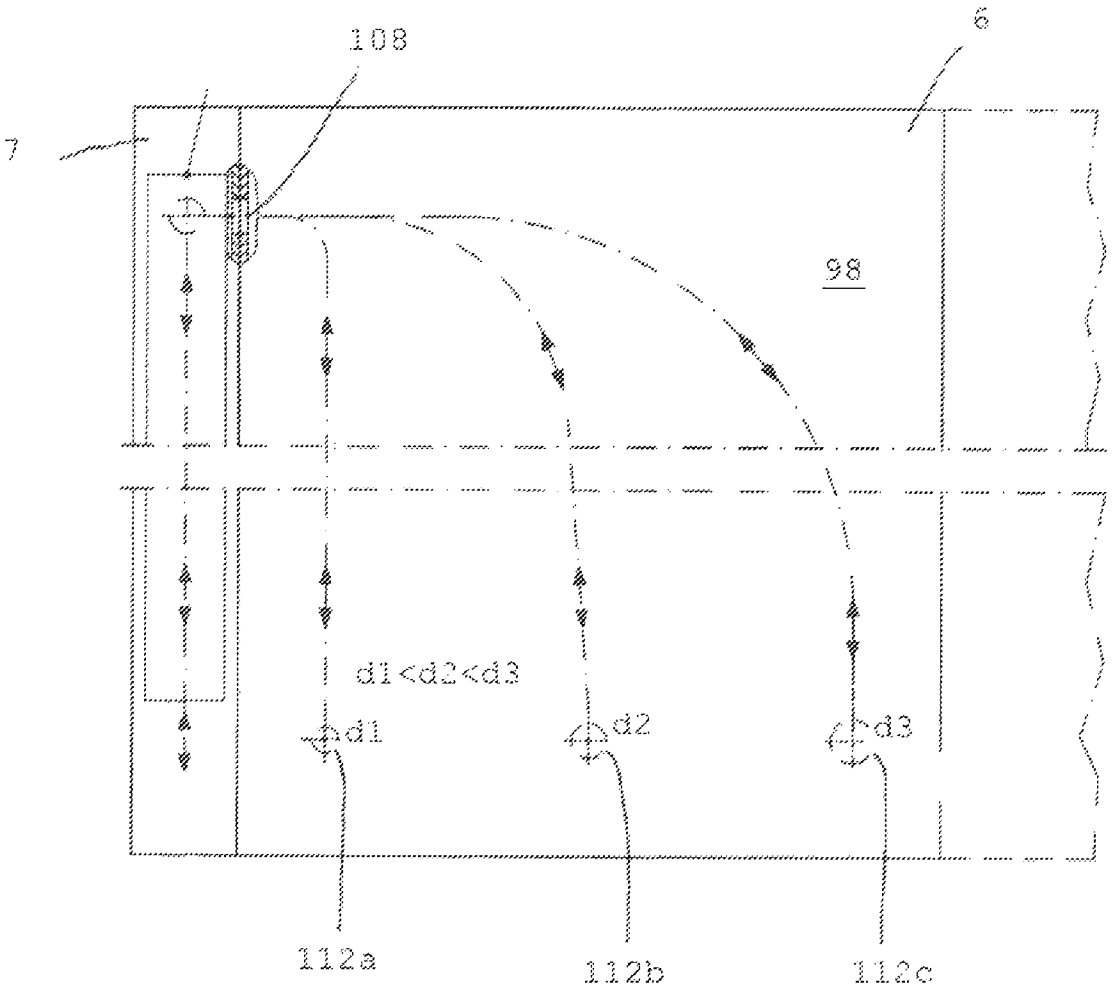
Figure 35A:
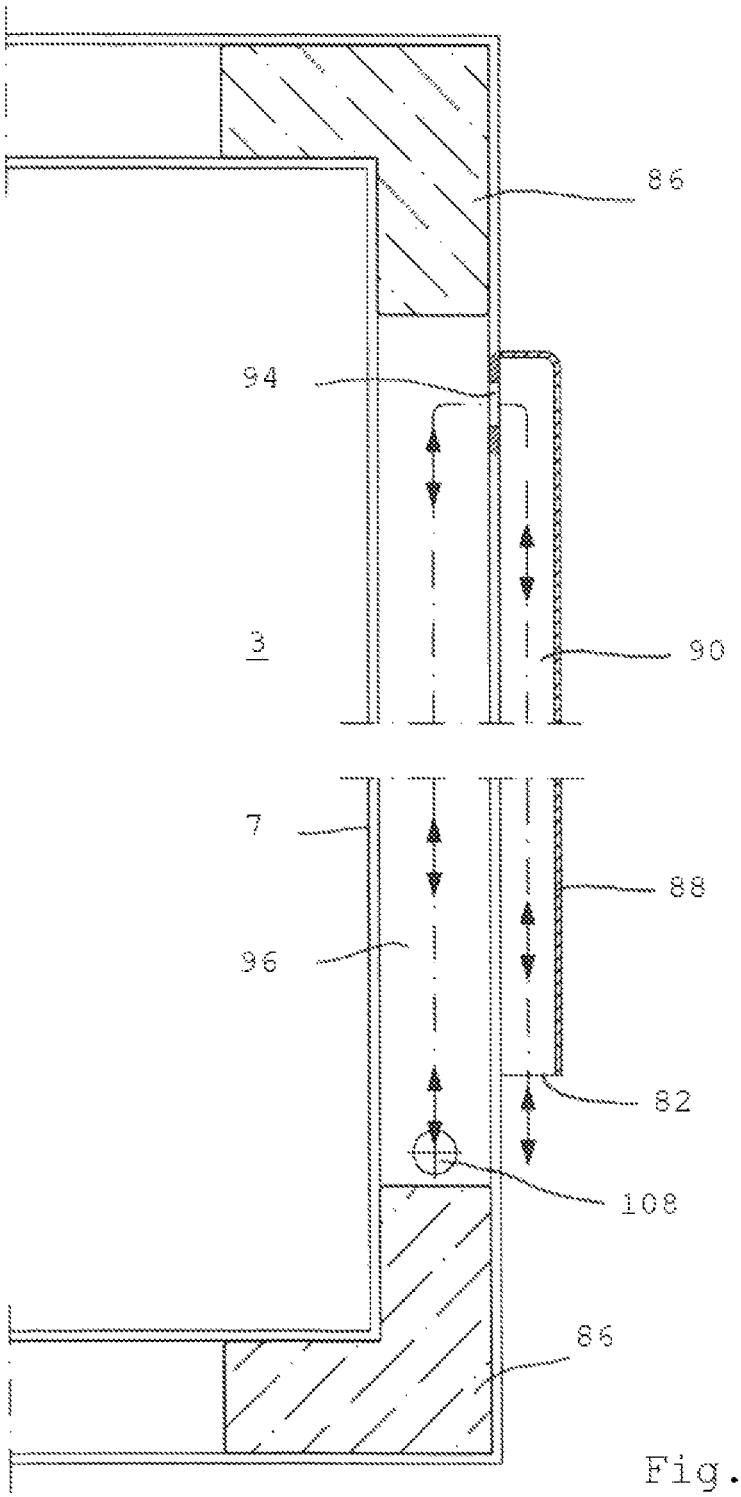
Figure 35B:
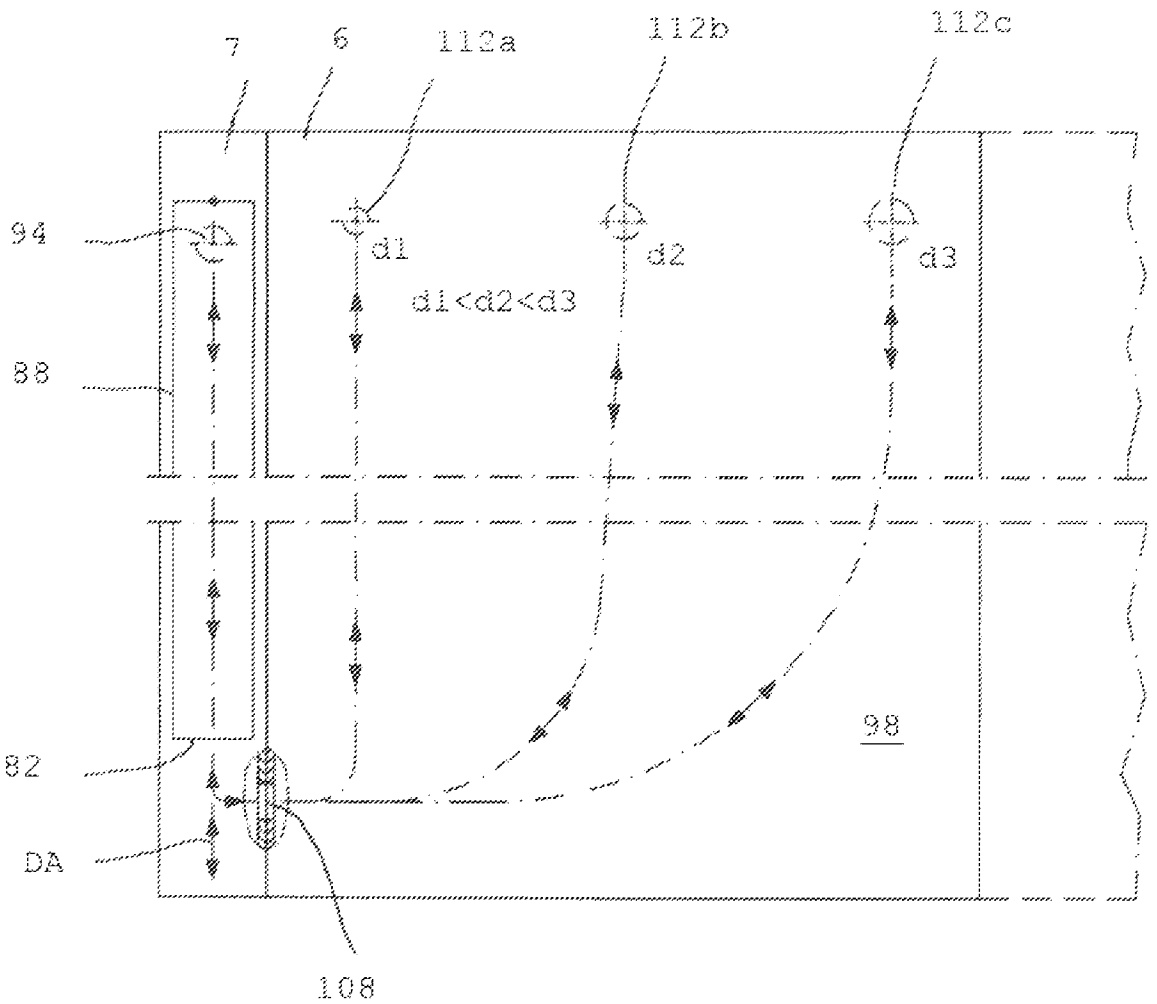
Figures 35C, 35D:
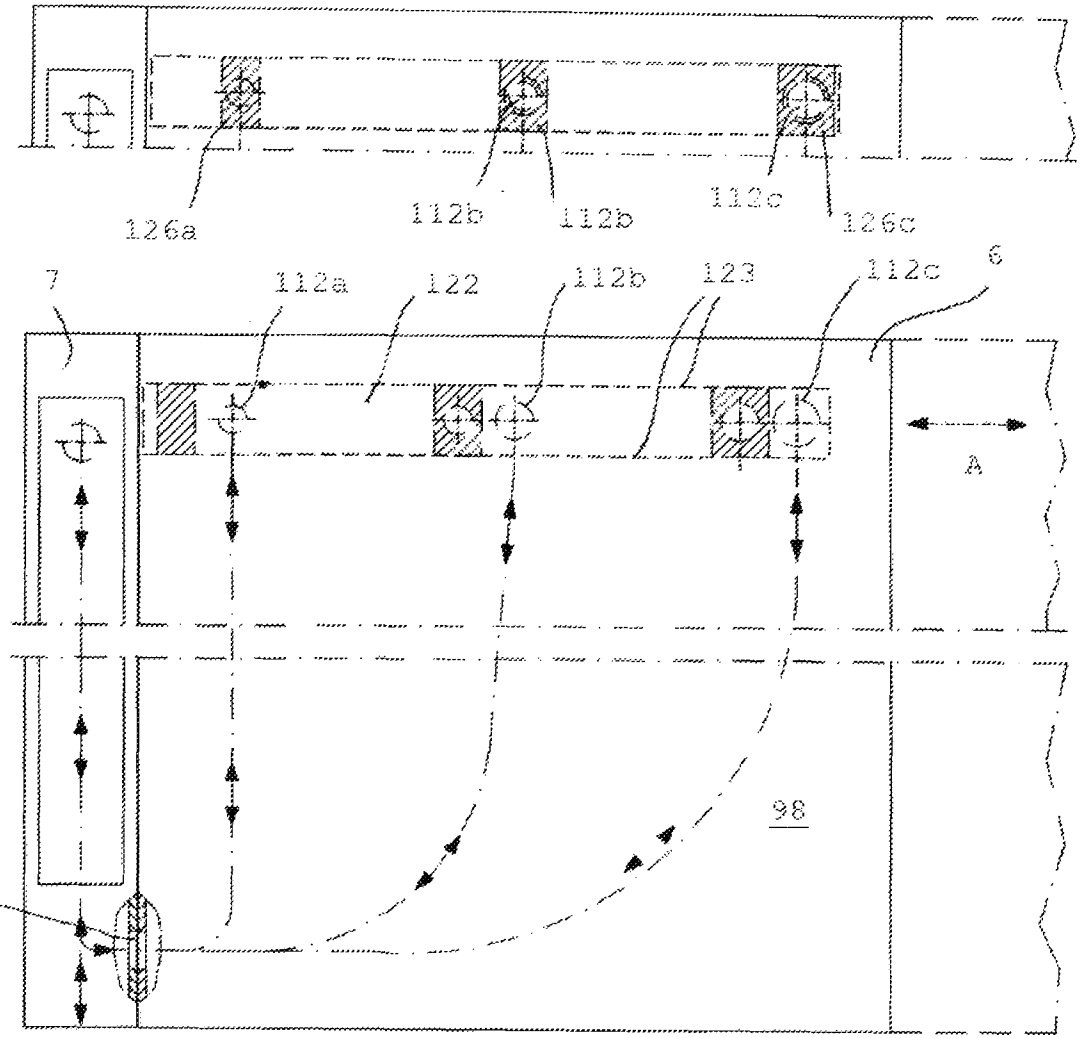
Figure 36A:
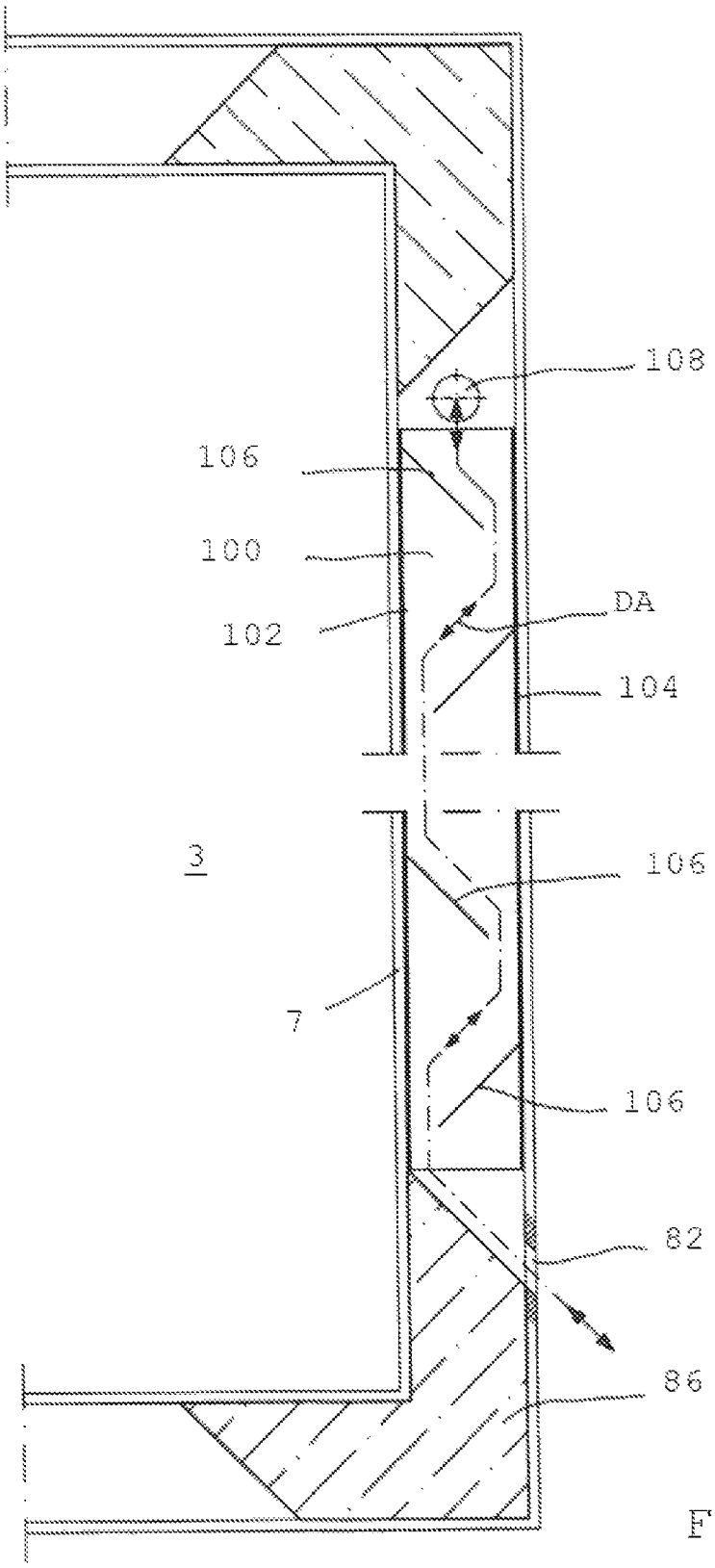
Figure 36B:
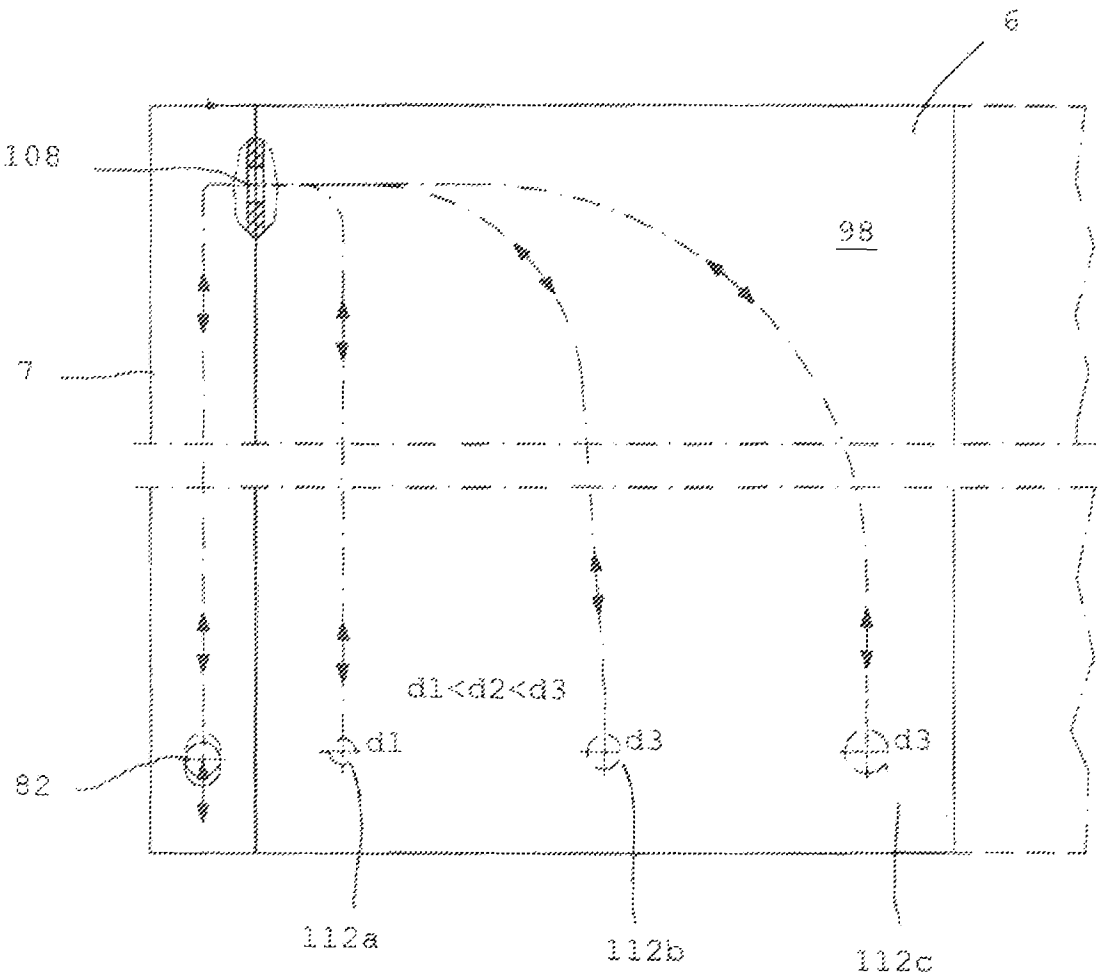
Figure 37A:
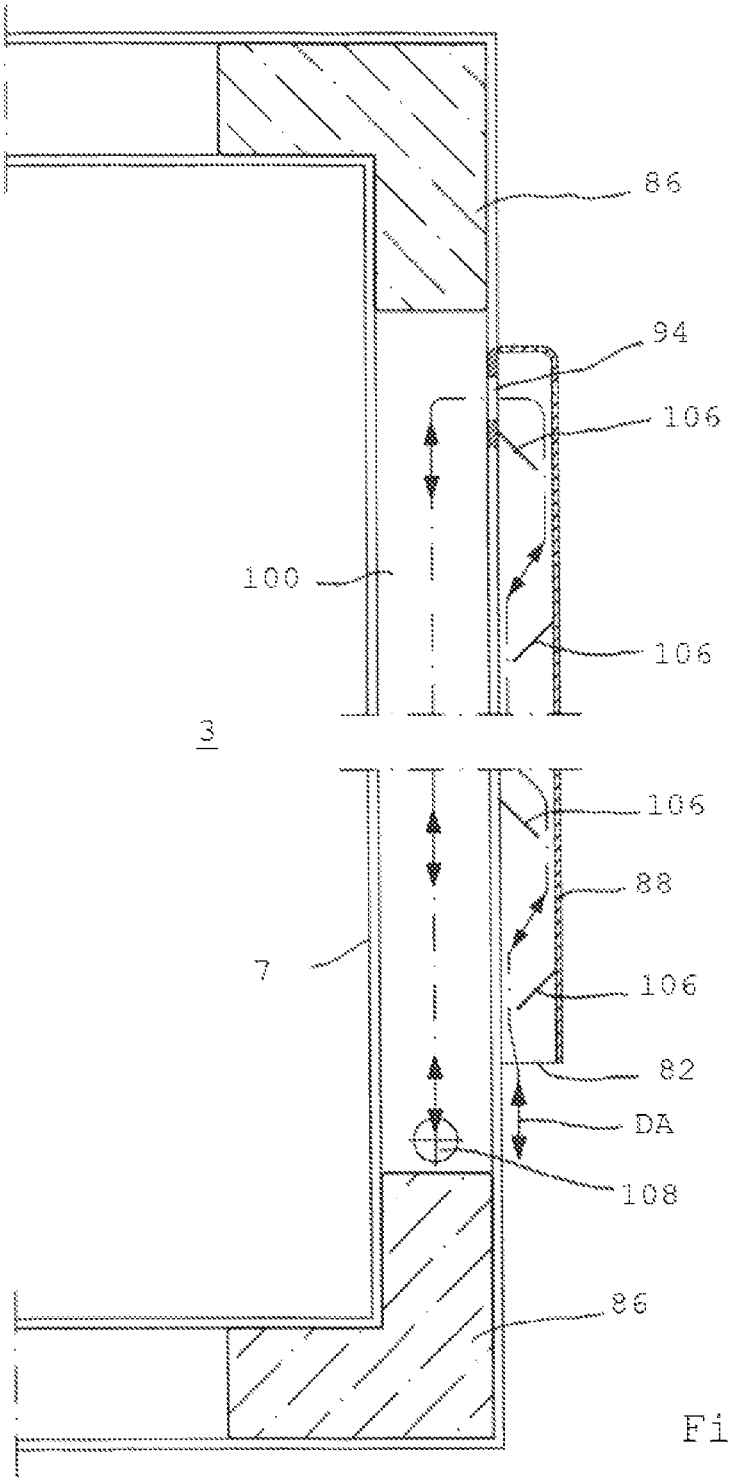
Figure 37B:
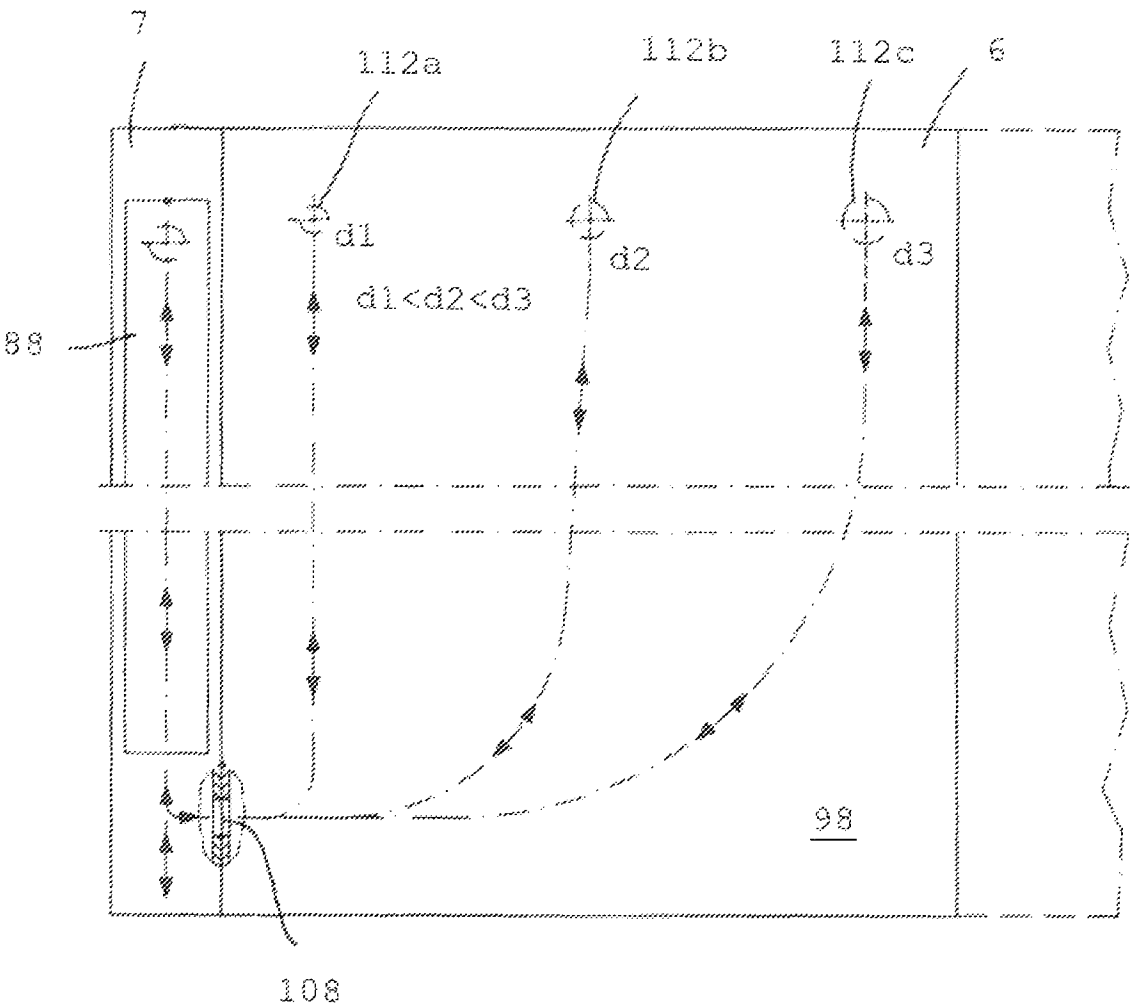
Figure 38B:
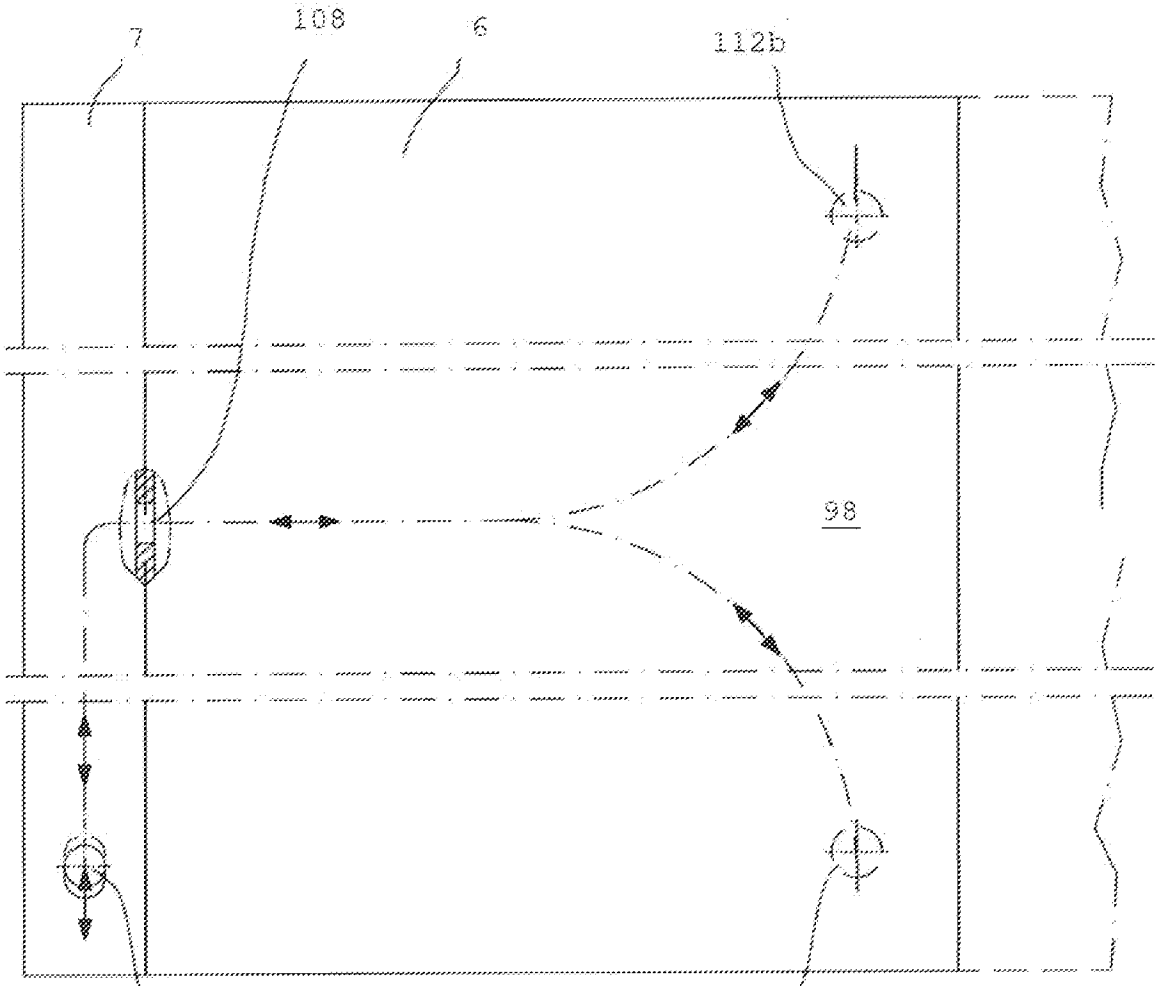
Figure 38A:
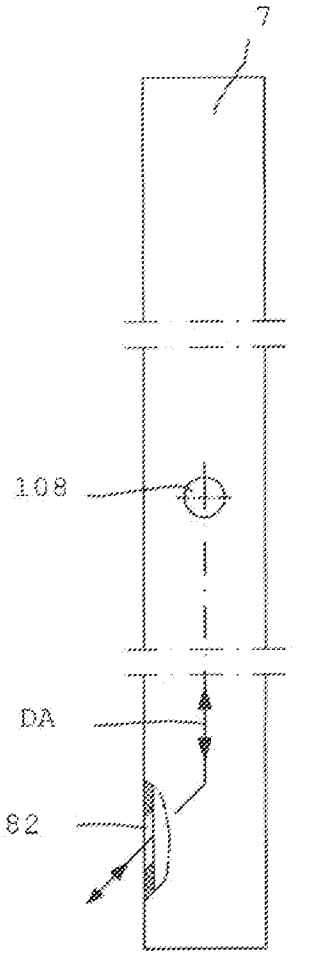
Figure 39B:
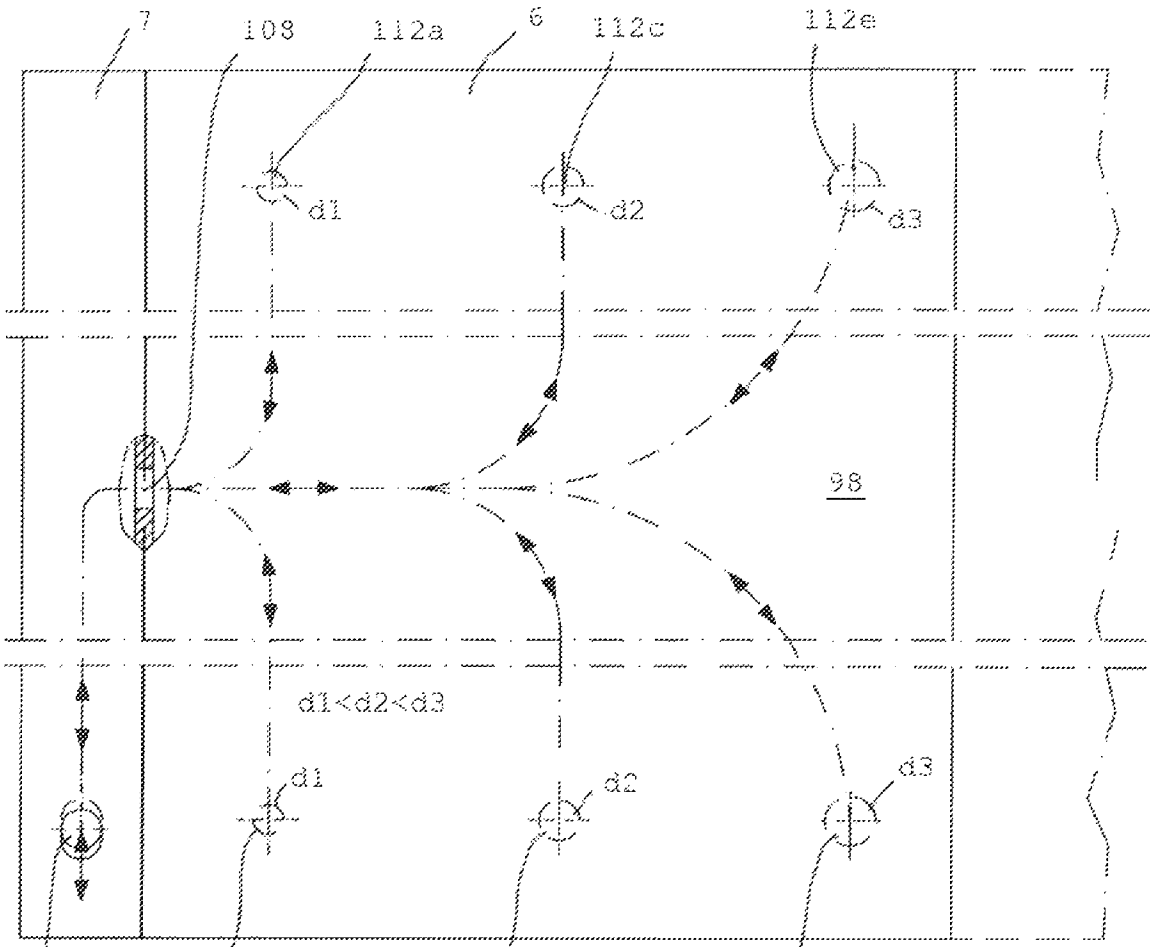
Figure 39A:
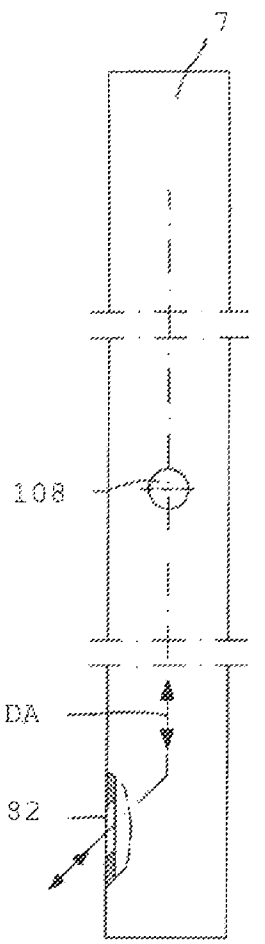
Figure 40B:
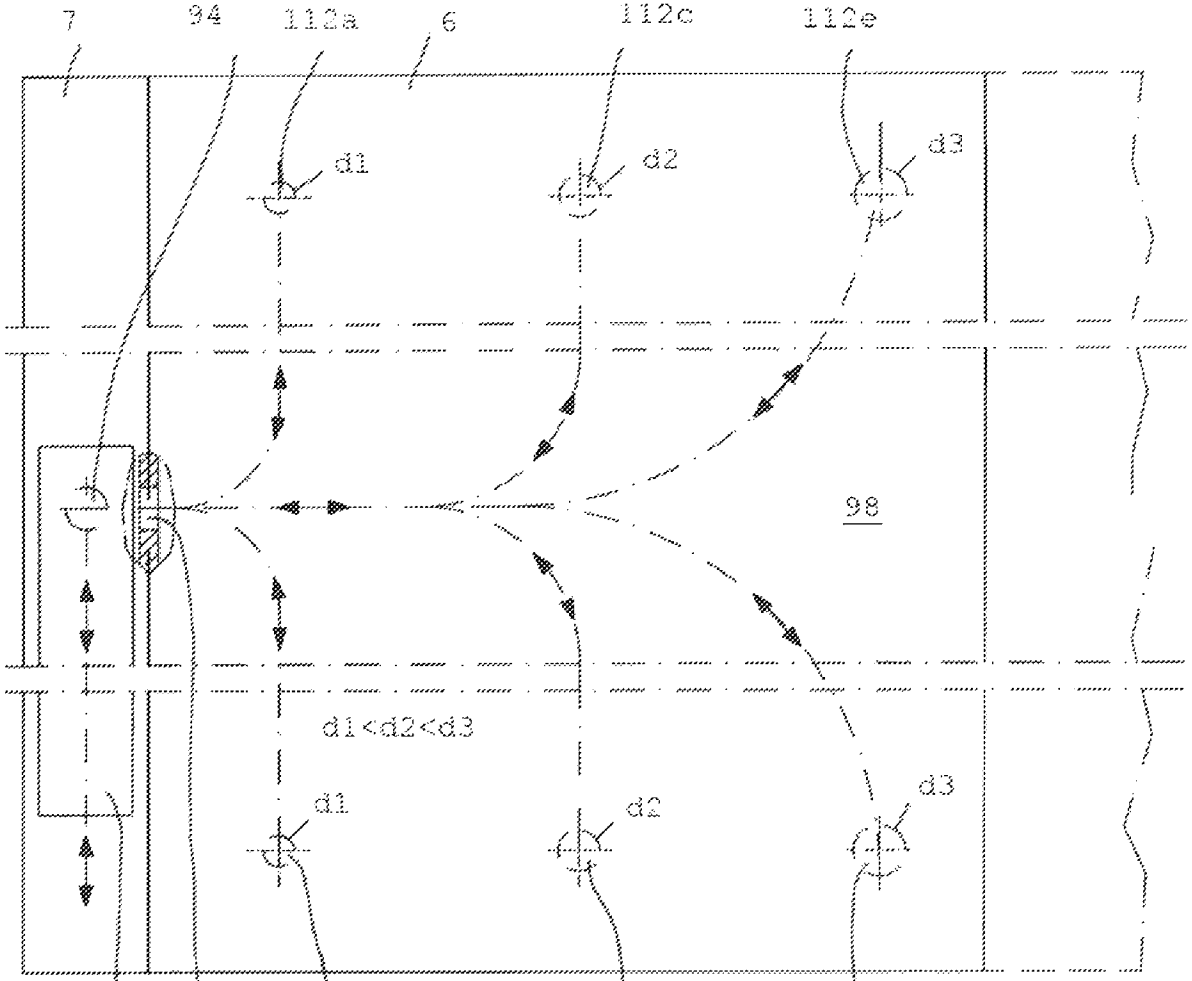
Figure 40A:
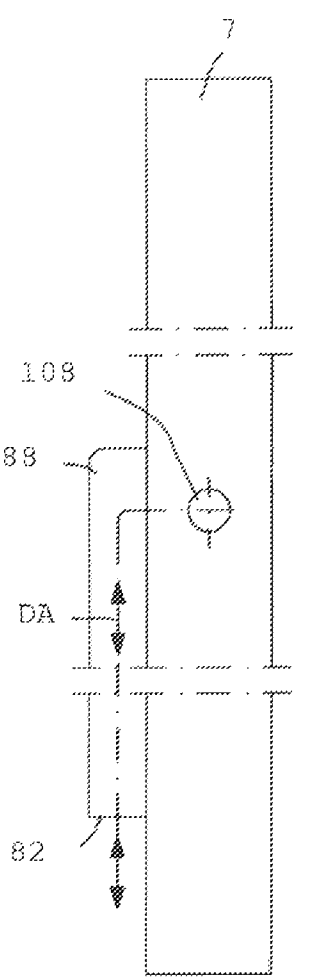
Figures 41A, 41B:
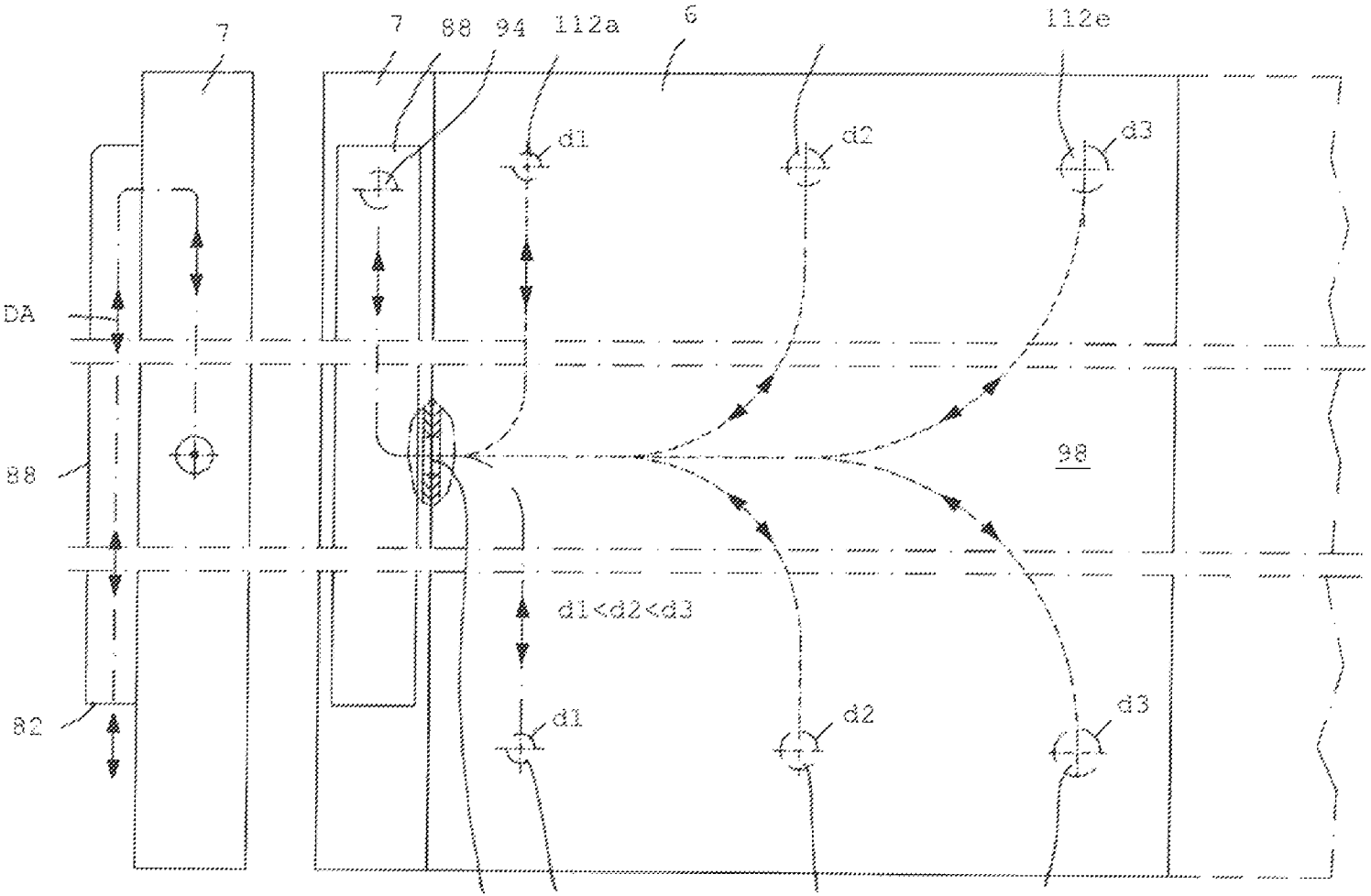
Figure 42B:
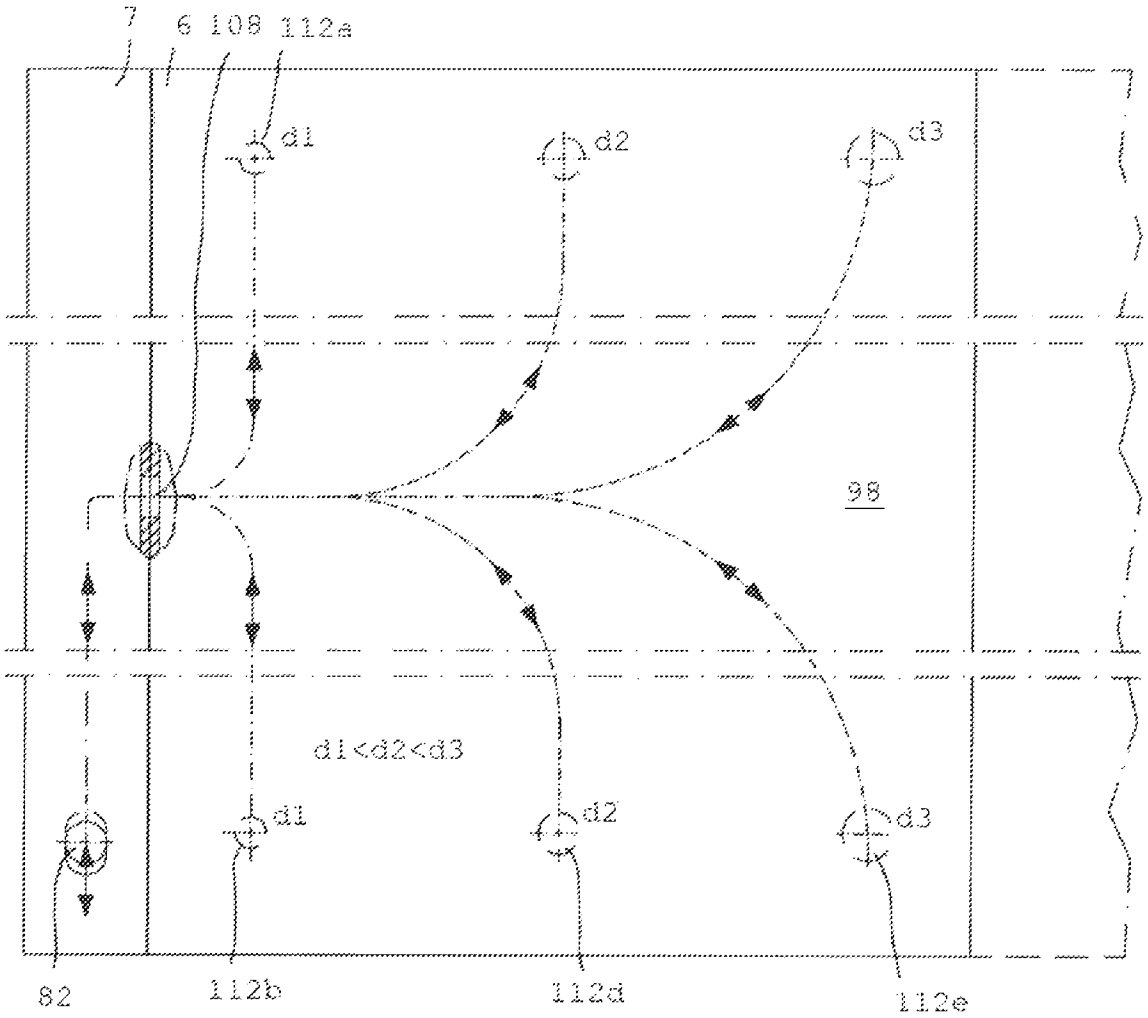
Figure 42A:
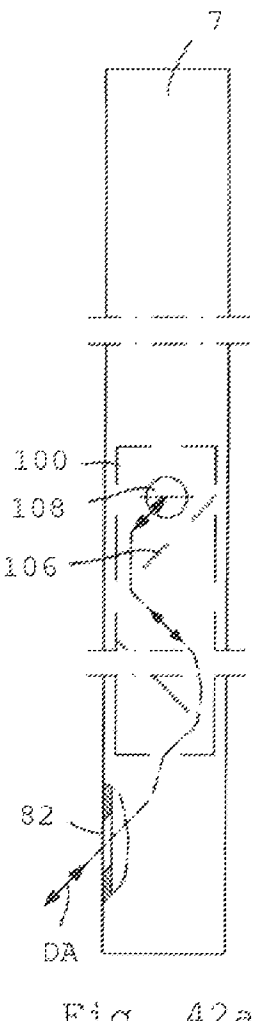
Figures 43A, 43B:
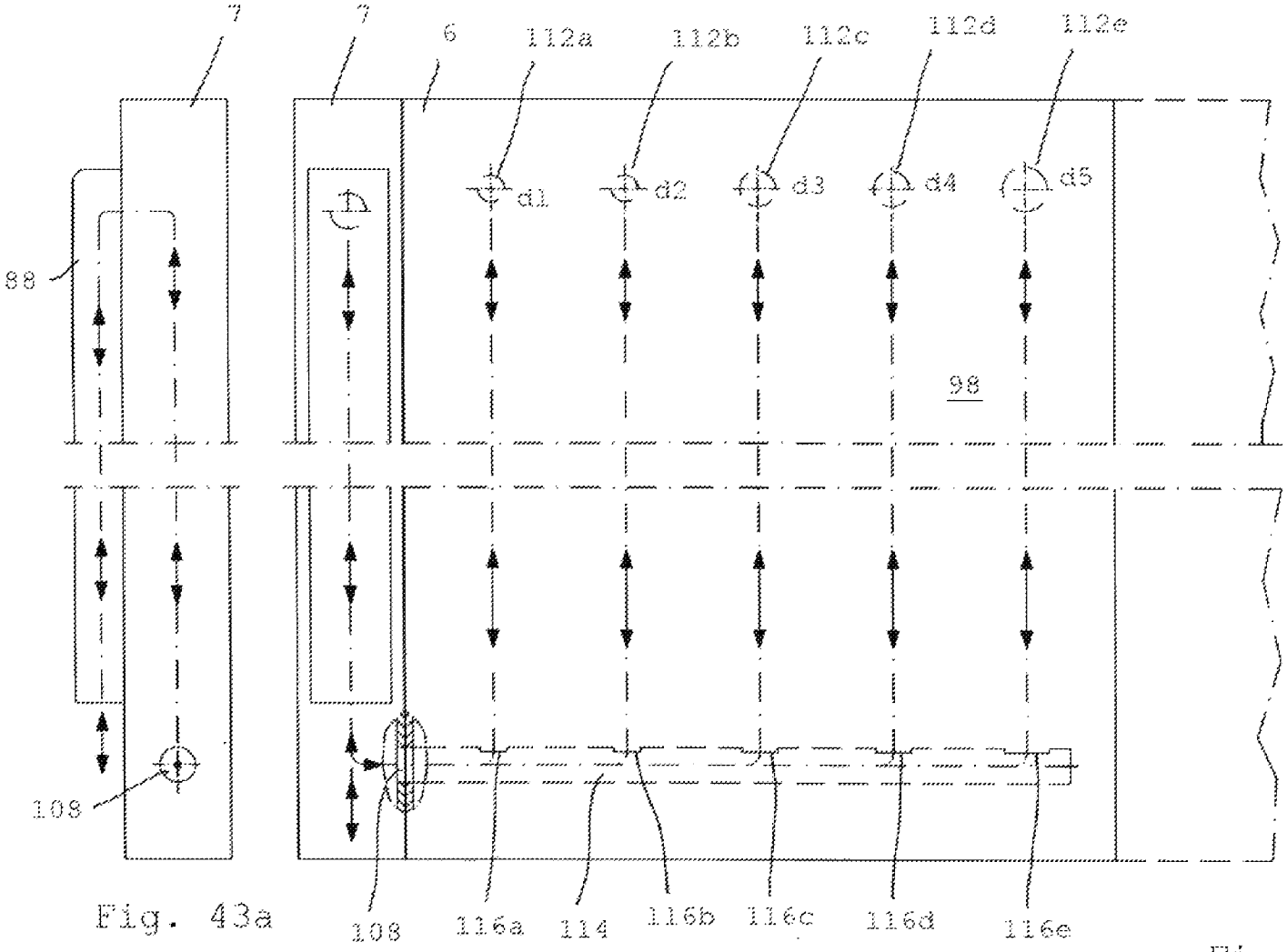
Figure 44A:
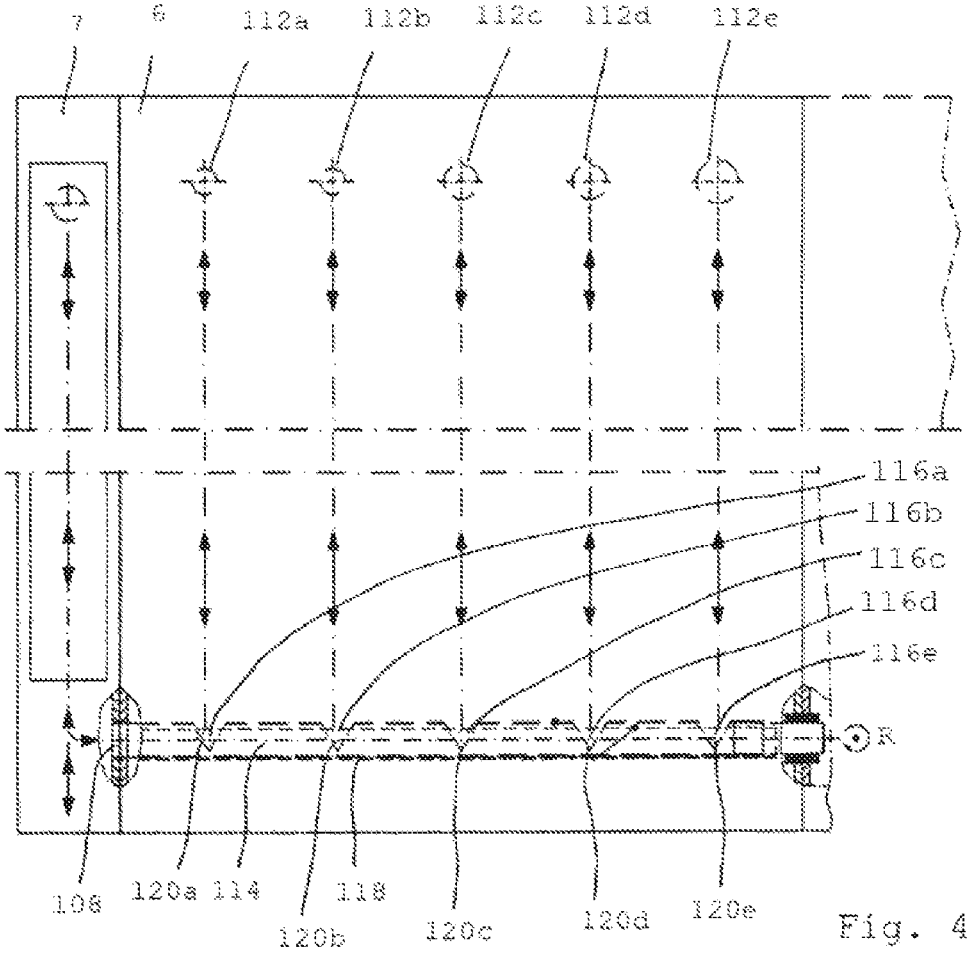
Figure 44B:
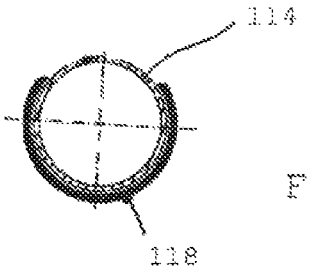

Possible arrangements of pressure equalization and drying devices in a façade element according to the invention;

FIG. 29 A vertical section through the sub-frame profile of a façade element in a sectional plane parallel to the glass plane of the façade element according to a 19th embodiment of the invention;

FIG. 30 A vertical section through the sub-frame profile of a façade element in a sectional plane parallel to the glass plane of the façade element according to a 20th embodiment of the invention;

FIG. 31 A vertical section through the sub-frame profile of a façade element in a sectional plane parallel to the glass plane of the façade element according to a 21st embodiment of the invention;

FIG. 32 A vertical section through the sub-frame profile of a façade element in a sectional plane parallel to the glass plane of the façade element according to a 22nd embodiment of the invention;

FIG. 33*a* A vertical section through the sub-frame profile in a sectional plane parallel to the glass plane of the façade element according to a 23rd embodiment of the invention;

FIG. 33*b* A vertical sectional view in a sectional plane perpendicular to the glass plane of the 23rd embodiment of the invention;

FIG. 34*a* A vertical section through the sub-frame profile in a sectional plane parallel to the glass plane of the façade element according to a 24th embodiment of the invention;

FIG. 34*b* A vertical sectional view in a sectional plane perpendicular to the glass plane of the 24th embodiment of the invention;

FIG. 35*a* A vertical section through the sub-frame profile in a sectional plane parallel to the glass plane of the façade element according to a 25th embodiment of the invention;

FIG. 35*b* A vertical sectional view in a sectional plane perpendicular to the glass plane of the 25th embodiment of the invention;

FIG. 35*c* A variant of the embodiment according to FIG. 35*b* in a first operating position;

FIG. 35*d* A variant of the embodiment according to FIG. 35*b* in a second operating position;

FIG. 36*a* A vertical section through the sub-frame profile in a sectional plane parallel to the glass plane of the façade element according to a 26th embodiment of the invention;

FIG. 36*b* A vertical sectional view in a sectional plane perpendicular to the glass plane of the 26th embodiment of the invention;

FIG. 37*a* A vertical section through the sub-frame profile in a sectional plane parallel to the glass plane of the façade element according to a 27th embodiment of the invention;

FIG. 37*b* A vertical sectional view in a sectional plane perpendicular to the glass plane of the 27th embodiment of the invention;

FIG. 38*a* A vertical section through the sub-frame profile in a sectional plane parallel to the glass plane of the façade element according to a 28th embodiment of the invention;

FIG. 38*b* A vertical sectional view in a sectional plane perpendicular to the glass plane of the 28th embodiment of the invention;

FIG. 39*a* A vertical section through the sub-frame profile in a sectional plane parallel to the glass plane of the façade element according to a 29th embodiment of the invention;

FIG. 39*b* A vertical sectional view in a sectional plane perpendicular to the glass plane of the 29th embodiment of the invention;

FIG. 40*a* A vertical section through the sub-frame profile in a sectional plane parallel to the glass plane of the façade element according to a 30th embodiment of the invention;

FIG. 40*b* A vertical sectional view in a sectional plane perpendicular to the glass plane of the 30th embodiment of the invention;

FIG. 41*a* A vertical section through the sub-frame profile in a sectional plane parallel to the glass plane of the façade element according to a 31st embodiment of the invention;

FIG. 41*b* A vertical sectional view in a sectional plane perpendicular to the glass plane of the 31st embodiment of the invention;

FIG. 42*a* A vertical section through the sub-frame profile in a sectional plane parallel to the glass plane of the façade element according to a 32nd embodiment of the invention;

FIG. 42*b* A vertical sectional view in a sectional plane perpendicular to the glass plane of the 32nd embodiment of the invention;

FIG. 43*a* A vertical section through the sub-frame profile in a sectional plane parallel to the glass plane of the façade element according to a 33rd embodiment of the invention;

FIG. 43*b* A vertical sectional view in a sectional plane perpendicular to the glass plane of the 33rd embodiment of the invention;

FIG. 44*a* A vertical sectional view in a sectional plane perpendicular to the glass plane of the 34th embodiment of the invention and FIG. 44*b* A detailed view in a further section of the embodiment according to FIG. 44*a*.

WAYS OF CARRYING OUT THE INVENTION

In the following figures, the same components are designated with the same reference numbers. In the following embodiments, only specific differences and deviations from previous embodiments are explained, while the basic structure of the façade element is described in the embodiments according to FIGS. 1 and 2.

In all figures, the arrows labeled "DA" indicate the direction of air movement during pressure equalization, and the arrows labeled "TR" indicate the direction of air exchange of dried air from the drying device into the façade intermediate space during drying. If these directions coincide, the designation "DA+TR" is also used. The arrows "AT" indicate the direction in which the desiccant can be replaced or, if a separate desiccant container is used, this can be replaced.

Figure 1:
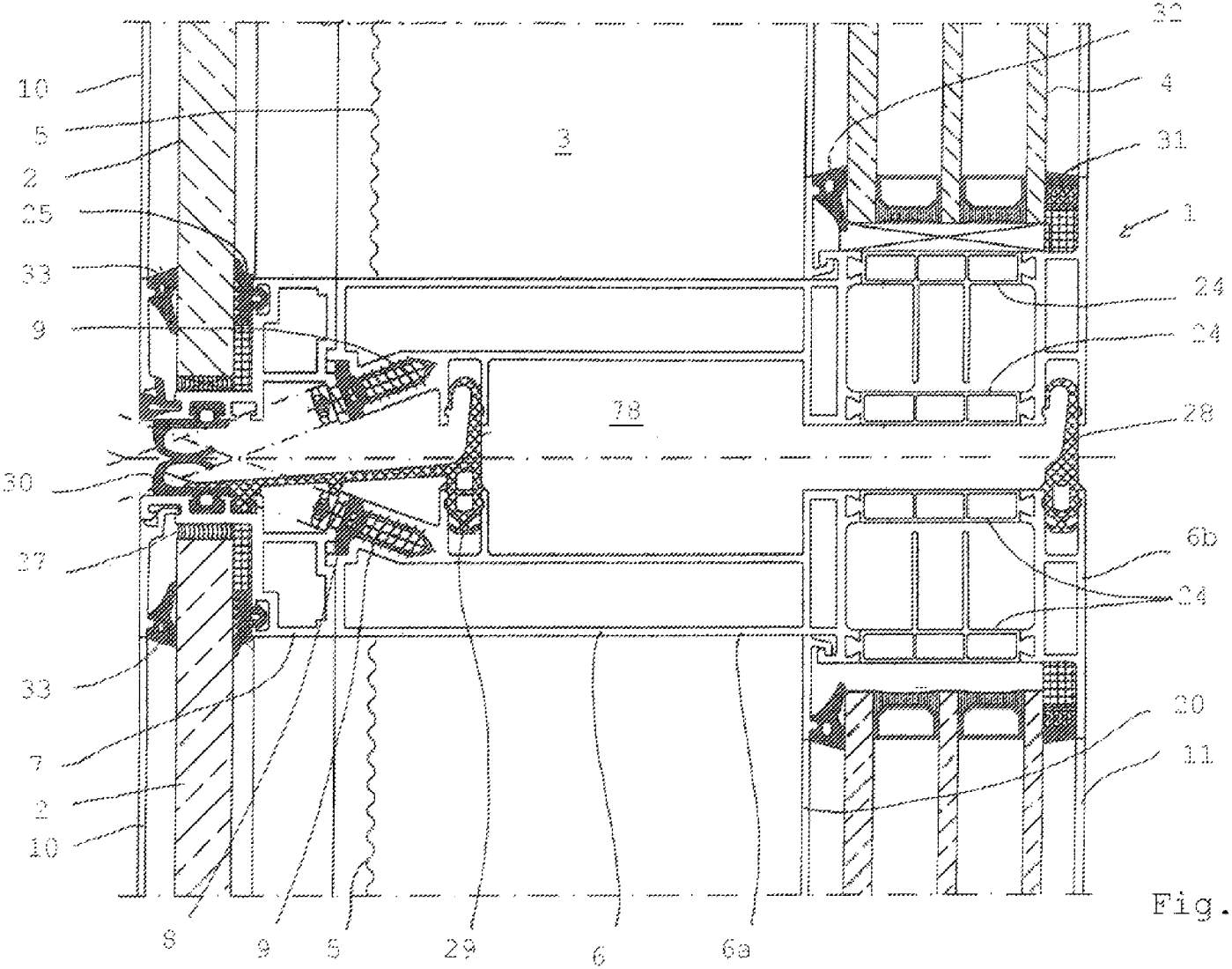
FIG. 1 A vertical section through the basic structure of a façade element according to a first variant.

FIG. 1 shows a vertical section through a façade element 1 without a pressure equalization device and drying device. On the outside of the façade an outer glass element 2 is arranged, which in the present exemplary embodiment is sealed to a glazing bead 10 on the outside via outer sealing strips 33. The outer glass element 2 is held on the inside and in particular towards the façade interior 3 by means of the internal gasket 25. The internal gasket 25 is inserted into a sub-frame profile 7. A seal 27 is located between the sub-frame profile 7 and the end faces of the outer glass element 2. An outer expansion joint seal 30 is also inserted into the sub-frame profile 7. This, together with the inner expansion joint seal 28 arranged on the inside of the façade and the central expansion joint seal 29, seals the expansion joint 78 between the vertically adjacent glass elements.

The sub-frame profile 7 is screwed to the main frame profile 6 of the surrounding frame profile 11 using connecting screws 9. A gasket 8 is provided between the main frame profile 6 and the sub-frame profile 7, which is preferably made of thermoplastic butyl or another suitable material that is highly vapor-tight. In the embodiment shown, the main frame profile 6 is formed as a composite profile with main frame profile sections 6*a* and 6*b*, which are thermally decoupled via insulation webs 24 made of plastic with high vapor tightness. Solar shading 5, shown schematically in this exemplary embodiment, is arranged in the façade intermediate space 3.

On the inside of the façade, an inner glass element 4 is provided in the form of multi-insulating glass, which is held towards the stop via an internal gasket or inner seal 31 and towards the façade intermediate space 3 by a gasket 32 which is held in the façade intermediate space by a glazing bead 20. Providing an inner seal increases vapor tightness compared to a gasket. Reduced vapor tightness is disadvantageous as it leads to faster exhaustion of the desiccant container and thus shortens the desiccant replacement intervals.

Figure 3:
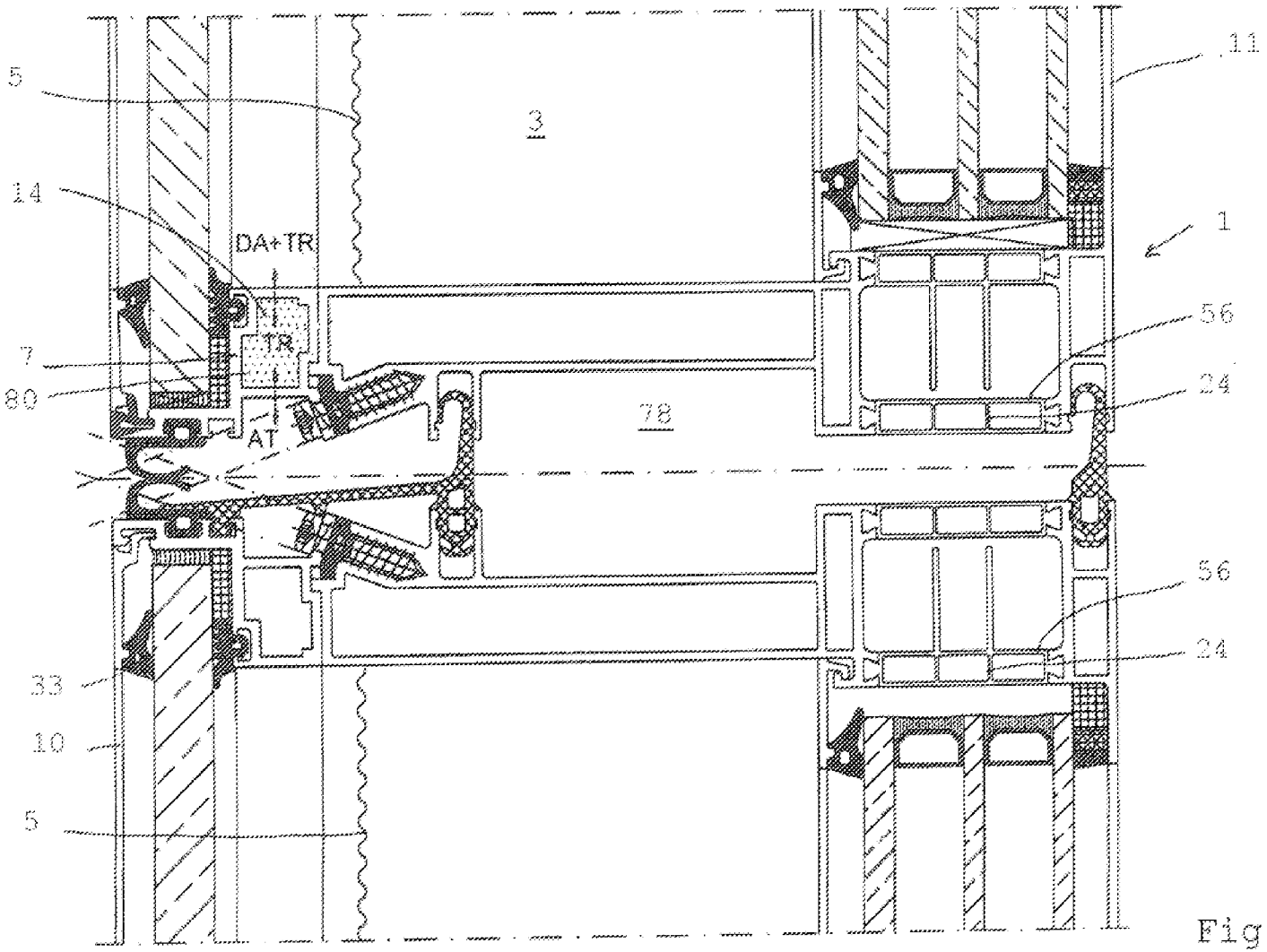
FIG. 3 A vertical section through a façade element according to a first embodiment of the invention.

FIG. 1 thus shows a first variant of the basic structure of the façade element, which, as shown in the embodiments starting from FIG. 3, is provided with a pressure equalization device and a drying device.

Figure 2:
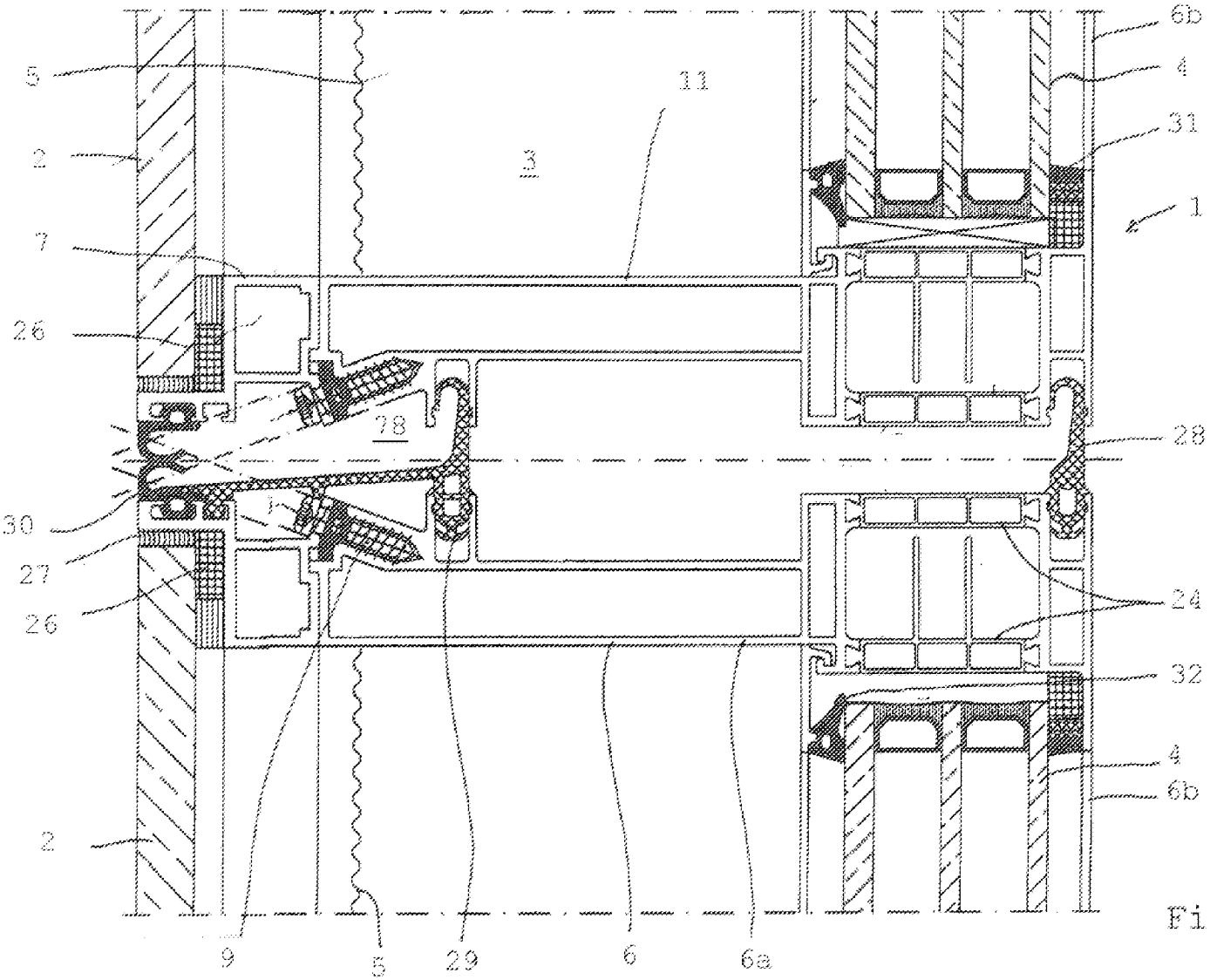
FIG. 2 A vertical section through the basic structure of a façade element according to a second variant.

FIG. 2 shows a variant of the embodiment according to FIG. 1, in which the façade element has no glazing bead 10 arranged on the outside of the façade and, accordingly, no outer sealing strips 33 which, with the omission of the outer glazing bead 10, are likewise omitted. The outer glass pane 2 is fixed to the sub-frame profile 7 by means of the seal 26. Otherwise, the structure according to FIG. 2 corresponds to that according to FIG. 1, so that reference can be made to the explanation relating to FIG. 1.

Building on the basic design of the façade element 1 already illustrated in FIG. 1, FIG. 3 shows a first alternative design of a pressure equalization device and drying device. In the embodiment shown in FIG. 3, both the pressure equalization device and the drying device are arranged in the sub-frame profile 7. For this purpose, desiccant 14 is located in a hollow chamber 80 of the sub-frame profile 7. The desiccant 14 can be replaced vertically in the direction of the arrow AT between the expansion joint 78 and the hollow chamber 80 filled with desiccant 14 in the sub-frame profile 7. Towards the façade intermediate space 3, both pressure equalization and, together with pressure equalization, the transport of moisture-laden air from the façade intermediate space 3 into the hollow chamber 80 filled with desiccant 14 where water vapor is adsorbed on suitable adsorbents such as zeolites can take place, and in this way a stable, low level of humidity is maintained in the internal atmosphere of the façade intermediate space 3.

Also indicated in FIG. 3 with reference number 56 are measures for providing a vapor barrier in the area of the insulation webs 24, for example by selecting suitable materials for the insulation webs.

Figure 4:
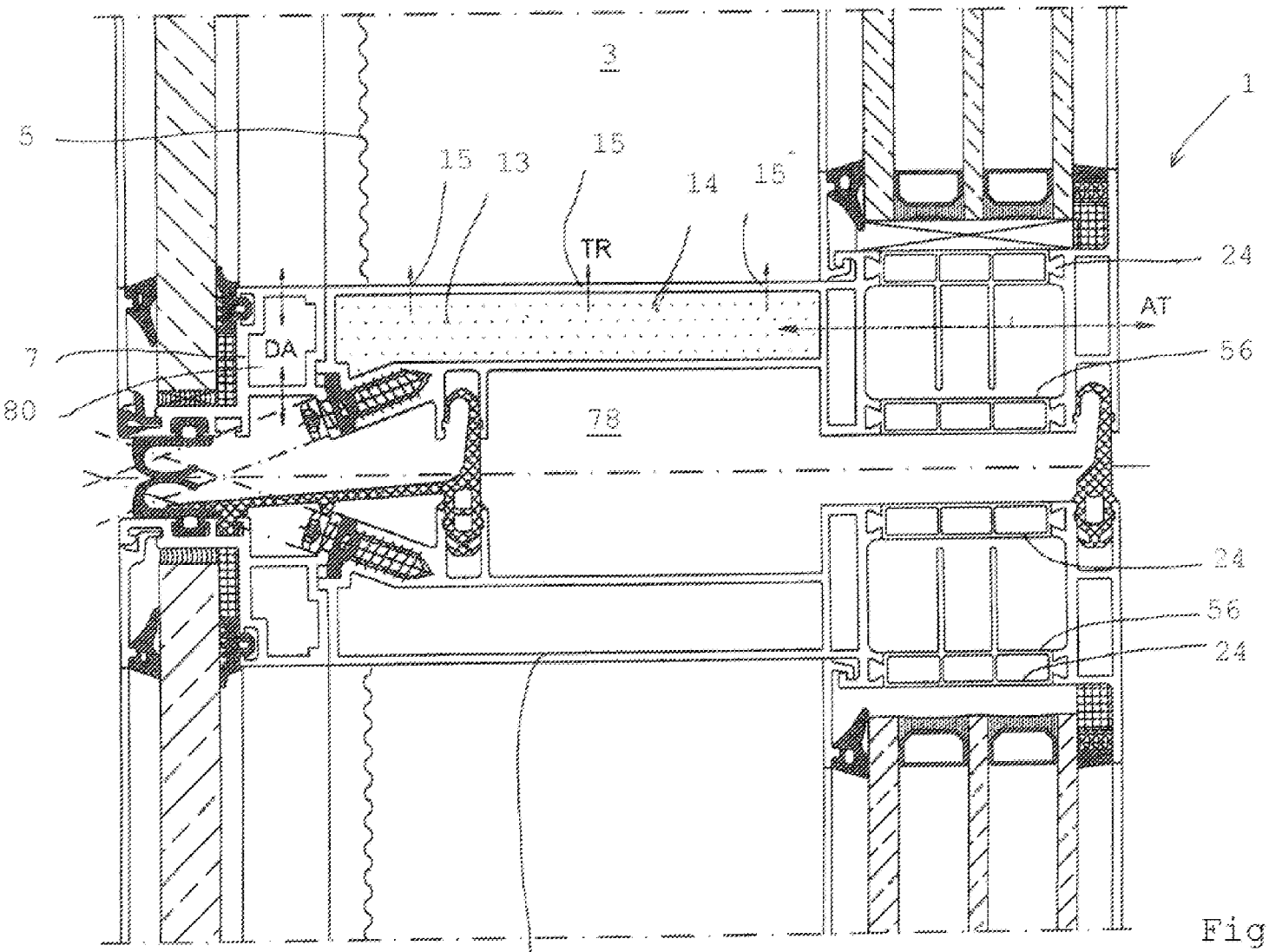
FIG. 4 A vertical section through a façade element according to a second embodiment of the invention.

The embodiment according to FIG. 4 differs from that according to FIG. 3 in that the hollow chamber 80 provided in the sub-frame profile 7 combined with a long or short capillary tube that connects to the outside atmosphere and to the façade intermediate space serves to equalize the pressure, as shown by the arrows DA. The main frame profile 6 has a hollow chamber 13 which is filled with desiccant 14. In addition, openings 15 are provided between the hollow chamber 13 in the main frame profile 6 and the façade intermediate space 3 which enable an exchange of air so that moisture-laden air can enter the hollow chamber 13, whereupon the desiccant 14 contained therein adsorbs the moisture. Moisture-laden desiccant is replaced in the direction of the arrow AT towards the inside of the façade. In contrast to the embodiment shown in FIG. 3, in which the pressure equalization device and the drying device in the sub-frame profile 7 interact directly with each other, in the embodiment shown in FIG. 4 there is no direct interaction between the pressure equalization device and the drying device, since the pressure equalization device is arranged in the sub-frame profile 7, while the drying device is located in the main frame profile 6.

Figure 26:
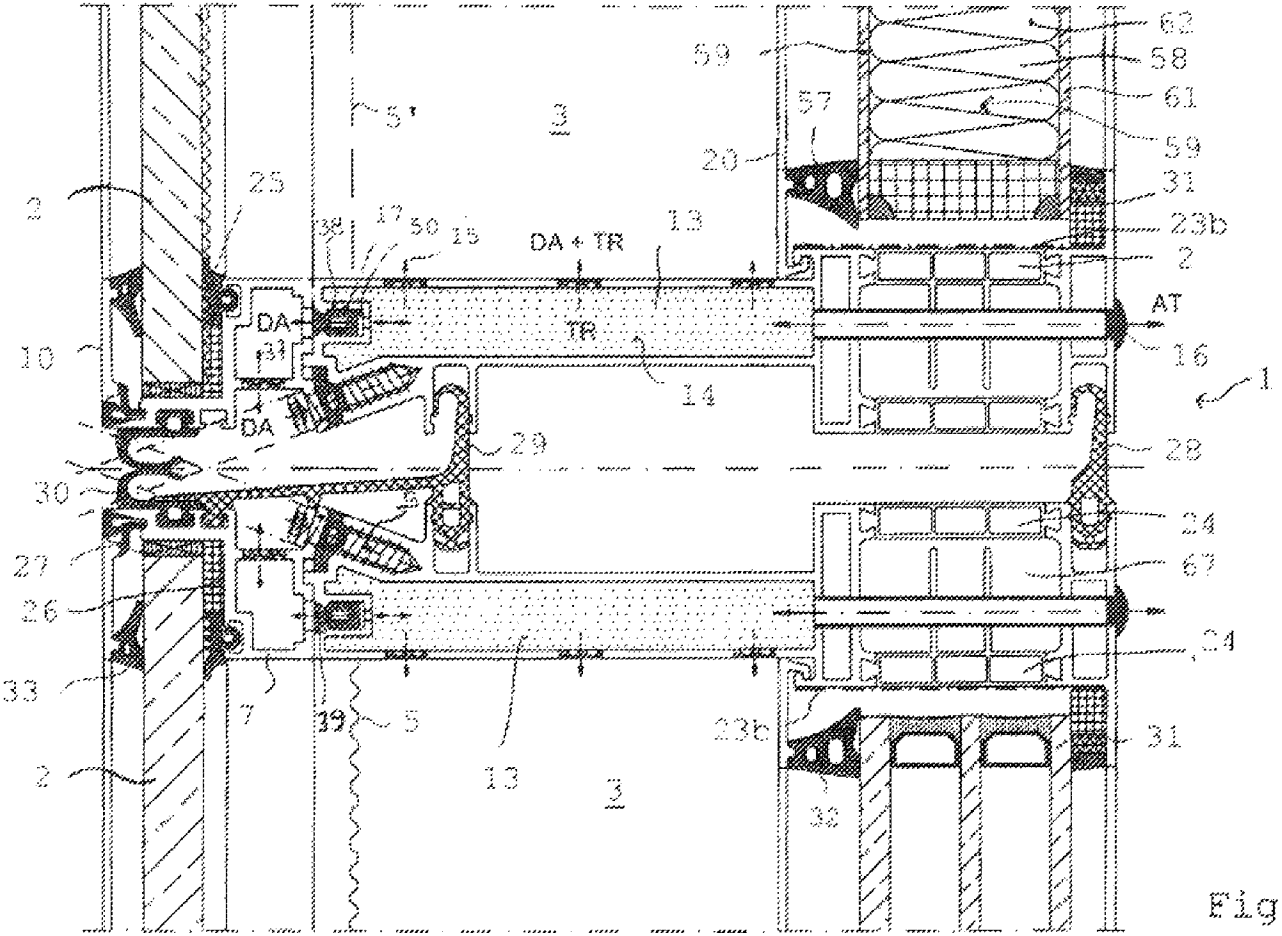
FIG. 26 A vertical section through a façade element according to an 18th embodiment of the invention.
Figure 27:
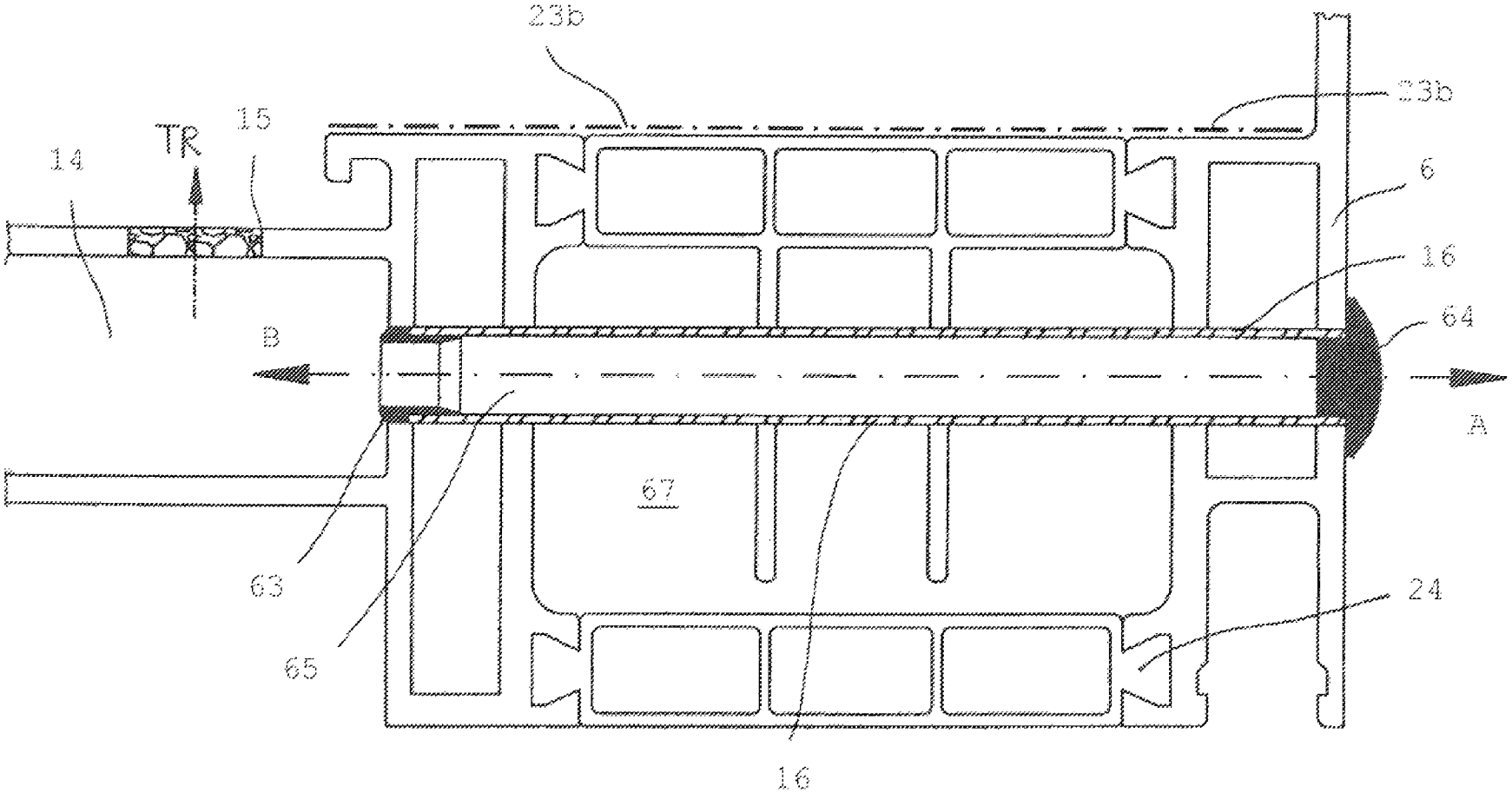
FIG. 27 A detail view relating to FIG. 26.

The direction "AT" shown in FIG. 4 for the replacement of vapor-laden desiccant with freshly regenerated desiccant is given only as a general indication. FIG. 26 and FIG. 27 illustrate a possible technical implementation of the replacement process.

Figure 5:
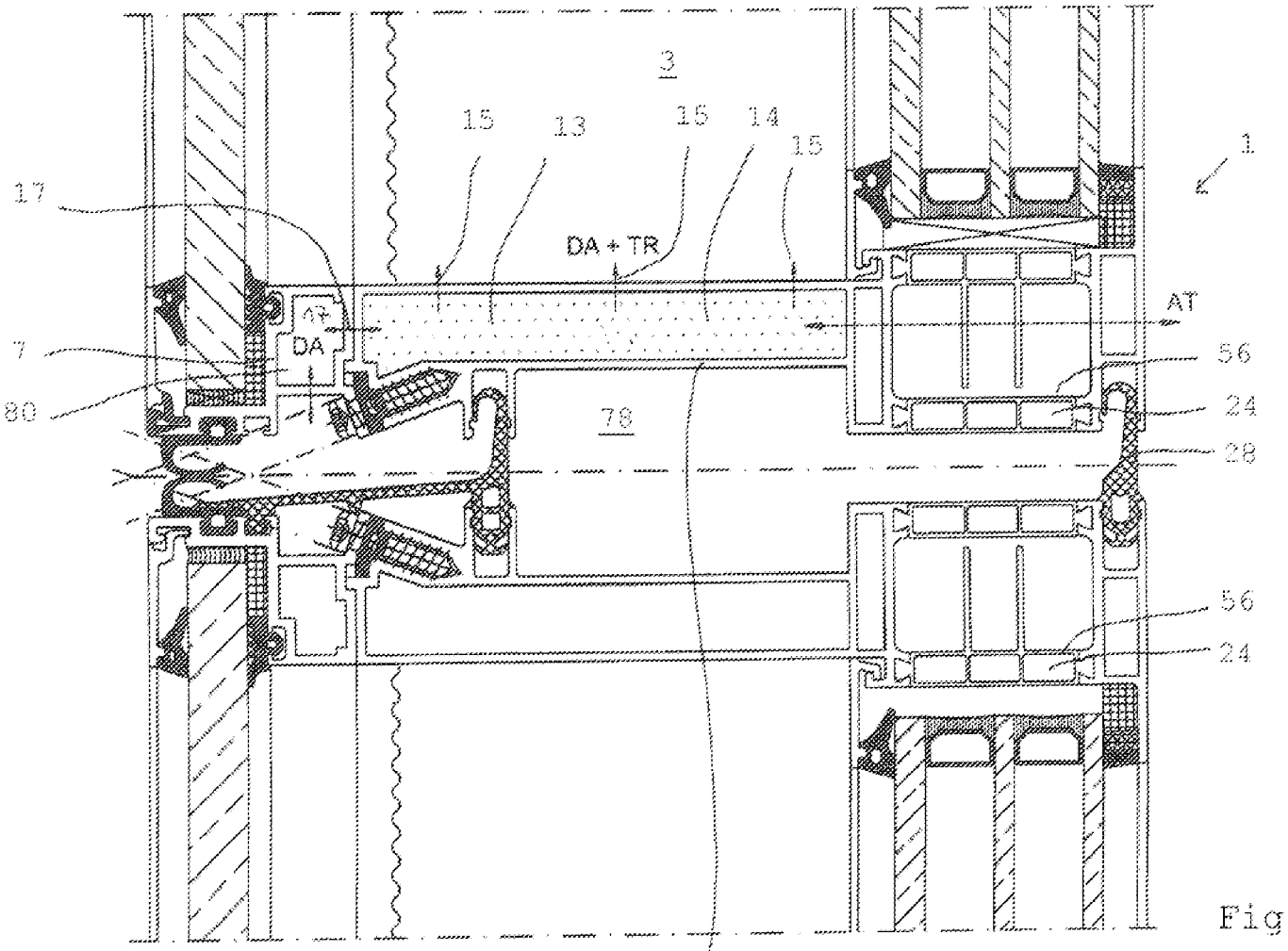
FIG. 5 A vertical section through a façade element according to a third embodiment of the invention.

The embodiment according to FIG. 5 is similar to that according to FIG. 4, but differs in that the hollow chamber 80 in the sub-frame profile 7, which exchanges air with the expansion joint 78 for the purpose of pressure equalization (arrow direction DA), is in air-conducting connection with the hollow chamber 13 in the main frame profile 6 via a pressure equalization sub-system 17. Pressure equalization relative to the façade intermediate space 3 thus takes place from the expansion joint 78 into the hollow chamber 80 of the sub-frame profile 7 and, through the pressure equalization sub-system 17, into the hollow chamber 13 filled with desiccant 14 and through the openings 15, whereas in the embodiment shown in FIG. 4, the hollow chamber 80 in the sub-frame profile 7 has a pressure-equalization-enabling, air-conducting connection both to the expansion joint 78 and to the façade intermediate space 3.

Thus, in the embodiment according to FIG. 5, the pressure equalization device and the drying device interact directly with each other, because the pressure equalization device is arranged in the sub-frame profile 7 and between the sub-frame profile 7 and the main frame profile 6, and the drying device is arranged in the main frame profile 6.

Figure 6:
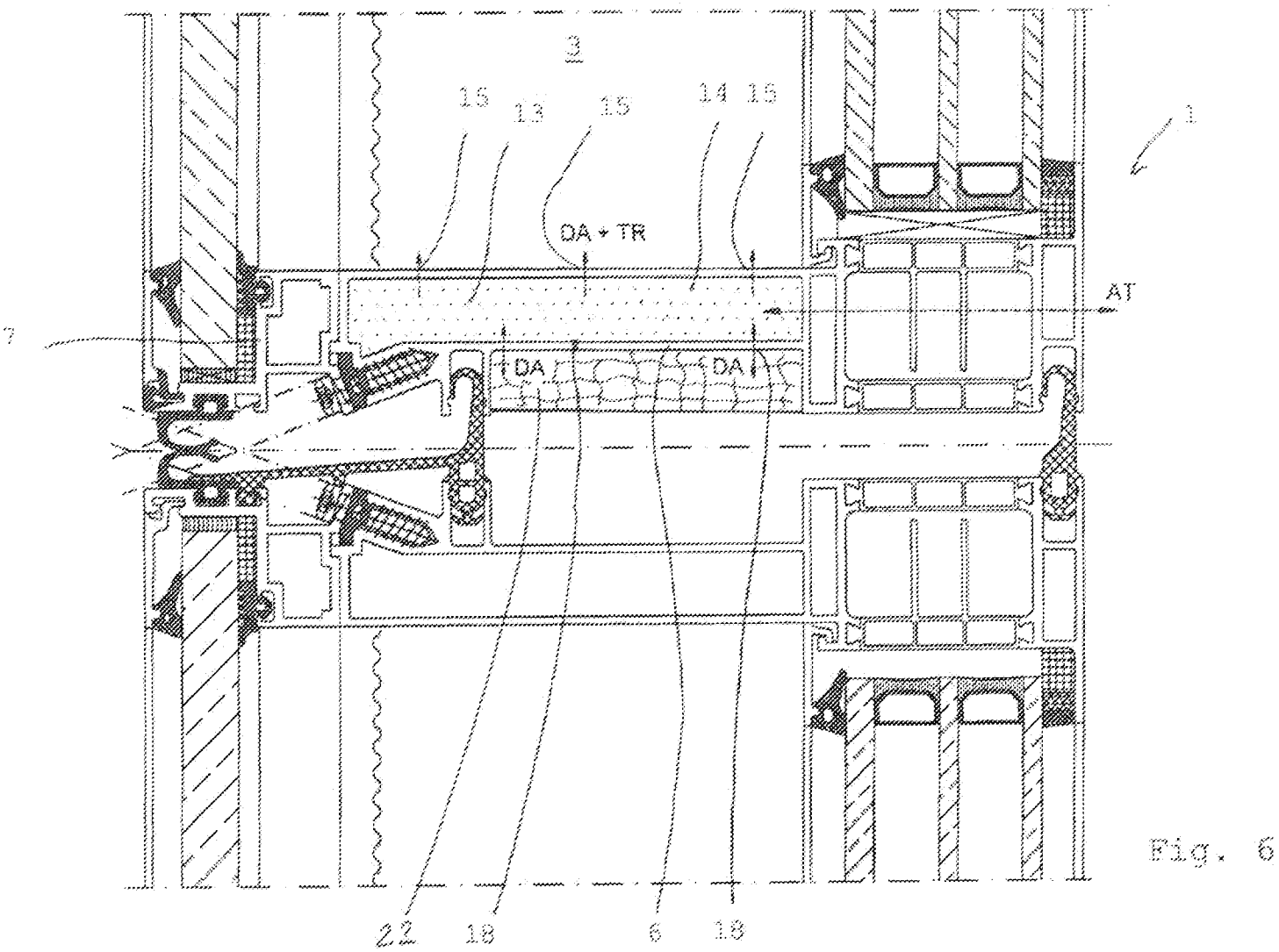
FIG. 6 A vertical section through a façade element according to a fourth embodiment of the invention.

Another variant is shown in FIG. 6. Here, both the pressure equalization device and the drying device are integrated into the hollow chamber 13 in the main frame profile 6. This solution is therefore similar to that shown in FIG. 3 in terms of the direct interaction of the pressure equalization device with the drying device. In contrast to the embodiment according to FIG. 3, however, the combined system is located in a cavity 13 in the main frame profile 6, whereas in the embodiment according to FIG. 3 the desiccant 14 is located in a cavity 80 in the sub-frame profile 7. For this purpose, pressure equalization openings 18 are provided between the hollow chamber 13 in the main frame profile 6 and the expansion joint 78, as well as openings 15 between the hollow chamber 13 and the façade intermediate space 3, thus enabling pressure equalization between the façade intermediate space 3 and the expansion joint area. Air flows between the expansion joint and the drying device through a foam block 22 with an open-cell core.

In the embodiments shown in FIGS. 3 to 6, the desiccant-filled hollow chamber 13 is arranged so that it is not located in the transparent field of view of the façade element 1 and therefore cannot be perceived as obtrusive.

Figure 7:
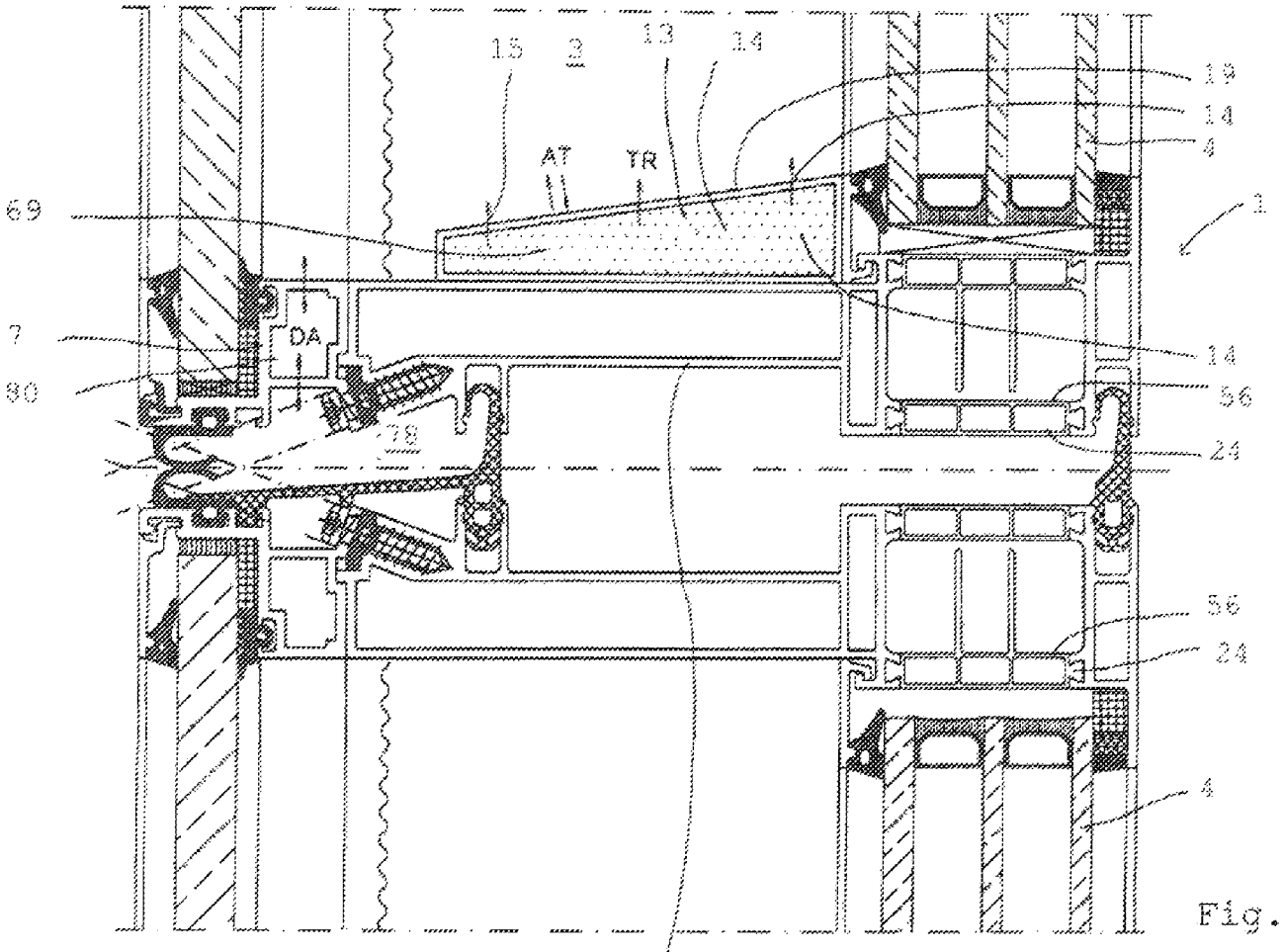
FIG. 7 A vertical section through a façade element according to a fifth embodiment of the invention.

In the embodiment according to FIG. 7, too, the drying device is located in the area of the main frame profile 6. In contrast to the previous embodiments, however, the drying device comprises a separate desiccant container 19 which can be attached to the main frame profile 6 in the façade intermediate space 3. The desiccant container 19 is replaced by completely removing it in the direction of arrow AT and reattaching it to the main frame profile 6 with regenerated desiccant. The desiccant container 19 has openings 15 that connect the inner cavity 69 of the desiccant container 19, which is filled with desiccant 14, with the façade intermediate space 3, so that air can be exchanged and water vapor in the façade intermediate space 3 can be absorbed by the desiccant 14 in the desiccant container 19. In the embodiment according to FIG. 7, the pressure equalization device is configured in the same way as in the embodiment according to FIG. 4. Pressure equalization is achieved by a cavity 80 of the sub-frame profile 7 that is in air connection with both the expansion joint 78 and the façade intermediate space 3. The pressure equalization device in the sub-frame profile 7 and the drying device in the form of a replaceable desiccant container 19 are thus provided without directly interacting with one another. The desiccant container 19 has a shape that does not obtrude when viewed from inside the façade looking outwards or from outside the façade looking inwards.

Figure 8:
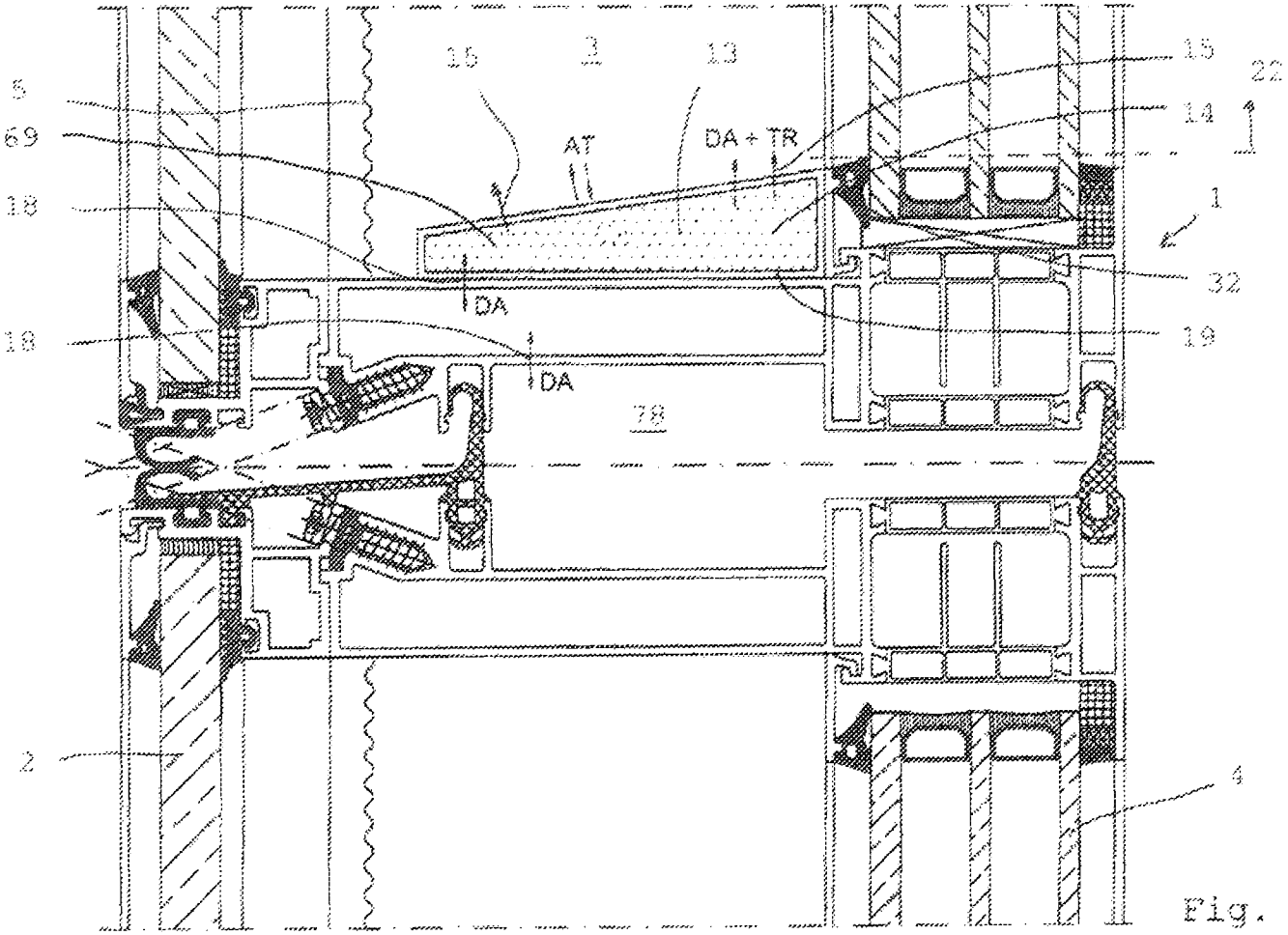
FIG. 8 A vertical section through a façade element according to a sixth embodiment of the invention.

The embodiment according to FIG. 8 combines the basic ideas of the embodiments according to FIGS. 6 and 7. As in the embodiment according to FIG. 7, a separate desiccant container 19 is provided, which, however, in contrast to the embodiment shown in FIG. 7, not only serves as a drying device, but also has a pressure equalization device integrated into it. For this purpose, in addition to the openings 15 previously described with reference to FIG. 7 which establish an air connection between the interior of the desiccant container 19 and the façade intermediate space 3, additional pressure equalization openings 18 are provided which, also in the case where a cavity 13 is interposed in the main frame profile 6 as shown in FIG. 8, establish a flow connection between the expansion joint 78 and the inner cavity 69 of the desiccant container 19 filled with desiccant 14, so that pressure equalization can take place between the expansion joint 78 and the façade intermediate space 3 via the pressure equalization openings 18, the inner cavity 69 of the desiccant container 19 and the openings 15. Both the pressure equalization device in the main frame profile 6 and in the desiccant container 19, and the drying device in the form of a replaceable container in the façade intermediate space 3 thus interact directly with each other. The pressure equalization device and the drying device are positioned and dimensioned such that they do not extend into the transparent region 12 of the façade element. The transparent region extends upwards from the internal gasket 32 of the inner glazing 4 in the drawing plane of FIG. 8, because only in this region are both the outer glazing 2 and the inner glazing 4 transparent when viewed through the façade element in a direction perpendicular to the main plane of the outer glazing 2, provided the solar shading device 5 is not in the operating position.

Figure 9:
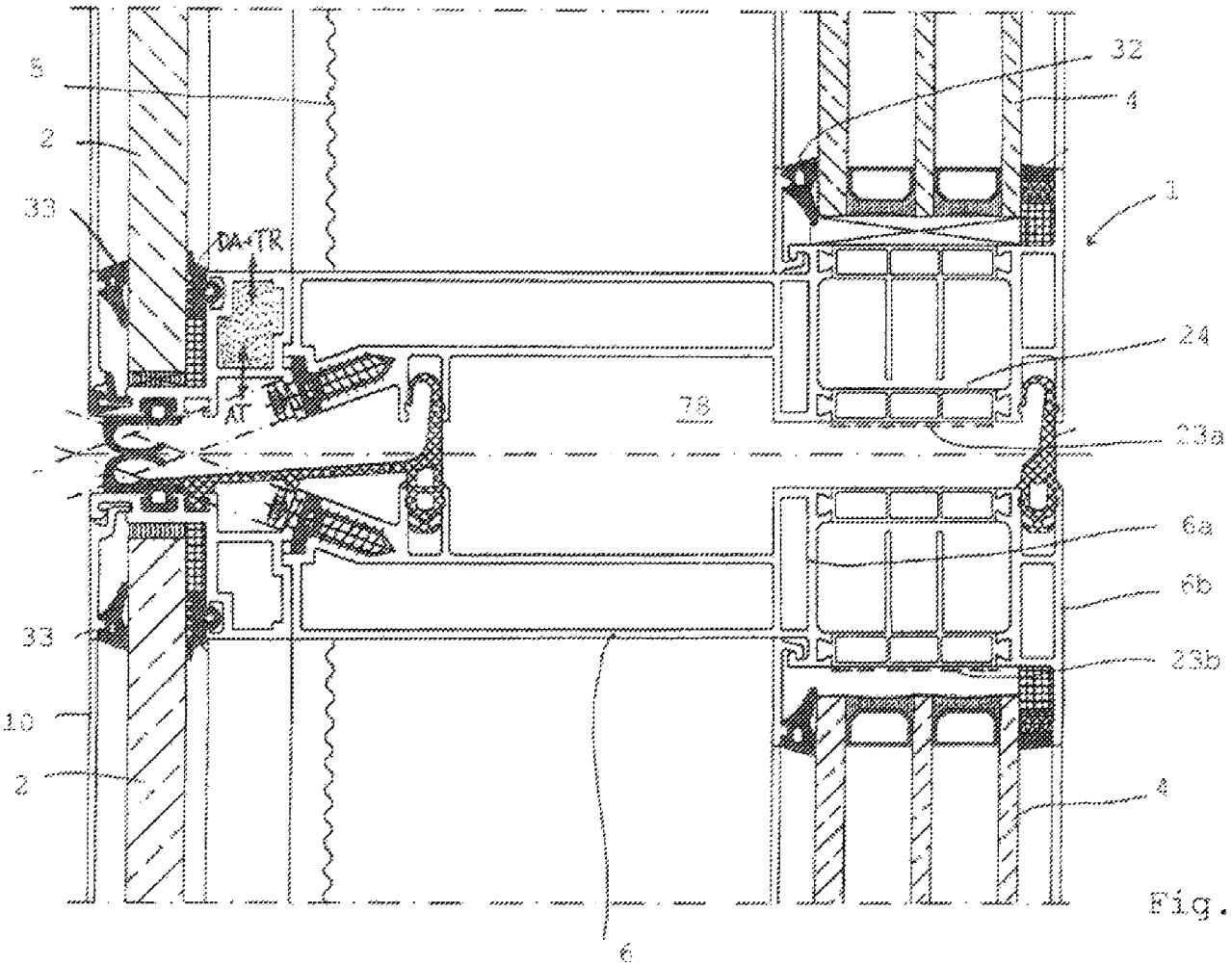
FIG. 9 A vertical section through a façade element according to a seventh embodiment of the invention.

The embodiment according to FIG. 9 substantially corresponds to that according to FIG. 3. Foils are applied to the insulation webs 24 for thermal separation of the sub-profiles 6*a* and 6*b* of the main frame profile 6. A foil with reference number 23*a* made of very thin stainless steel with a thickness of no more than 0.050 mm or of metalized plastic foil or of butyl foil is provided on the insulation web on a surface facing towards the expansion joint. Reference number 23*b* refers to a foil as described above, but on the insulation web 24 on a side facing away from the expansion joint. These measures serve to further increase the vapor tightness of the insulation webs and thus reduce the diffusion of water vapor into the façade intermediate space 3.

Figure 10:
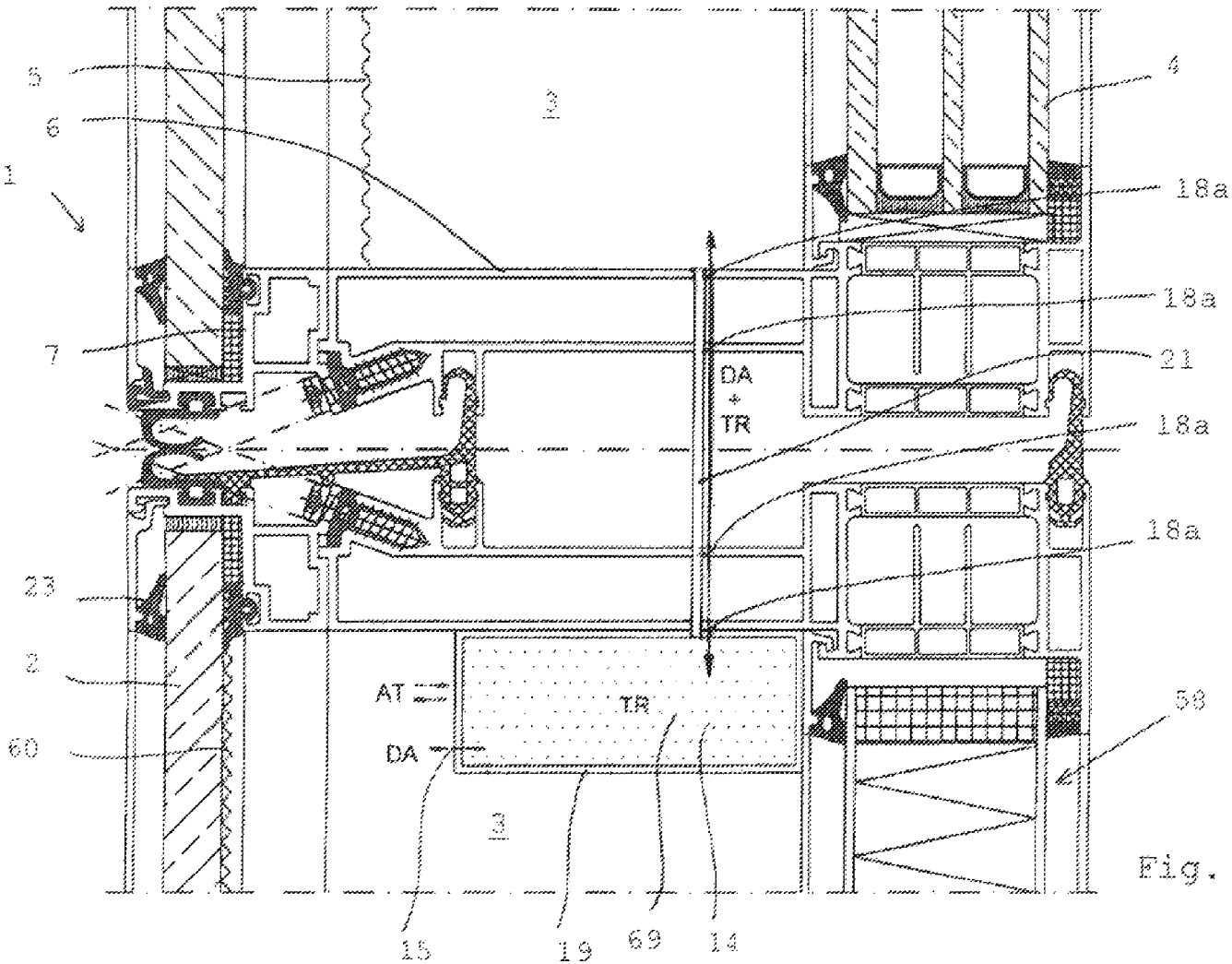
FIG. 10 A vertical section through a façade element according to an eighth embodiment of the invention.

In the embodiment according to FIG. 10, an opaque element is shown, which is provided in the form of a spandrel panel 58 in the plane of the inner glass element 4 and an opaque coating 60 in the plane of the outer glass pane, conventionally referred to as position 2. With this configuration, it is possible to arrange a separately provided desiccant container 19 in the opaque region. In the embodiment shown in FIG. 10, the desiccant container 19 is a replaceable container located in the spandrel area in front of the spandrel panel 58. The desiccant container 19 also forms part of the pressure equalization device with openings 15 into the façade intermediate space 3 surrounding the desiccant container 19. Between the two vertically adjacent façade elements there is an air conducting element 21 which has an inner cavity and connects the inner cavity 69 of the desiccant container in the spandrel panel 58 with the façade intermediate space 3 of the adjacent panel. For this purpose, the air conducting element, which can be a tube or hose, for example, is inserted through insertion openings 18*a* in the main profile 6 and fixed on the outside of the insertion element 21 in a sealing manner in the insertion openings 18*a*. In this way, pressure equalization is achieved in the façade intermediate space 3 of the adjacent façade element and incoming air is dehumidified at the same time.

Figure 11:
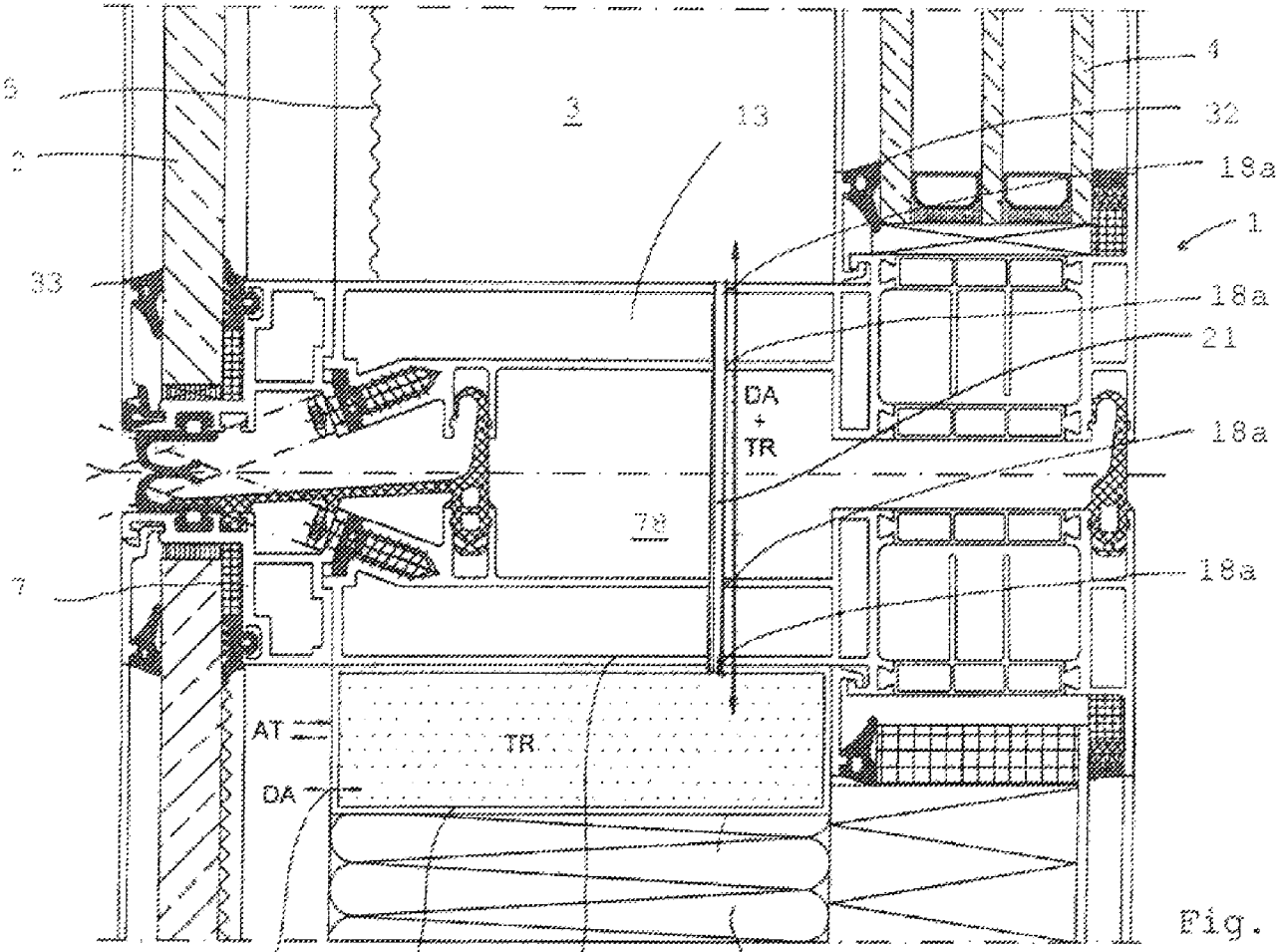
FIG. 11 A vertical section through a façade element according to a ninth embodiment of the invention.

The embodiment according to FIG. 11 closely corresponds to that according to FIG. 10. In contrast to the embodiment according to FIG. 10, however, an interior space in the opaque region in the area of the frame of the main frame profile 6 is completely filled with insulating material 62. For this reason, the desiccant container 19 also occupies the whole depth of the main frame profile 6, and openings 15 are provided at the front of the desiccant container 19 in order to achieve pressure equalization in the area of the sub-frame profile 7 via the façade intermediate space 3, which is not filled with insulating material. As in the embodiment shown in FIG. 10, the air conducting element 21 is used to equalize the pressure in the façade intermediate space 3 of the vertically adjacent façade element and to dry the incoming air.

The above examples clearly show that there are two basic concepts with regard to the pressure equalization device. On the one hand, a direct air connection can be established with the façade intermediate space so that there is no direct interaction with the drying device. On the other hand, a connection to the façade intermediate space can also be made via and through the drying device, so that there is direct interaction between the pressure equalization device and the drying device.

Figure 12:
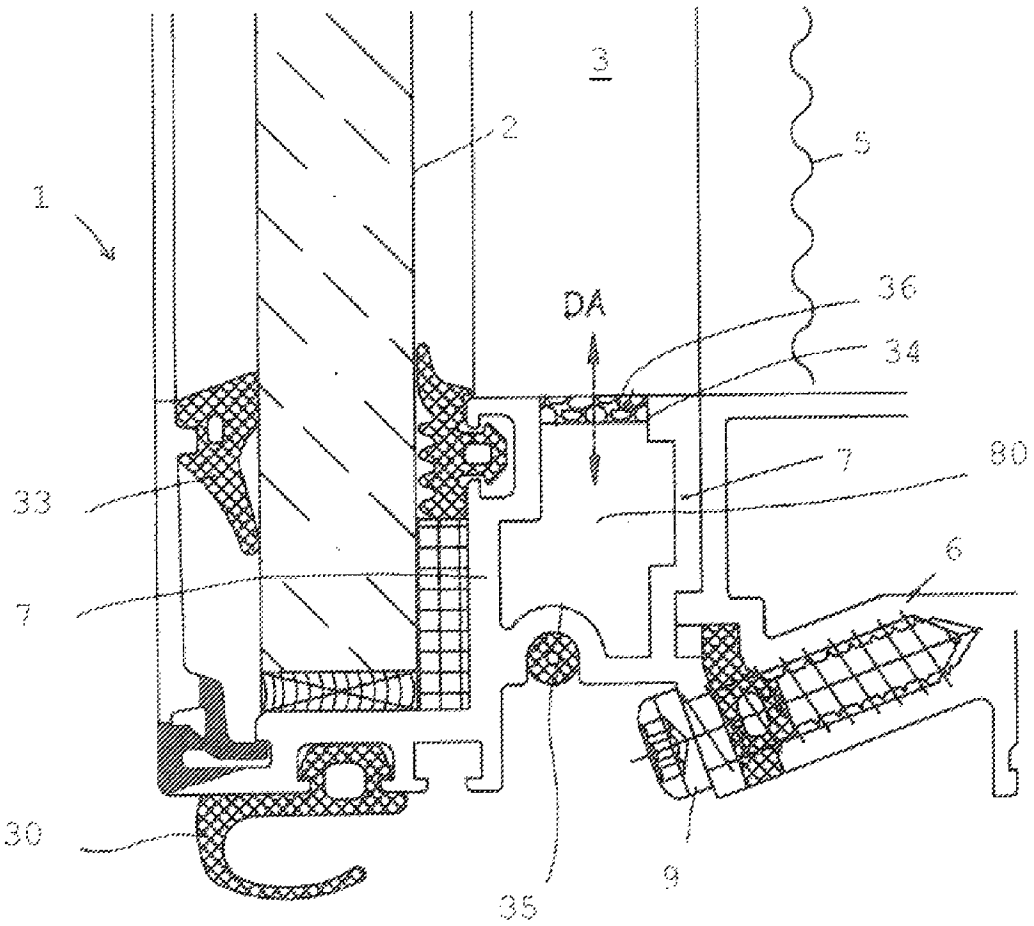
FIG. 12 A design of a pressure equalization device according to an embodiment of the invention.

The embodiment according to FIG. 12 shows the pressure equalization device integrated into the sub-frame profile 7 in detail. For this purpose, a long capillary tube 35 is clipped into the sub-frame profile 7. The long capillary tube can preferably be made of metal or plastic. Thermoplastics or elastomers can be used as plastics. A filter element or membrane can be arranged at the inlet of the capillary tube (not shown in the cross-section), which is in air-conducting connection with the outside atmosphere. In the same way, a filter or membrane can alternatively or additionally be provided at the outlet of the capillary tube (not shown in the cross-section). The outlet of the capillary tube is in air-conducting connection with the hollow chamber 80 in the sub-frame profile 7. The hollow chamber 80 in the sub-frame profile 7 is provided with a filter 36 in a pressure equalization opening to the façade intermediate space 3. This allows pressure equalization to take place between the façade intermediate space 3 and the outside atmosphere via the cavity 80 and the capillary tube 35 in the direction of arrow DA, via an air-conducting connection between the cavity 80 and an outlet opening of the long capillary tube 35 and the air-conducting connection between the inlet opening of the long capillary tube 35 and the outside atmosphere. The embodiment shown in FIG. 12 is an example of those embodiments in which there is no direct interaction between the pressure equalization device and the drying device.

Figure 19:
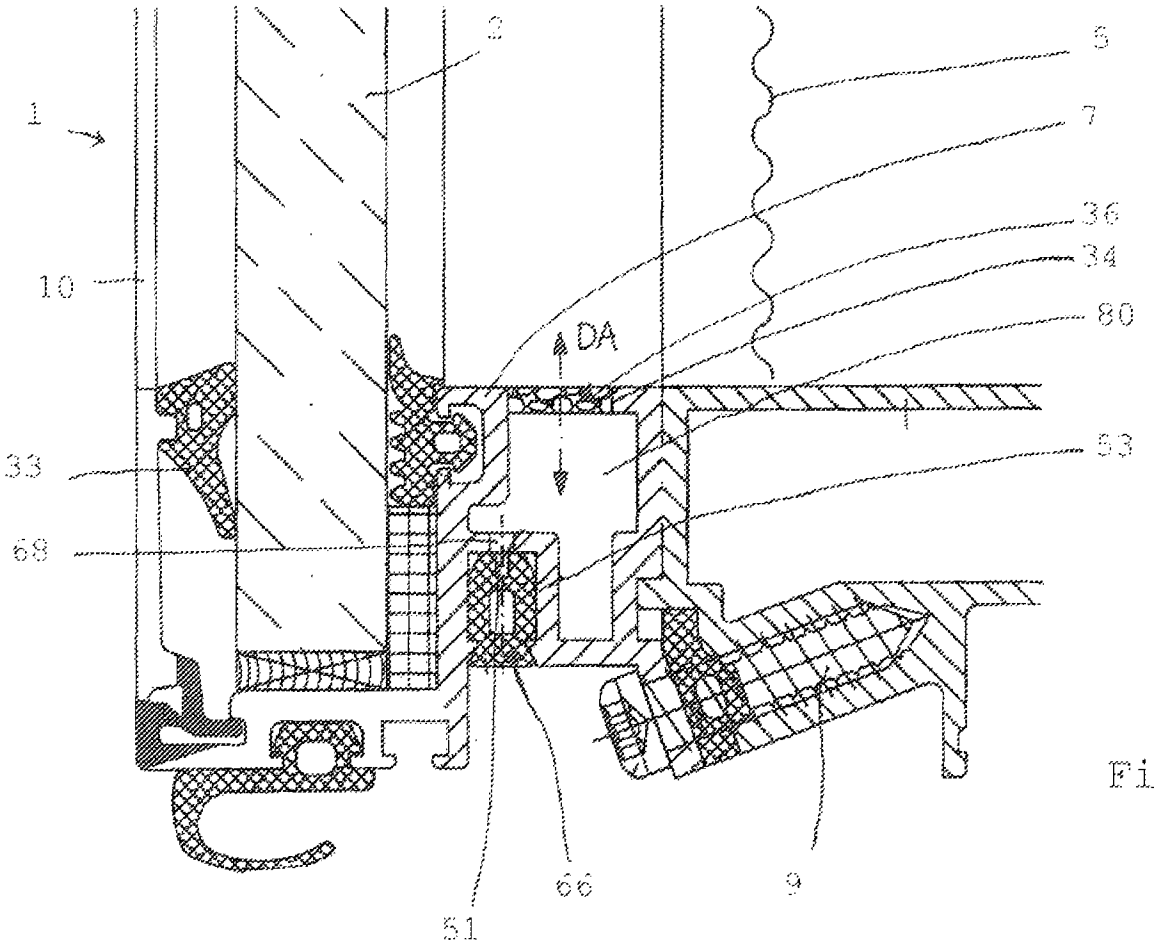
FIG. 19 A vertical section through a façade element according to a 14th embodiment of the invention, which represents a variant of the embodiment according to FIG. 16 with a long capillary tube.

The embodiment shown in FIG. 19 is similar to that shown in FIG. 12, but uses a plastic profile 66 made of a thermoplastic or elastomer instead of the long capillary tube shown in FIG. 12. For this purpose, a groove 53 is formed in the area of the hollow chamber 80 in the sub-frame profile 7, and the plastic profile 66 is inserted into the groove 53 in order to seal the groove 53 at a distance from the groove. A groove 51 with a rectangular cross-section which represents the capillary element is provided in the plastic profile 66 made of a thermoplastic or elastomer. There is also an opening 68 in the groove 53, which connects the cavity 80 with the groove 51. The groove is connected to the outside atmosphere via a gap in the plastic profile 66. The desired pressure equalization takes place via the plastic profile 66, the hollow chamber 80 and, in the direction of the arrow DA, the filter 36 in the pressure equalization opening 34 of the hollow chamber 80 of the sub-frame profile 7.

Figure 20:
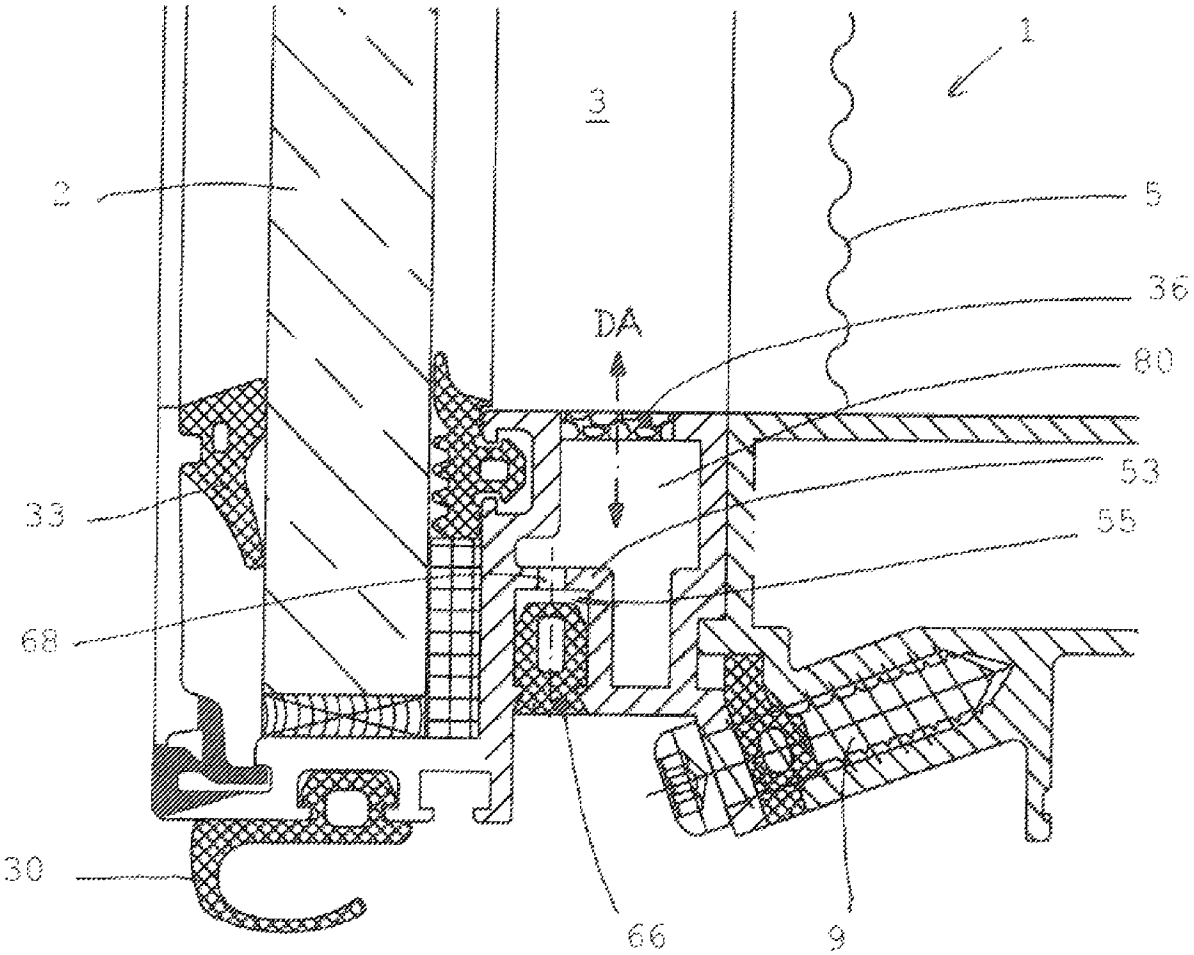
FIG. 20 A vertical section through a façade element according to a 15th embodiment of the invention, which represents a variant of the embodiment according to FIG. 16 with a long capillary tube.

The embodiment according to FIG. 20 differs from that according to FIG. 19 only in that a space is provided which forms a gap 55 between the groove 53 in the sub-frame profile 7 and the plastic profile 66 inserted into the groove 53. The plastic profile 66 for sealing the groove 53 is made of a thermoplastic or elastomer and must be both sufficiently adaptable and sufficiently vapor-tight, something which must be taken into account when selecting a suitable plastic profile. The gap 55 forms the capillary element and is connected to the hollow chamber in the sub-frame profile 7 via the opening 68. As in the embodiment shown in FIG. 19, in the embodiment shown in FIG. 20, too, there is no direct interaction between the pressure equalization device and the drying device.

Figure 21:
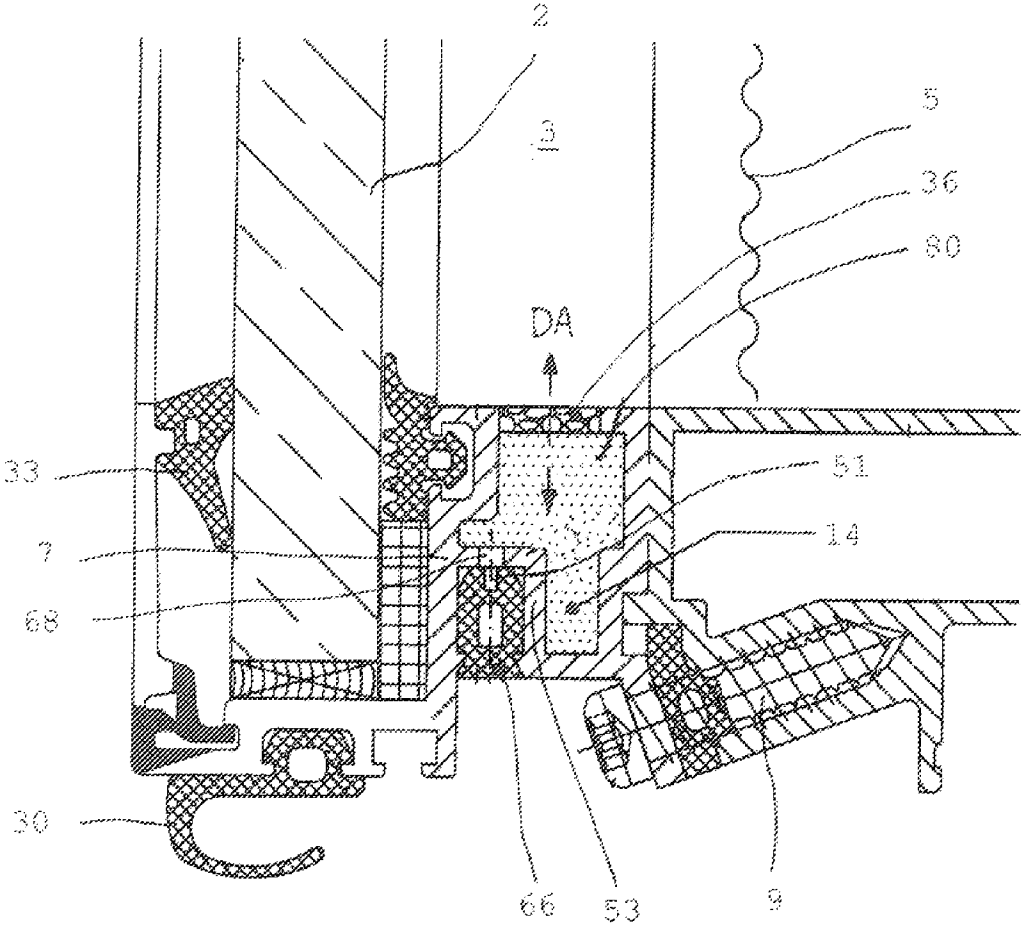
FIG. 21 A vertical section through a façade element according to a 16th embodiment of the invention, which represents a variant of the embodiment according to FIG. 16 with a long capillary tube.

In the embodiment shown in FIG. 21, in contrast to that shown in FIG. 19, the hollow chamber 80 in the sub-frame profile 7 is filled with desiccant 14. Hence, there is direct interaction between the pressure equalization device and the drying device. As in the embodiment shown in FIG. 19, the capillary element is again formed by a groove 53 in the sub-frame profile 7 and a gap 51 in the plastic profile 66 which forms a long capillary element. The capillary element 51 has a rectangular cross-section. A filter 36 is inserted into the pressure equalization opening to the façade intermediate space 3.

Figure 22:
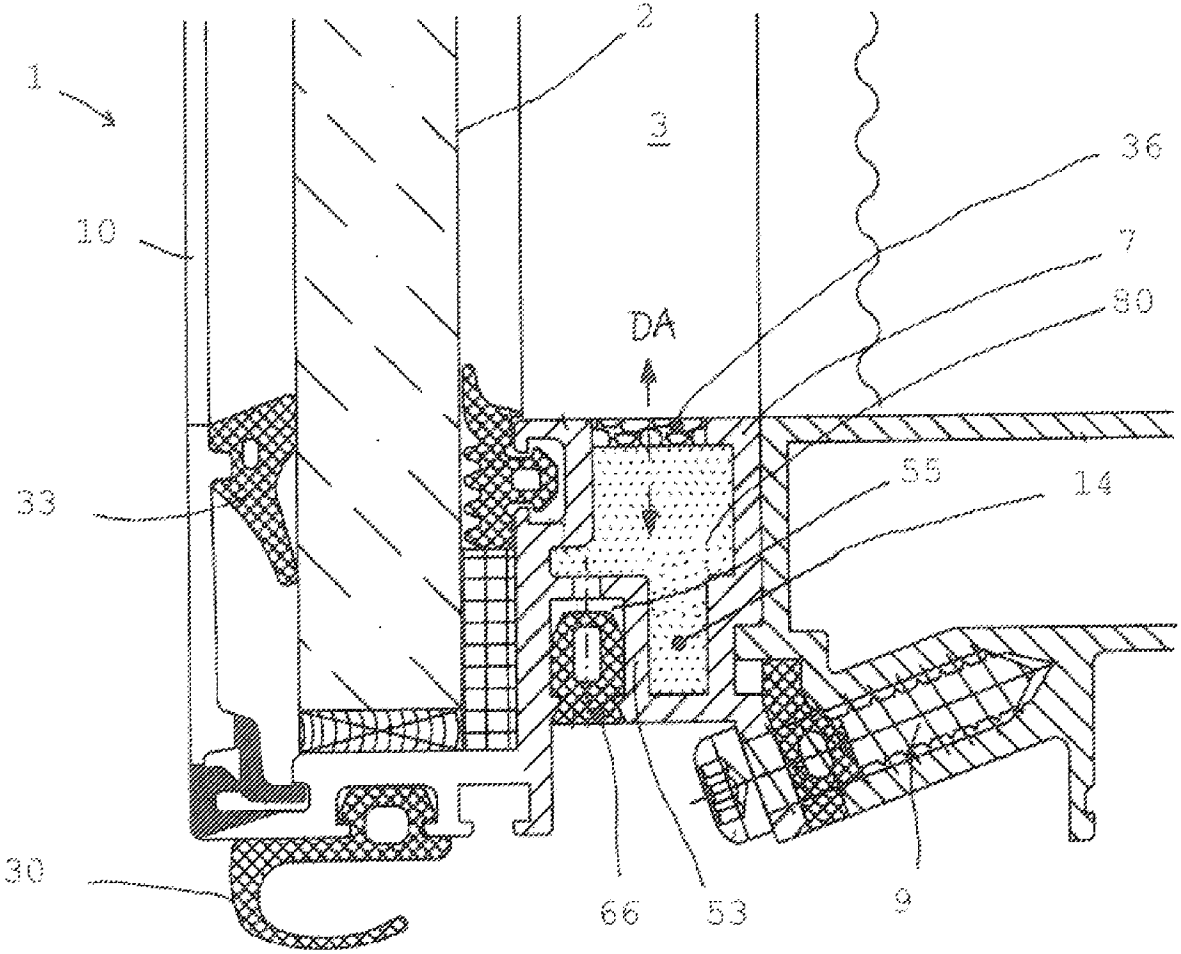
FIG. 22 A vertical section through a façade element according to a 17th embodiment of the invention, which represents a variant of the embodiment according to FIG. 16 with a long capillary tube.

FIG. 22 shows a variant of the embodiment according to FIG. 20 in which, similarly, the hollow chamber 80 in the sub-frame profile 7 is also filled with desiccant 14. The pressure equalization device thus again comprises a long capillary groove formed by the gap 55 between the plastic profile 66 made of a thermoplastic or elastomer and the groove 53, and the filter 36 between the hollow chamber 80 and the façade intermediate space 3. However, due to the filling of the hollow chamber 80 with desiccant 14, in contrast to the embodiment shown in FIG. 20, there is direct interaction between the pressure equalization device and the drying device.

Figure 17:
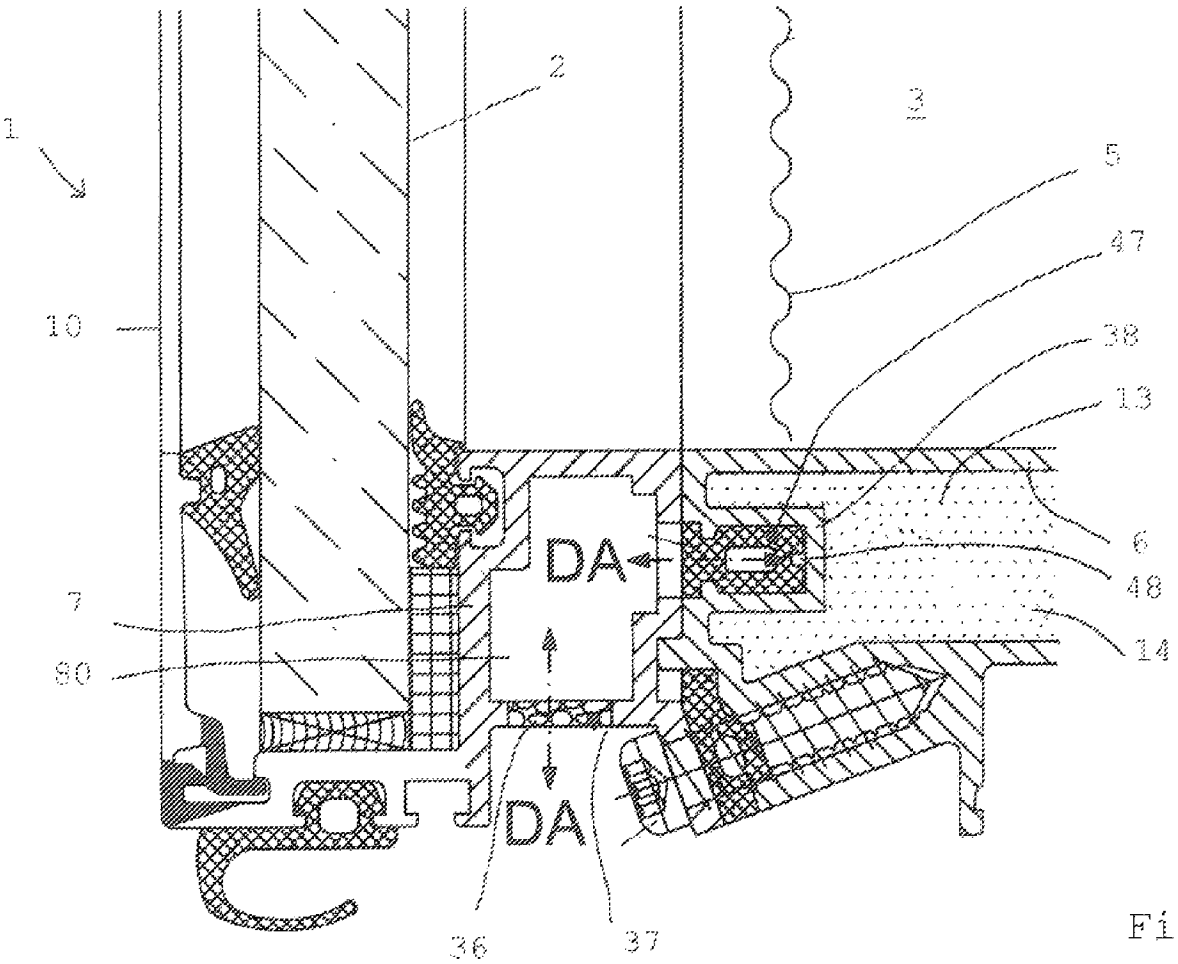
FIG. 17 A vertical section through a façade element according to a twelfth embodiment of the invention, which represents a variant of the embodiment according to FIG. 16 with a long capillary tube.

In the embodiment shown in FIG. 17, there is a pressure equalization opening 37 with a filter 36 in the sub-frame profile 7 which connects the hollow chamber 80 in the sub-frame profile 7 to the outside atmosphere. Furthermore, a groove 38 is provided in the main frame profile 6 as part of a long capillary tube. In this groove there is a plastic profile 47 made of a thermoplastic or elastomer which serves to seal the groove 38 and is provided with a gap 48 as part of the capillary tube cross-section. The pressure equalization device therefore includes elements in both the sub-frame profile 7 and the main frame profile 6. A capillary groove comprising a groove 38 and a gap 48 in the plastic profile 47 is formed in the main frame profile 6. The cavity 13 in the main frame profile 6 adjacent to the groove 38 in the main frame profile 6 is filled with desiccant 14. An opening (not shown in the sectional plane of FIG. 17) connects the long capillary tube with the hollow chamber filled with desiccant 14 in the main frame profile 6. Hence, there is direct interaction between the pressure equalization device and the drying device.

Figure 18:
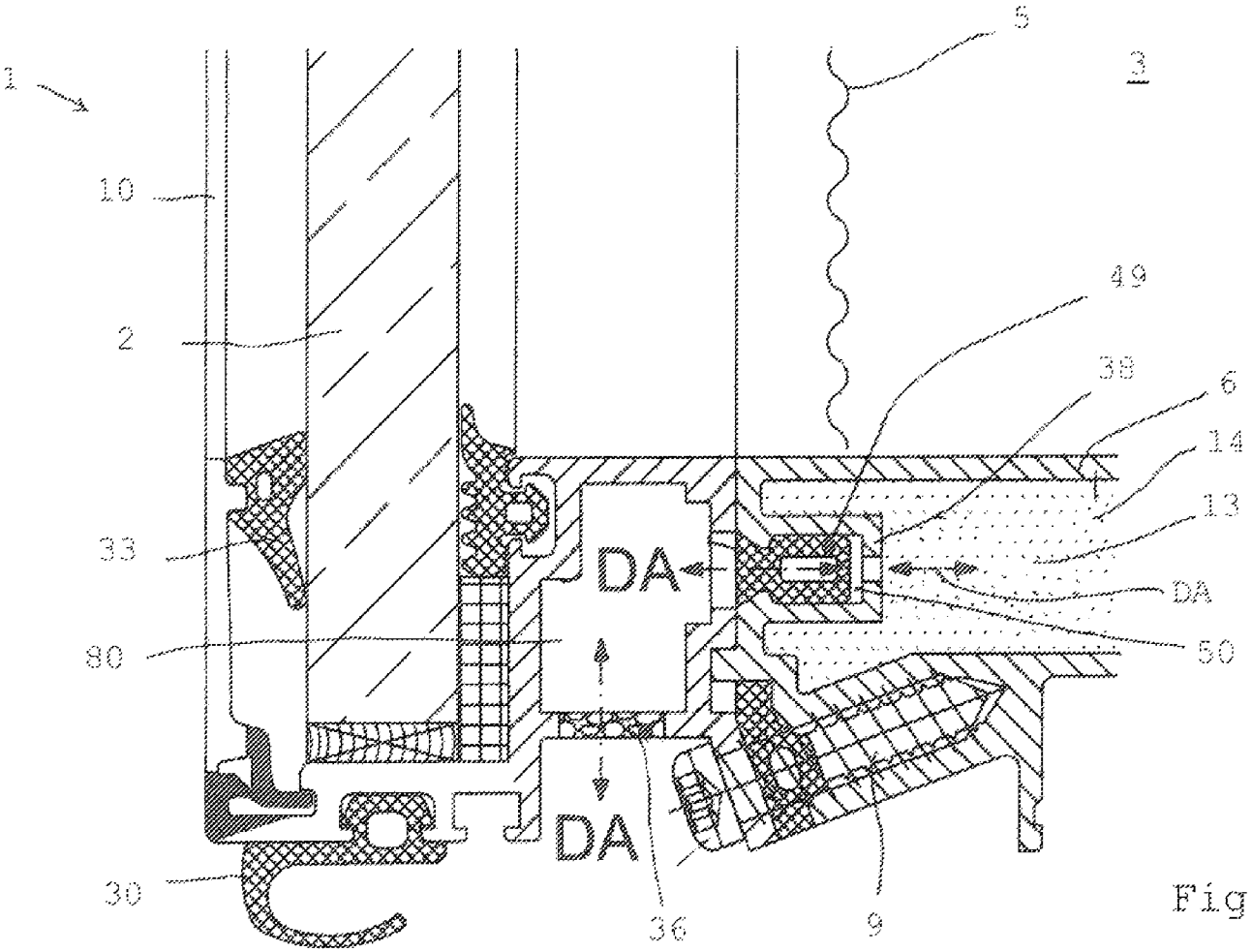
FIG. 18 A vertical section through a façade element according to a 13th embodiment of the invention, which represents a variant of the embodiment according to FIG. 16 with a long capillary tube.

The embodiment according to FIG. 18 differs from that according to FIG. 17 in that a differently shaped, elongated plastic profile 49 made of a thermoplastic or elastomer is inserted into the groove 38 in the main frame profile 6, which also serves to seal the groove 38, but ends at a distance from the groove base, so that a gap 50 is present between the groove 38 in the main frame profile 6 and the plastic profile 49. Hence, the pressure equalization device is again formed in both the sub-frame profile 7 and the main frame profile 6. In the main frame profile 6, a capillary groove is provided which is formed by the gap 50 between the groove 38 and the plastic profile 49. In addition, the pressure equalization device interacts directly with the drying device, since the cavity 13 in the main frame profile 6 adjacent to the groove 38 is filled with desiccant 14 and an opening in the groove 38 is located in the desiccant-filled cavity. A filter 36 in the sub-frame profile 7 prevents the ingress of dirt.

Figure 13:
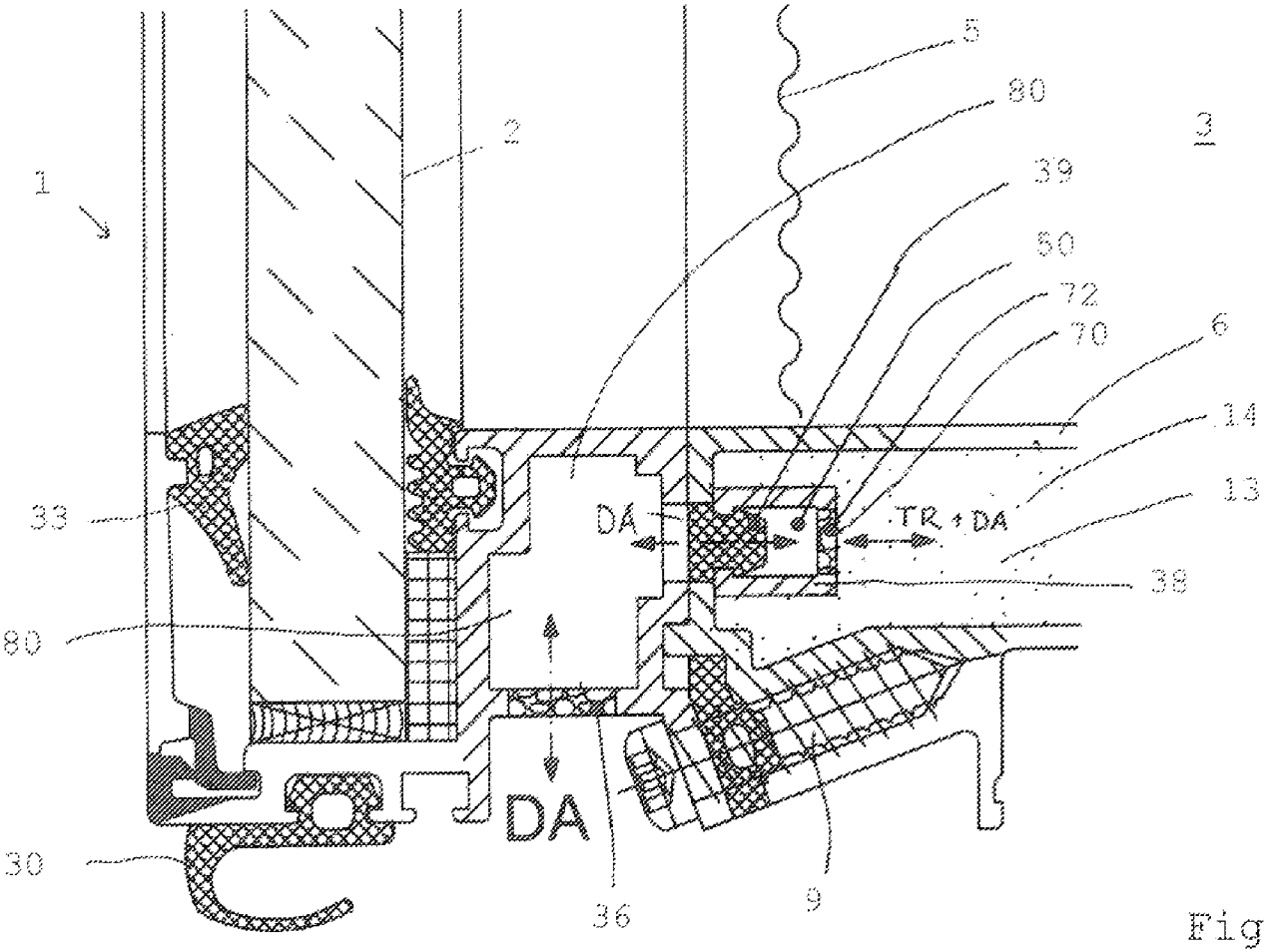
FIG. 13 A design of a pressure equalization device according to a further embodiment of the invention.

The embodiment shown in FIG. 13 is similar to that shown in FIG. 18, but the sealing plastic profile 39 made of a thermoplastic or elastomer inserted into the groove 38 in the main frame profile 6 is shaped differently. Within the groove 38, a gap 50 is provided which forms a cavity and performs the function of a long capillary tube. The cross-sectional dimensions of the capillary tube can be adapted by appropriately selecting the dimensions of the plastic profile 39. The hollow chamber 13 in the main frame profile 6 adjacent to the groove 38 is filled with desiccant 14. The groove 38 has a pressure equalization opening 72 to the hollow chamber 13 in the main frame profile 6 filled with desiccant 14. A filter 70 can optionally be located in the pressure equalization opening 72. Compared to the exemplary embodiments according to FIGS. 18 and 19, in the embodiment according to FIG. 13 the cross-sectional area of the gap 50 is larger. Consequently, a very long capillary tube must be chosen in this exemplary embodiment. The longer the capillary tube, the better it works as a moisture inhibitor. A filter 36 in the sub-frame profile 7 prevents the ingress of dirt.

Figure 14:
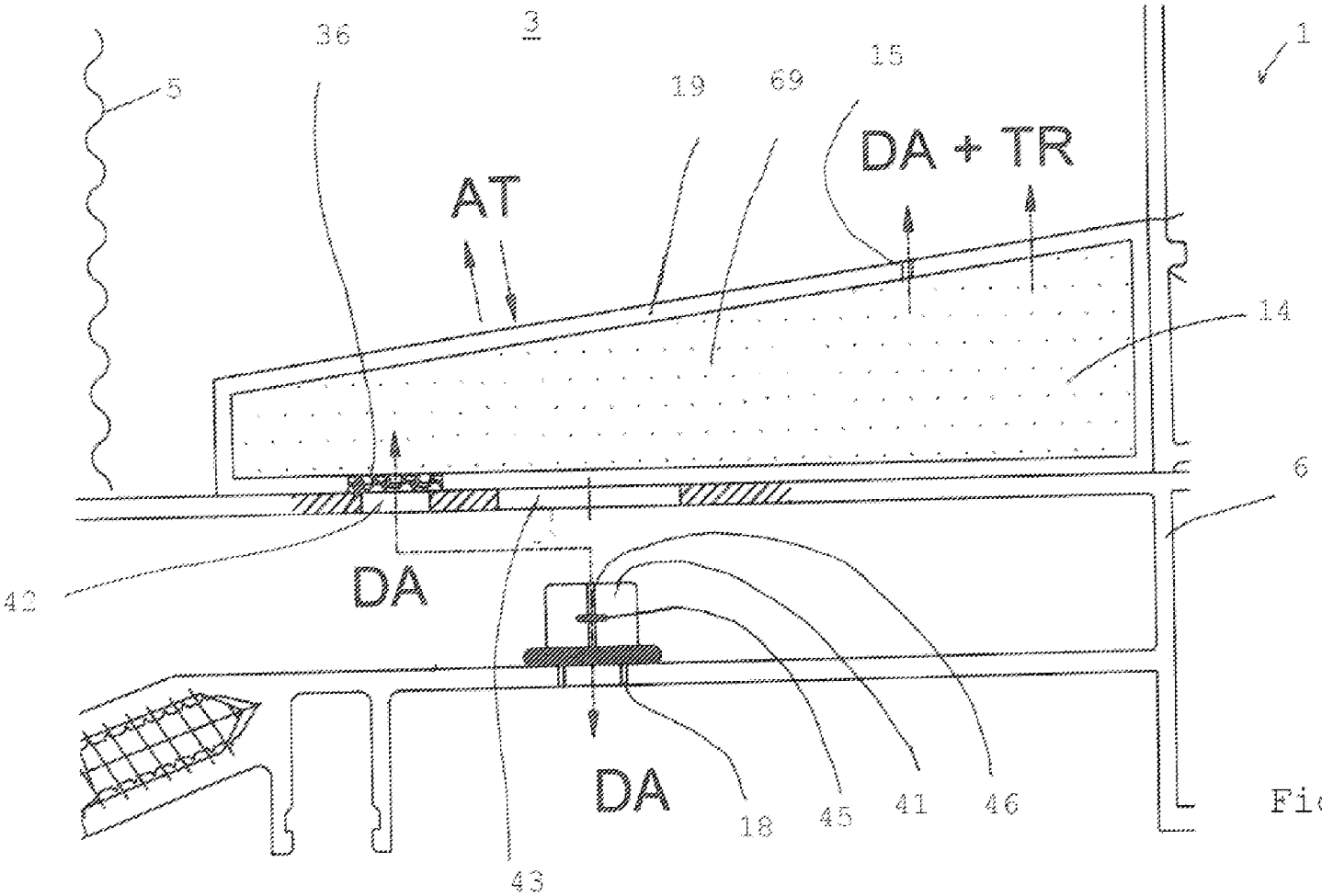
FIG. 14 A first embodiment of a pressure equalization device with a short capillary tube.

FIG. 14 shows a pressure equalization device that directly interacts with a drying device, further clarifying the general illustration in FIG. 8. A separate desiccant container 19 is provided, which can be attached to the main frame profile 6 in the direction of arrow AT, for example via a screw connection, and removed from it. In the main frame profile 6, a pressure equalization opening 42 is provided and there is a correspondingly arranged opening in the desiccant container 19, which can advantageously be provided with a filter 36 acting as a desiccant particle barrier. Furthermore, a maintenance opening 43 is provided in the main frame profile 6 through which it is possible to replace the short capillary tube 41 with membrane 45 located in a pressure equalization opening 18 in the main frame profile 6. The membrane acts as a filter and moisture inhibitor. There is an air-conducting pressure equalization path in the direction of arrow DA from the outside atmosphere into the cavity 69 of the desiccant container 19 filled with desiccant 14, and from there through corresponding openings 15 into the façade intermediate space 3. Through the latter openings 15, air is also exchanged between the inner cavity 69 of the desiccant container 19 and the façade intermediate space 3 in order to regulate the moisture content of the air in the façade intermediate space 3.

Figure 15:
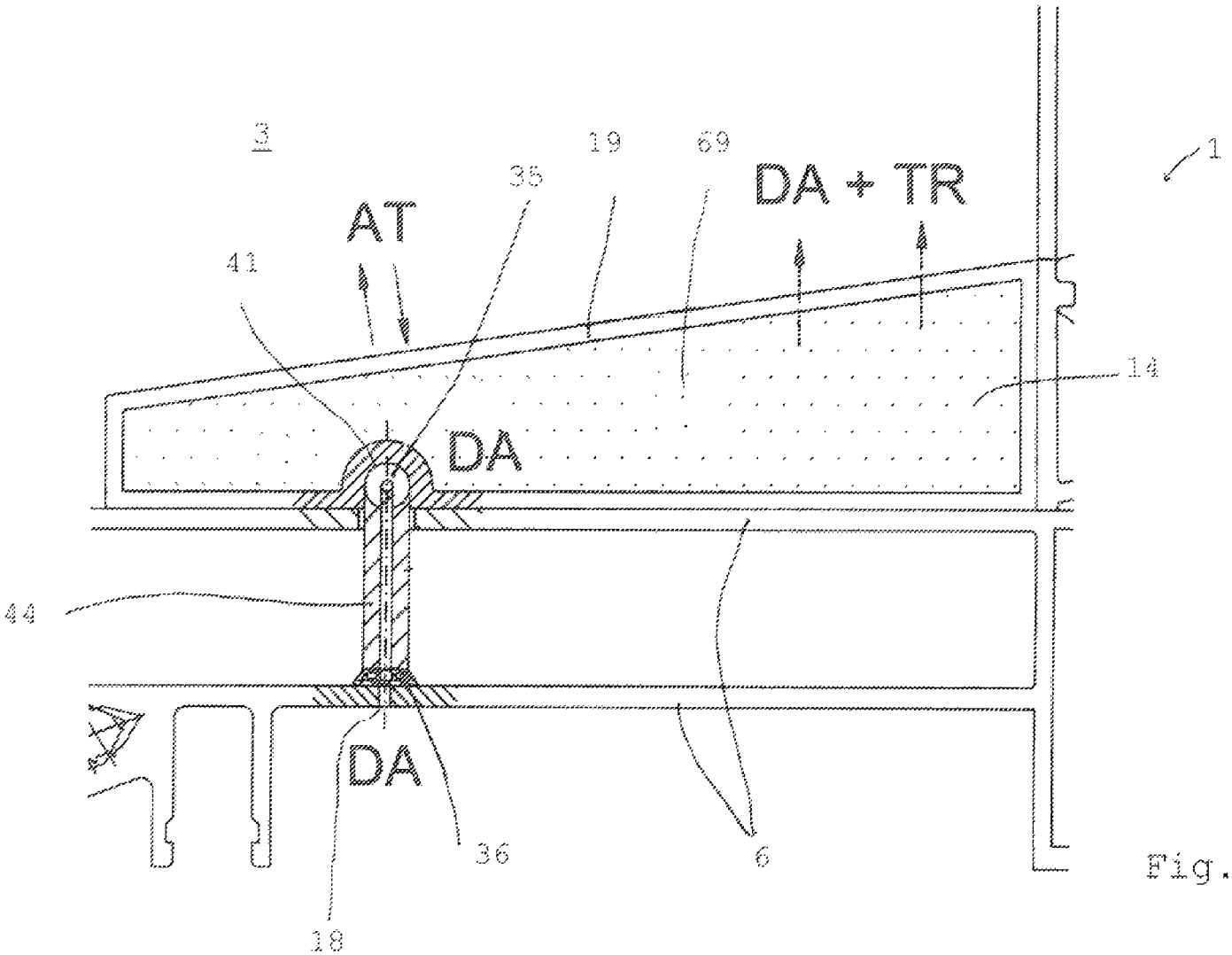
FIG. 15 A further embodiment with a design of a pressure equalization device in direct interaction with a drying device.

FIG. 15 shows a design similar to that shown in FIG. 14, but using a long capillary tube. For this purpose, a removable and therefore replaceable desiccant container 19 filled with desiccant 14 can be attached to the main frame profile 6. The pressure equalization device comprises a long capillary tube 35 which is inserted into a correspondingly dimensioned receiving groove in the desiccant container on the side of the desiccant container 19 facing the main frame profile 6. The long capillary tube is made of metal or a thermoplastic or elastomeric material. The outlet end of the long capillary tube 35 is in air-conducting connection with the inner cavity 69 of the desiccant container 19 via an opening that is not visible in the sectional plane of FIG. 15. Hence, there is direct interaction between the pressure equalization device and the drying device. The outlet end of the long capillary tube 35 is in air-conducting connection with the inner cavity 69 of the desiccant container 19 via an opening that is not visible in the sectional plane of FIG. 15. An inlet opening of the long capillary tube 35 shown only in section in FIG. 15 is in air-conducting connection with a connection piece 44 which also has an internal flow channel for air and whose end facing away from the long capillary tube 35 is in air-conducting connection with a pressure equalization opening 18 in the main frame profile 6 which establishes the flow connection to the expansion joint 78. A filter 36 is provided in the pressure equalization opening 18 in the main frame profile 6.

Replacement of the desiccant container 19 in the direction of the arrow AT is carried out as in the embodiments according to FIGS. 8 and 14, and the exchange of air between the façade intermediate space 3 and the cavity 69 of the desiccant container 19 filled with desiccant 14 takes place as described in connection with the embodiment according to FIG. 14.

Figure 16:
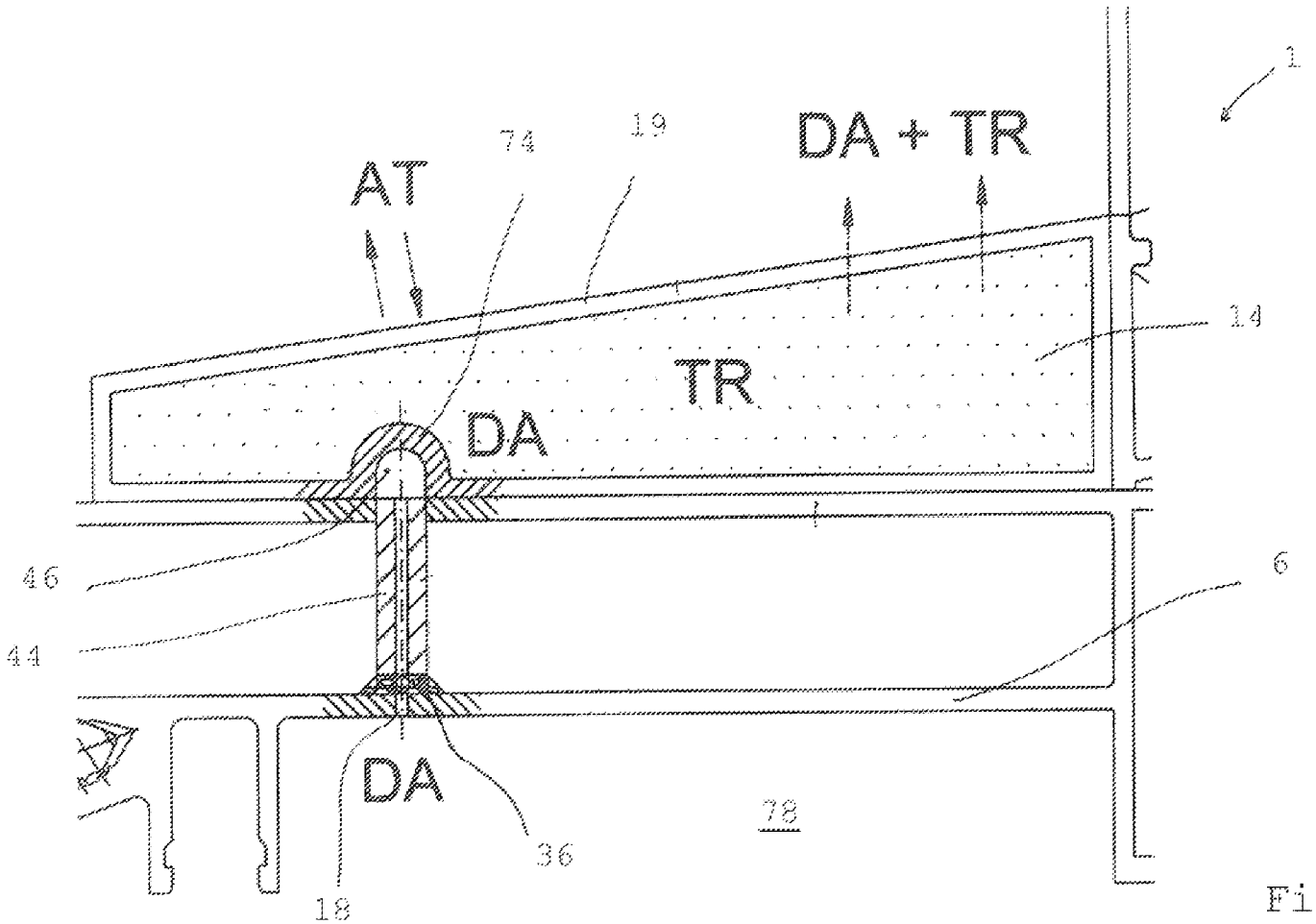
FIG. 16 A further embodiment with a further design of a pressure equalization device with a long capillary tube in direct interaction with a drying device.

In a modification of FIG. 15, FIG. 16 shows a different configuration of a long capillary tube which is composed of two sections of an elongated cavity 46, a groove-shaped indentation 74 in the wall of the desiccant container 19 and the wall of the main frame profile 6 with an opening in which the connection piece 44 is arranged. The outlet end of the long capillary tube 46 is in air-conducting connection with the inner cavity 69 of the desiccant container 19 via an opening that is not visible in the sectional plane of FIG. 16. The inlet opening of the long capillary tube 46 shown only in section in FIG. 16 is in air-conducting connection with the connection piece 44 which also has an internal flow channel for air and whose end facing away from the long capillary tube 46 is in air-conducting connection with a pressure equalization opening 18 in the main frame profile 6 which establishes the flow connection to the expansion joint 78. A filter 36 is provided in the pressure equalization opening 18 in the main frame profile 6. Otherwise, the embodiment shown in FIG. 16 corresponds to that shown in FIGS. 14 and 15.

Figure 23:
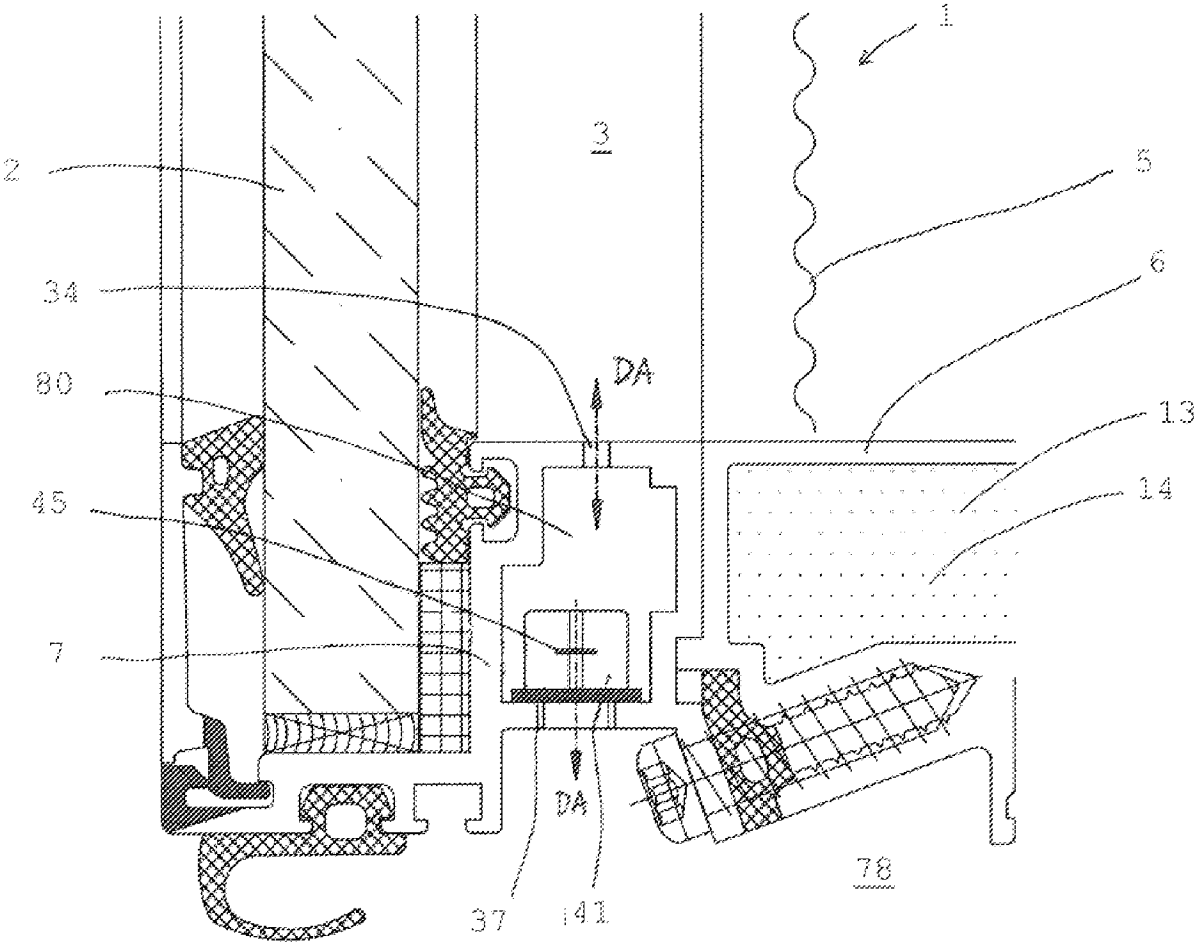
FIG. 23 A second embodiment of a pressure equalization device with a short capillary tube.

FIG. 23 shows a further embodiment using a short capillary tube 41 with a membrane 45 which is in air-conducting connection with a pressure equalization opening 37 in the sub-frame profile 7. Via the short capillary tube, for pressure equalization, air from the expansion joint 78 passes into the hollow chamber 80 in the sub-frame profile 7 and from there via the pressure equalization opening 34 into the façade intermediate space 3. The drying device comprises desiccant 14 in a hollow chamber 13 of the main frame profile 6. The hollow chamber exchanges air with the façade intermediate space 3. Hence, there is no direct interaction between the pressure equalization device and the drying device.

Figure 24:
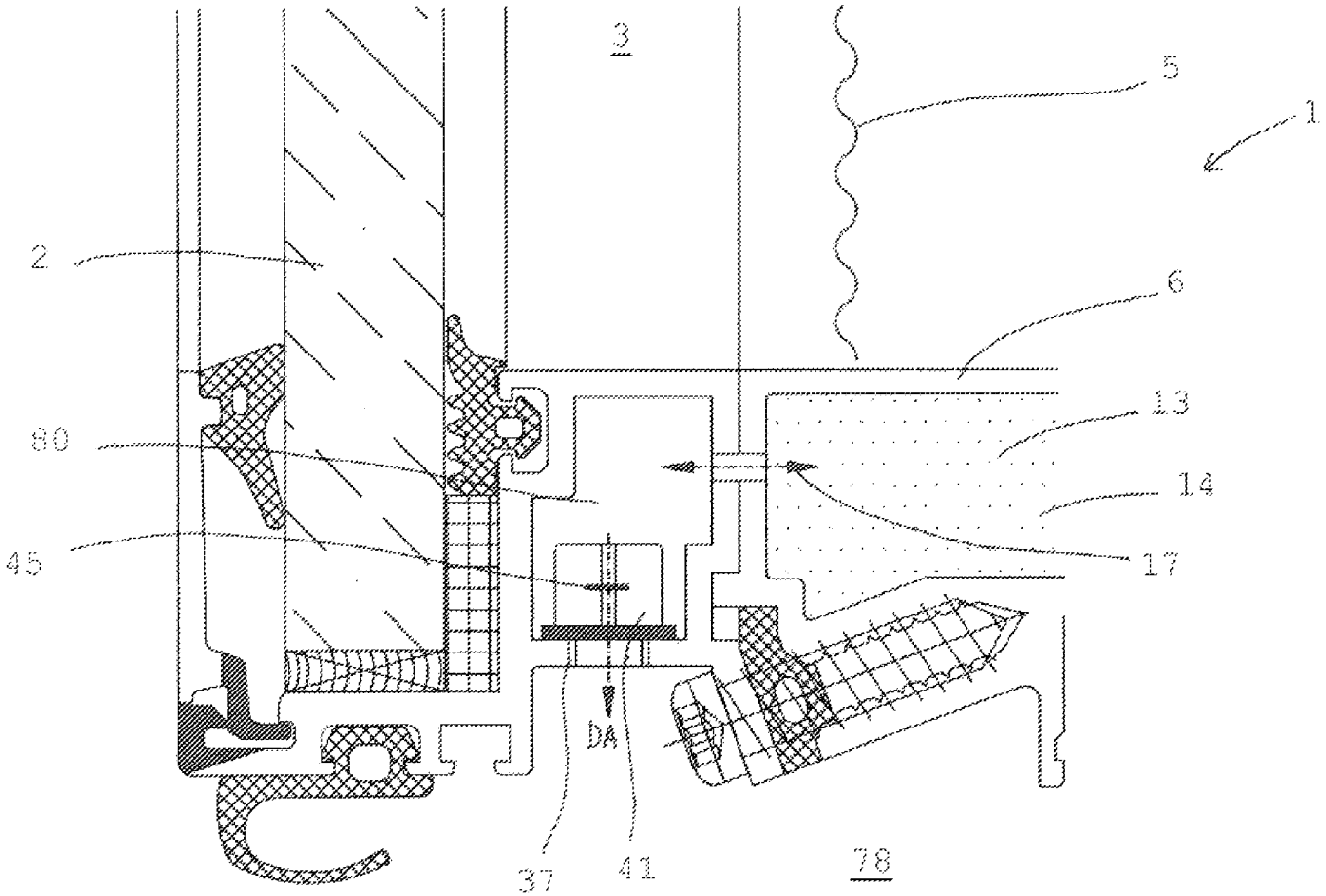
FIG. 24 A third embodiment of a pressure equalization device with a short capillary tube.

The embodiment shown in FIG. 24 represents a modification of that shown in FIG. 23. There is direct interaction between the pressure equalization device and the drying device because, in contrast to the embodiment shown in FIG. 23, there is no direct exchange of air between the hollow chamber 80 in the sub-frame profile 7 and the façade intermediate space 3, since the hollow chamber 80 is in air connection with the desiccant-filled hollow chamber 13 of the main frame profile 6. For this purpose, aligned openings are provided in the hollow chamber 80 and the hollow chamber 13 through which, as described with reference to FIG. 5, pressure equalization takes place between the outside atmosphere and the façade intermediate space with interposition of the drying device.

Figure 25:
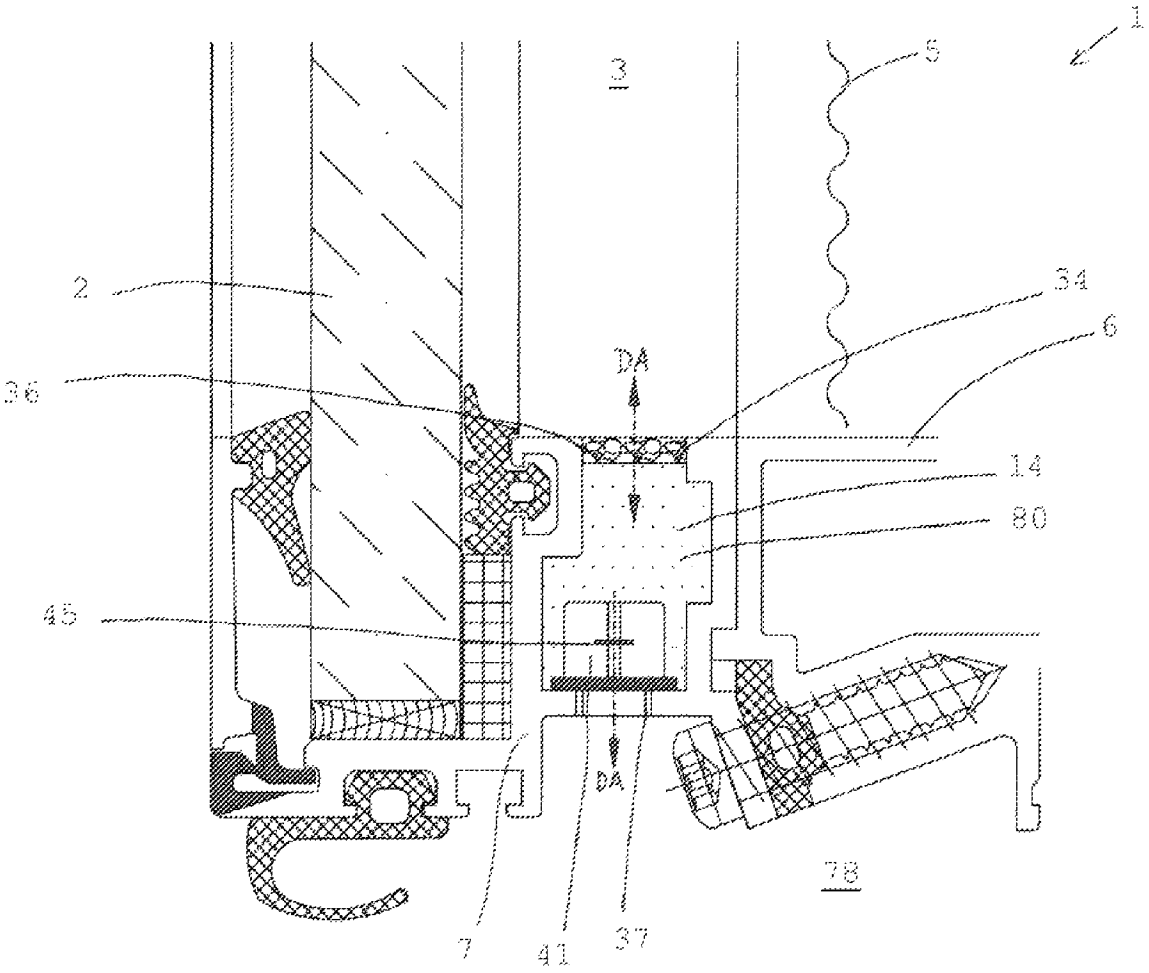
FIG. 25 A fourth embodiment of a pressure equalization device with a short capillary tube.

The embodiment shown in FIG. 25, like the embodiments shown in FIGS. 23 and 24, uses a short capillary tube 41 with a membrane 45 whose inlet opening is in air-conducting connection with a pressure equalization opening 37 in the sub-frame profile 7. There is direct interaction between the pressure equalization device and the drying device because the hollow chamber 80 in the sub-frame profile 7 is filled with desiccant 14. Furthermore, a pressure equalization opening 34 is provided in the hollow chamber 80 which is in air-conducting connection with the façade intermediate space 3. A filter element 36 is located in the pressure equalization opening 34.

The embodiment according to FIG. 26, like the embodiment according to FIG. 10, has an opaque panel 58 in the spandrel area which is provided instead of the inner glazing element. The embodiments of the pressure equalization device and the drying device, on the other hand, correspond to those illustrated in FIG. 18 by a detailed view and previously explained.

The panel 58 is thermally insulated and has an outer cover shell 59, which is usually made of metal. The cover shell is preferably dark towards the façade intermediate space and, particularly preferably, dark and matt.

An inner cover shell 61 is provided on the room side. An insulating material 62 is located between the cover shells 59 and 61. The insulating panel is preferably made of open-cell mineral wool, organic foam or aerogel or is a vacuum panel. The panel 58 is held to the façade intermediate space 3 by a bead 20 with the interposition of a sealing strip 57, while an inner seal 31 is provided on the room side. Optional solar shading 5' can also be provided in the region of the panel 58, in particular if the outer glazing element 2 is not provided with an opaque coating 60 at position 2.

Desiccant 14 is replaced and fresh, regenerated desiccant is blown in using a replacement device 16 which extends through a hollow chamber 67 of the main frame profile 6 and whose inner cavity 65 connects the room side of the façade element 1 with the hollow chamber 13 in the main frame profile 6 in which the desiccant 14 is located. To prevent water vapor penetrating from the room side into the desiccant-filled cavity 13, a room-side sealing element 64 is provided, as shown in the detailed view in FIG. 27, which seals the inner cavity 65 of the replacement device at its room-side end. Furthermore, a sealing part 63 is provided in the area of the opening between the cavity 13 filled with desiccant 14 and the hollow chamber 67 of the main frame profile 6, which serves to prevent water vapor penetrating from the hollow chamber 67 of the main frame profile 6 into the desiccant-filled cavity 13. When the desiccant 14 is to be replaced, the sealing element 64 is removed and the desiccant 14 is sucked out through the inner cavity of the replacement device 16 towards the room side in the direction of arrow A. Fresh desiccant can then be blown into the hollow chamber 13 in the direction of arrow B through the inner cavity 65 of the replacement device 16 and the sealing element 64 can then be reinserted. This allows desiccant 14 to be replaced easily from the room side.

Figure 28:
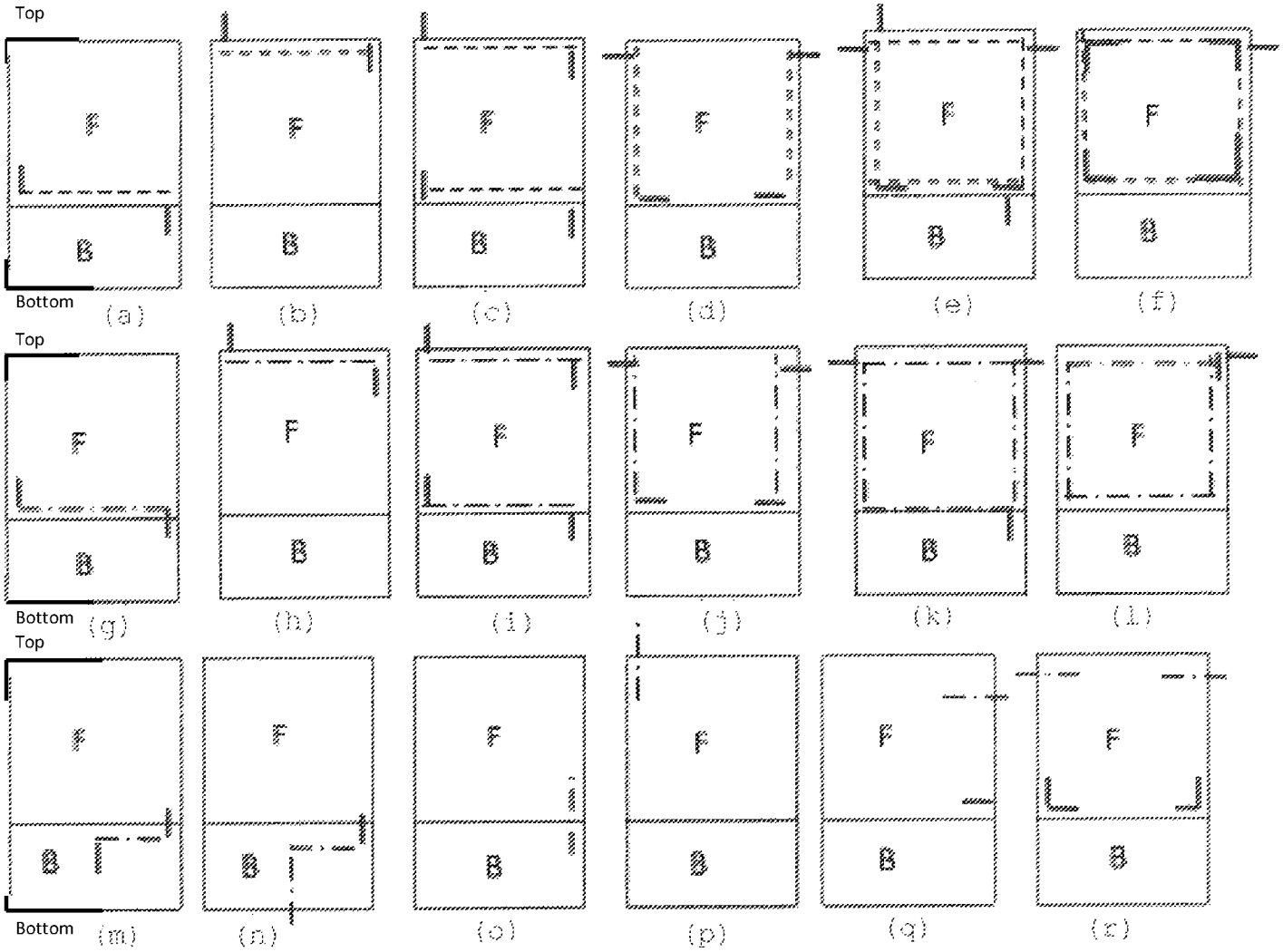
FIG. 28(*a*) to FIG. 28(*r*)

In FIG. 28, various possible arrangements of the pressure equalization device and drying device are shown schematically in the schematic diagrams 28(*a*) to 28(*r*). The window region is shown as "F" and the optional opaque region, which is preferably located in the spandrel area, is shown as "B". Dashed lines indicate a long capillary tube that interacts with a drying device, while horizontal dash-dotted lines in the drawing plane of FIG. 28 indicate a long capillary tube without interaction with a drying device. The horizontal lines in the drawing plane of FIG. 28 correspond to a horizontal direction when the façade element is installed as intended. The vertical dash-dotted lines shown in FIG. 28(*a*) to (*r*) correspond to a pressure equalization device with a membrane and a short capillary tube. Finally, a distinction must be made with regard to the arrangement of the pressure equalization openings. Straight solid lines indicate a pressure equalization opening to the outside or to the inside, while solid lines drawn at right angles indicate pressure equalization to the inside.

Therefore, as can be seen from FIG. 28, there are 18 feasible ways of arranging pressure equalization devices and drying devices. The arrangement of the pressure equalization device and drying device depends on the choice of pressure equalization system, in particular the choice of a short or long capillary tube, and the circumstances of the building. Short capillary tubes are preferably installed in vertical frame areas.

In the embodiments where the volume flow of air during pressure equalization does not interact with the desiccant, as shown by way of example in the embodiments according to FIGS. 4 and 7, the provision of a capillary tube can be omitted if the air flow is such that a sufficient service life can be achieved before it becomes necessary to replace the desiccant. Various configurations are possible, as shown in FIGS. 29 to 32.

In the configuration according to the vertical section in FIG. 29, the pressure equalization air flow takes place entirely in the sub-frame profile 7. For this purpose, a first pressure equalization opening 82 and a second pressure equalization opening 84 are provided, these being provided in the sub-frame profile 7 and, in the example according to FIG. 29, are spaced apart vertically as far as possible from one another and arranged in the immediate vicinity of the corner brackets 86 in the mitered corners of the sub-frame profile 7. The first pressure equalization opening 82 is arranged at the lowest point of the vertical part of the sub-frame profile, is connected with the outside atmosphere and extends obliquely downwards along an incline at the corner bracket, so that dust penetrating through the first pressure equalization openings 82 into the inner cavity of the sub-frame profile 7 can settle downwards and escape from the sub-frame profile. The second pressure equalization opening 84 is provided at the highest point of the, for example 4 meter, vertical part of the sub-frame profile 7 and connects the façade intermediate space 3 with the inner cavity of the sub-frame profile 7. The rectilinear air routing shown in FIG. 29 can already extend the service life of the desiccant compared to the case of direct air entry from the outside atmosphere into the façade intermediate space, which is defined by the provision of two aligned holes through the sub-frame profile.

As an alternative to the configuration shown in FIG. 29, during pressure equalization air can flow in a front cover 88 which, in the vertical section through the sub-frame profile shown in FIG. 30, is fastened to the sub-frame profile 7, being preferably clipped or screwed onto the sub-frame profile 7. The front cover has an inner cavity 90 and a vertical extension that substantially corresponds to the height of the vertical part of the sub-frame profile 7. The first pressure equalization opening 82 is provided at the bottom end of the front cover 88 at the lowest point of the sub-frame profile and points down vertically, so that dust penetrating into the inner cavity of the front cover 88 automatically falls out of the first pressure equalization opening 82 in a downward direction under the influence of gravity. At the top end of the front cover, an opening towards the sub-frame profile 7 at the top end of the vertical part of the sub-frame profile is provided. During pressure equalization, air flows between the top end of the front cover 88 and a sleeve 92 which extends through the sub-frame profile 7 and leads into the façade intermediate space 3. The largely rectilinear air routing shown in FIG. 30, with only a single 90° deflection at the top of the air flow, can also extend the service life of the desiccant compared to the case of direct air entry from the outside atmosphere into the façade intermediate space.

FIG. 31 modifies the flow routing according to FIG. 30 in such a way that a flow connection exists between the inner cavity 90 of the inner cover 88 and the inner cavity 96 of the sub-frame profile 7 via an air equalization opening 94 in the sub-frame profile 7 at the upper end of the front cover 88. The second pressure equalization opening 84 connects the façade intermediate space 3 and the inner cavity 96 of the sub-frame profile 7 and is provided approximately at the height of the first pressure equalization opening 82, so that when the pressure is equalized the air flow is deflected twice and covers a distance that essentially corresponds to twice the height of the vertical part of the sub-frame profile 7. This flow routing results in a double deflection of the air flow, between which the air flow essentially runs in a straight line.

The variant according to FIG. 32 corresponds to the configuration shown in FIG. 29, to which reference is made, but is modified in such a way that, in the inner cavity 96 of the sub-frame profile 7, an insertion element 98 is arranged which comprises a first wall 102 and a second wall 104, to each of which at least one transverse baffle 106 is attached, the alternating arrangement of which deflects the air flow several times in contrast to the rectilinear air flow according to the embodiment shown in FIG. 29 and forces a winding flow path. The transverse baffles 106, which are arranged alternately in the vertical direction, slope downwards towards the side of the free flow cross-section and therefore act as additional dust brakes. The air routing shown in FIG. 32, with multiple deflections of the air flow, can further extend the service life of the desiccant compared to the case of direct air entry from the outside atmosphere into the façade intermediate space.

According to a further embodiment of the invention (not shown), the measures explained with reference to FIGS. 31 and 32 can be combined with one another by providing a front cover and additionally providing alternately arranged transverse baffles either in the inner cavity of the sub-frame profile or in the inner cavity of the front cover, which constitute additional deflections of the air flow. In this case, however, it is preferable to provide the transverse baffles in the front cover, as they can fulfill the additional function of a dust brake and prevent or at least reduce the penetration of dust into the sub-frame profile. By combining the measures explained in FIGS. 31 and 32, the service life of the desiccant can be extended even further compared to the case of direct air entry from the outside atmosphere into the façade intermediate space.

In all embodiments with a front cover, this can also consist of a plastic material which is able to absorb moisture and thus serves as a moisture buffer that dehumidifies incoming air within the limits of its moisture absorption capacity and releases the absorbed moisture back into dried air flowing out of the façade intermediate space.

The embodiments illustrated in FIGS. 7, 8 and 29 to 32 have in common that the pressure equalization between the outside atmosphere and the façade intermediate space is separate from the air exchange between the façade intermediate space and a desiccant. Another common feature of these embodiments is that a dust filter can also be provided in the region of the first pressure equalization opening. If a capillary tube is dispensed with, the design of the air routing alone can significantly increase the service life of the desiccant until the moisture-laden desiccant needs to be replaced.

To further increase the service life of the desiccant, the air flow should be led through the desiccant during pressure equalization.

FIGS. 33*a* and 33*b* show a first possible embodiment, with FIG. 33*a* showing a vertical sectional view through the sub-frame profile in a sectional plane parallel to the glass plane of the façade element, and FIG. 33*b* showing a vertical sectional view in a sectional plane perpendicular to the glass plane.

The design of the sub-frame profile according to FIG. 33*a* is similar to that according to FIG. 29 and differs only in that, instead of the second pressure equalization opening between the inner cavity 96 of the sub-frame profile 7 and the façade intermediate space 7 an opening 108 to the desiccant chamber is provided. The opening 108 is preferably a bore hole. For all other design features, refer to the explanations concerning FIG. 29.

FIG. 33*b* uses dash-dotted lines to schematically indicate the flow pattern of the air flow during pressure equalization. This representation is simplified, because a gas flow through a bed of solid particles such as desiccant pellets is not linear, but takes a winding path with numerous branches. However, the dotted lines are intended to indicate which measures can be taken advantageously in order to load the desiccant with moisture as evenly as possible.

In the following, the situation will be explained in which there is negative pressure in the façade intermediate space and air from the outside atmosphere flows into the façade intermediate space. However, the explained principles apply equally to an air flow in the opposite direction.

After flowing into an inner cavity 110 of the main frame profile 6 which is filled with desiccant, the air flow is drawn to the openings 112*a*, 112*b* and 112*c* which connect the inner cavity 110 of the main frame profile 6 with the façade intermediate space 3. The driving force of the air flow is the air pressure present at the openings 112*a*, 112*b* and 112*c*, which is lower than that of the air flow when it enters the desiccant bed 98 through the opening 108.

The provision of three openings results in air flow to all openings, although the pressure loss through the desiccant bed 98 is substantially proportional to the distance between the opening 108 and the respective opening 112*a*, 112*b*, 112*c*. To counteract the effect whereby the air flow prefers the path with the least flow resistance, the openings 112*a*, 112*b*, 112*c* have different opening diameters. The opening diameter d1 of the opening 112*a* closest to the opening 108 at the inlet is the smallest and therefore generates the greatest pressure loss due to the flow resistance when air flows through. The diameter d2 of the opening 112*b* further from the opening 108 is greater than the diameter d1, and the diameter d3 of the opening 112*c* furthest from the opening 108 at the inlet is the greatest. In this way, the flow of air through the desiccant container can be made more even. The air flow through the desiccant bed 98 shown in FIGS. 33*a*, *b* can significantly extend the service life of the desiccant compared to the case of direct air entry from the outside atmosphere into the façade intermediate space.

The desiccant is introduced directly into an inner cavity of the main frame profile 6, so that no adverse optical effect can result from a desiccant container placed in the façade intermediate space. Nor is it necessary to provide a separate desiccant container. The desiccant is replaced using a replacement device, as explained with reference to FIGS. 26 and 27.

FIGS. 34*a* and 33*b* show a second possible embodiment, with FIG. 34*a* showing a vertical sectional view through the sub-frame profile in a sectional plane parallel to the glass plane of the façade element, and FIG. 34*b* showing a vertical sectional view in a sectional plane perpendicular to the glass plane.

The design of the sub-frame profile according to FIG. 34*a* is similar to that according to FIG. 30 and differs only in that, instead of the second pressure equalization opening between the inner cavity 96 of the sub-frame profile 7 and the façade intermediate space 3, an opening 108 to the desiccant chamber is provided. The opening 108 is preferably a bore hole. For all other design features, refer to the explanations concerning FIG. 30.

The air flow through the desiccant bed 98 in FIG. 34*b* corresponds to that in FIG. 33*b*.

The air flow through the desiccant bed 98 shown in FIGS. 34*a, b* can likewise significantly extend the service life of the desiccant compared to the case of direct air entry from the outside atmosphere into the façade intermediate space.

FIGS. 35*a* and 35*b* show a third possible embodiment, with FIG. 35*a* showing a vertical sectional view through the sub-frame profile in a sectional plane parallel to the glass plane of the façade element, and FIG. 35*b* showing a vertical sectional view in a sectional plane perpendicular to the glass plane.

The design of the sub-frame profile according to FIG. 35*a* is similar to that according to FIG. 31 and differs only in that, instead of the second pressure equalization opening between the inner cavity 96 of the sub-frame profile 7 and the façade intermediate space 3, an opening 108 to the desiccant chamber is provided. The opening 108 is preferably a bore hole. For all other design features, refer to the explanations concerning FIG. 31.

The air flow through the desiccant bed 98 according to FIG. 35*b* corresponds to that according to FIG. 33*b*, but with the difference that the opening 108 to the desiccant chamber is located vertically at the lower end of the façade element and the openings 112*a*, 112*b*, 112*c* are correspondingly located at the upper vertical end of the façade element. Due to the low volume flow of air, it makes no difference whether air flows through the desiccant bed 98 from top to bottom or from bottom to top.

The air flow through the desiccant bed 98 shown in FIGS. 35*a, b* can significantly extend the service life of the desiccant compared to the case of direct air entry from the outside atmosphere into the façade intermediate space.

FIGS. 35*c* and 35*d* show a further design of the embodiment according to FIGS. 35*a* and 35*b*. However, it should be clear that the possibility of adjusting the pressure loss and preferred flow paths through the drying device described below can be used in all embodiments in which the air flow is guided through the drying device for pressure equalization.

In the region of the openings 112*a*, 112*b* and 112*c*, a slide 122 is arranged, which is held in a suitable guide 124 so as to be displaceable in the axial direction indicated by the arrow A. In the slide, shutters 126*a*, 126*b* and 126*c* shown by hatching in FIG. 35*c* are provided, which can be moved by shifting the slide 122 between two positions which are shown in FIGS. 35*c* and 35*d*. In the position shown in FIG. 35*c*, the shutters are located in an area that does not overlap the openings 112*a*, 112*b* and 112*c*. Hence, there is no interaction between the openings 112*a*, 122*b*, 112*c* and the shutters. In the position shown in FIG. 35*d*, shutter 126*a* is located in front of the opening 112*a*, shutter 126*b* is located in front of the opening 112*b* and shutter 126*c* is located in front of the opening 112*c*. The pressure loss and also the air flow through the desiccant bed can be influenced by providing openings in the shutters and their opening cross-sections. In the exemplary embodiment according to FIGS. 35*c* and 35*d*, shutter 126*a* has no opening, shutter 126*b* has an opening with diameter d1, and shutter 126*c* has an opening with diameter d2. In the position shown in FIG. 35*d*, opening 112*a* is therefore closed. Opening 112*b* is narrowed to a diameter d1 and opening is narrowed to diameter d3. In this way, the pressure loss through the desiccant bed is increased, but the flow path between openings 108 and 112*a* is also prevented. FIGS. 36*a* and 36*b* show a fourth possible embodiment, with FIG. 36*a* showing a vertical sectional view through the sub-frame profile in a sectional plane parallel to the glass plane of the façade element, and FIG. 36*b* showing a vertical sectional view in a sectional plane perpendicular to the glass plane.

The design of the sub-frame profile according to FIG. 36*a* is similar to that according to FIG. 32 and differs only in that, instead of the second pressure equalization opening between the inner cavity 96 of the sub-frame profile 7 and the façade intermediate space 3, an opening 108 to the desiccant chamber is provided. The opening 108 is preferably a bore hole. For all other design features, refer to the explanations concerning FIG. 32.

The air flow through the desiccant bed 98 according to FIG. 36*b* corresponds to that according to FIG. 33*b*, so that reference is made to the explanations concerning FIG. 33*b*.

The air flow through the desiccant bed 98 shown in FIGS. 36*a, b* can significantly extend the service life of the desiccant compared to the case of direct air entry from the outside atmosphere into the façade intermediate space.

FIGS. 37*a* and 37*b* show a fifth possible embodiment, with FIG. 37*a* showing a vertical sectional view through the sub-frame profile in a sectional plane parallel to the glass plane of the façade element, and FIG. 37*b* showing a vertical sectional view in a sectional plane perpendicular to the glass plane.

The design of the sub-frame profile according to FIG. 37*a* comprises a front cover 88 as in the exemplary embodiment according to FIG. 35*a*, but with additional transverse baffles 106 in the front cover 88 for flow deflection and as a dust separator. The transverse baffles 106 create a winding flow path and further improve the effectiveness of the pressure equalization system.

The air flow through the desiccant bed 98 according to FIG. 37*b* corresponds to that according to FIG. 35*b*, so that reference is made to the explanations concerning FIG. 35*b*.

The air flow through the desiccant bed 98 shown in FIGS. 37*a, b* can significantly extend the service life of the desiccant compared to the case of direct air entry from the outside atmosphere into the façade intermediate space. This solution also has good dust separation properties thanks to the alternating transverse baffles in the front attachment element.

The embodiment according to FIGS. 37*a, b* already generates a relatively high pressure loss in the air flow of the pressure equalization device, which can be problematic if the desiccant bed 98 also causes a high pressure loss in the air flowing through, so that with slight pressure fluctuations there may not be sufficient driving force for air to flow through the entire height of the desiccant bed 98, which substantially corresponds to the height of a façade element.

Therefore, the embodiments described below with reference to FIGS. 38*a* to 42*b* provide an opening 108 between the sub-frame profile 7 and the main frame profile 6 that is substantially central in relation to the height of the desiccant bed 98, while the openings 112*a*, 112*b*, . . . are arranged above and below the desiccant bed 98. In this way, the distance between the opening 108 and each of the openings 112*a*, 112*b*, . . . is halved.

The simplest case is shown in the embodiment according to FIGS. 38*a* and 38*b*, with FIG. 38*a* showing a vertical sectional view through the sub-frame profile in a sectional plane parallel to the glass plane of the façade element, and FIG. 38*b* showing a vertical sectional view in a sectional plane perpendicular to the glass plane.

The opening 108 lies approximately halfway up the façade element, adjacent to a shortened air flow in the sub-frame profile 7 between the first pressure equalization opening 82 and the opening 108. This shortens the path of the air from the opening 108 to one of the openings 112*a*, 112*b* with a correspondingly smaller pressure loss of the air flowing through the desiccant bed 98. The pressure loss in the inner cavity of the sub-frame profile 7 is significantly less than in the desiccant bed 98. The configuration in the sub-frame profile 7 corresponds to that shown in FIG. 33*a*, but with the modification that the opening 108 is halfway up.

In the embodiment according to FIGS. 39*a* and 39*b*, FIG. 39*a* shows a vertical sectional view through the sub-frame profile in a sectional plane parallel to the glass plane of the façade element, and FIG. 39*b* shows a vertical sectional view in a sectional plane perpendicular to the glass plane.

The configuration of the sub-frame profile shown in FIG. 39*a* corresponds to that shown in FIG. 38*a*. However, in the exemplary embodiment according to FIG. 39*a*, six openings 112*a*, 112*b*, 112*c*, 112*d*, 112*e* and 112*f* were provided in the desiccant bed 98, which are configured as bore holes whose diameter increases with increasing distance from the opening 108, as previously explained with reference to FIG. 33*b*. Thus, two measures are combined with one another in order to achieve as even a flow as possible through the desiccant bed 98 with an acceptable pressure loss: on the one hand, the substantially vertically centered arrangement of the opening 108 between the main frame profile 6 and the sub-frame profile 7, and, on the other hand, the arrangement of the openings 112*a* to 112*f* in the façade intermediate space above and below the desiccant bed 98, with the cross-section of the openings increasing the further they are positioned from the opening 108 to the sub-frame profile.

The functional principle shown in FIG. 39*b* can be combined with different flow routings in the sub-frame profile, an adjustment only being necessary because the opening 108 in the main frame profile is located approximately halfway up the sub-frame profile.

In the embodiment according to FIG. 40*a*, the height of the front cover 88 is reduced by half compared to the embodiment according to FIG. 34*a*, while in the embodiment according to FIG. 41*a*, the front cover 88 corresponds to that according to FIG. 35*a* and only the position of the opening 108 is changed. The flow routing through the desiccant between the sub-frame profile and the façade intermediate space as shown in FIGS. 40*b* and 41*b* corresponds to that previously explained with reference to FIG. 39*b*.

In the embodiment according to FIG. 42*a, b*, the flow routing between the opening 108 to the sub-frame profile 7 and the openings 112*a*, 112*b*, 112*c*, 112*d*, 112*e* and 112*f* again corresponds to that shown in FIG. 39*b*. However, a shortened insert 100 with transverse baffles 106 is arranged in the sub-frame profile 7 compared to the configuration according to FIG. 36*a* to take account of the modified position of the opening 108. This configuration with a shortened flow path through the sub-frame profile has the additional advantage that the pressure loss of the flow path through the sub-frame profile is also reduced.

In the embodiment according to FIGS. 43*a, b*, the opening 108 between the sub-frame profile 7 and the desiccant-filled chamber in the main frame profile 6 is connected to a distribution pipe 114, so that air flowing through the opening 108 into the drying device enters the distribution pipe. The distribution pipe 114 is provided at predetermined intervals with a plurality of outlet openings 116*a*, 116*b*, 116*c*, 116*d*, 116*e*, the number of which may differ from that shown in FIG. 43*b*. In the illustrated exemplary embodiment, the cross-sectional openings of the outlet openings 116*a* to 116*e* are not the same, but increase with increasing distance from the opening 108. This makes it possible to influence the air flow exiting the individual outlet openings 116*a* to 116*c* so that it is substantially the same through each outlet opening. The openings 112*a*, 112*b*, 112*c*, 112*d* and 112*e* are each located substantially vertically above one of the outlet openings 116*a* to 116*e*, so that a preferred air flow path is formed between each pair of an outlet opening 116*a* to 116*e* and an opening 112*a* to 112*e*, and the resulting distribution of air flows through the desiccant bed means that the desiccant in the drying device is loaded with moisture as evenly as possible. The openings 112*a* to 112*e* have an increasing opening cross-section. In the case of a bore hole, the opening diameter of the openings 112*a* to 112*e*, which are labeled d1 to d5 in FIG. 43*a*, thus increases steadily from d1 to d5.

The embodiment according to FIGS. 44*a* and 44*b* modifies the embodiment according to FIGS. 43*a* and 43*b* in such a way that the pressure loss of the air flowing through the drying device can also be adjusted, as previously explained with reference to FIGS. 35*c* and 35*d*. For this purpose, the distribution pipe 114 is surrounded by a pipe sleeve 118 which is rotatably mounted relative to the distribution pipe 114 via a bearing in the main frame profile 6 and can be adjusted from the outside. To this end, the pipe sleeve 118 is rotatable from the outside on the main frame profile in the direction indicated by the arrow R. The pipe sleeve 118 has adjustment openings 120*a* to 120*e* at each of the axial positions corresponding to the respective axial positions of the outlet openings 116*a* to 116*e*. The opening cross-section of the outlet openings 116*a* to 116*e* can be reduced by rotating the pipe sleeve 118 relative to the distribution pipe 114. As the opening cross-section of the outlet openings decreases, the pressure loss of the air flowing through the outlet openings 116*a* to 116*e* increases.

However, the air flows indicated in all figures are only intended to schematically indicate a possible flow pattern. In reality, the air flow branches out through a bed of granular solids, and the very low volume flows for pressure equalization are also overlaid by diffusion processes that allow moisture-laden air to diffuse into areas where the air has dried. These diffusion processes support the even moisture loading of the desiccant in the desiccant bed.

A common feature of all configurations in which air flows through the desiccant bed is that the service life of the desiccant can be significantly increased compared to direct introduction of air into the façade intermediate space. In this way, despite the absence of a capillary tube, a double-skin façade element can be designed whose replacement interval can be more than 20 years, even under unfavorable climatic conditions.

For all the air flow variants described above, a simple test can be used to determine the volume flow of air as a function of the prevailing pressure difference. Using targeted tests, it is possible to determine the relationship between the volume flow of air and the pressure difference so that it can be described mathematically. The calculation of the pressure difference over any chosen reference period, for example one year, using hourly weather data for a defined location has already been explained in detail.

All of the described embodiments, some of which are detail representations, have in common that the façade element according to the invention can be configured in two different ways. On the one hand, a surrounding frame profile can be provided for all components of the façade element, wherein either only transparent glass elements are provided, or transparent regions and additional opaque regions are provided, preferably in the spandrel area. On the other hand, two surrounding frame profiles can be provided, one surrounding frame profile for the transparent glass elements and another surrounding frame profile for the opaque region.

The façade element according to the invention naturally has an air volume in the façade intermediate space that far exceeds the gas volume of a conventional insulating glass pane. Therefore, the design options for insulating glass panes are not transferable to double-skin façade elements and regular regeneration of the desiccant is required, so that all functional elements, in particular the pressure equalization device and drying device, must be accessible, maintainable, reparable and replaceable. Furthermore, the pressure equalization device and the drying device are positioned and dimensioned such that they are not located in a transparent region of the façade element, which has the advantage that they are fully integrated into the area of the surrounding frame profile and are thus entirely concealed from an outside observer.

LIST OF REFERENCE NUMBERS

1 Façade element
2 Outer glass element
3 Façade intermediate space
4 Inner glass element
5 Solar shading
5' Solar shading in the spandrel area
6 Main frame profile of the surrounding frame profile
6*a*, 6*b* Main frame profile sections
7 Sub-frame profile of the surrounding frame profile
8 Gasket
9 Connecting screw
10 External glazing bead
11 Surrounding frame profile
12 Transparent region
13 Hollow chamber in main frame profile
14 Desiccant
15 Opening
16 Desiccant replacement device
17 Pressure equalization sub-system between sub-frame profile and drying device in the main frame profile
18 Pressure equalization opening
18*a* Insertion opening
19 Desiccant container
20 Glazing bead
21 Air conducting element
23*a* Foil
23*b* Foil
24 Insulation web
25 Internal gasket of the outer glass element
26 Seal inside the outer glass element
27 Seal
28 Inner expansion joint seal
29 Middle expansion joint seal
30 Outer expansion joint seal
31 Internal gasket or inner seal
32 Gasket inside the inner glass element
33 Outer seal
34 Pressure equalization opening
35 Long capillary tube
36 Filter
37 Pressure equalization opening
38 Groove
39 Plastic profile
41 Mounting groove
42 Pressure equalization opening
43 Maintenance opening
44 Connection piece
45 Membrane
46 Cavity
47 Plastic profile
48 Gap
49 Plastic profile
50 Gap
51 Groove
53 Groove
55 Gap
56 Vapor barrier
57 Seal inside the inner panel
58 Spandrel panel (opaque)
59 Outer cover shell of the spandrel panel on the room side
60 Opaque coating
61 Inner cover shell of the spandrel panel on the room side
62 Insulation material
63 Sealing part
64 Room-side sealing element
65 Inner cavity of the replacement device
66 Plastic profile
67 Hollow chamber
68 Opening
69 Desiccant container cavity
70 Filter
72 Pressure equalization opening
74 Indentation
78 Expansion joint
80 Hollow chamber in sub-frame profile
82 First pressure equalization opening
84 Second pressure equalization opening
86 Corner bracket
88 Front cover
90 Inner cavity of the cover
92 Sleeve
94 Third air equalization opening
96 Inner cavity of the sub-frame profile
98 Desiccant bed
100 Insertion element
102 First wall
104 Second wall
106 Transverse baffle
108 Opening to desiccant chamber
110 Inner cavity of the main frame profile
112*a* . . . 112*f* Opening to the façade intermediate space
114 Distribution pipe

116*a* . . . 116*e* Outlet opening
118 Pipe sleeve
120*a* . . . 120*e* Adjustment opening
122 Slide
124 Guide
126*a*, 126*b*, 126*c* Shutter

The invention claimed is:

1. A double-skin façade element, comprising:
a planar outer glazing element and a planar inner glazing element which are held at a distance from one another in a thermally insulated surrounding frame profile;
at least one pressure equalization device which is in air-conducting connection with an outside atmosphere and with a façade intermediate space which is provided between the outer glazing element and the inner glazing element;
at least one drying device fillable with desiccant which is either arranged in the façade intermediate space or is integrated into the surrounding frame profile and exchanges air with the façade intermediate space;
wherein:
at least one capillary element is provided, which is an integral part of the surrounding frame profile and is composed in part by a portion of the surrounding frame profile;
the pressure equalization device and the drying device are positioned and dimensioned such that the devices do not extend into a transparent region of the façade element; and
the at least one drying device is configured to allow the desiccant to be replaced and comprises a replacement opening configured to allow the desiccant to be replaced from a room side.

2. The double-skin façade element according to claim 1, wherein the at least one capillary element comprises a membrane with a capillary tube, the capillary tube having a length of one of at most 60 mm, at most 20 mm and at most 10 mm, and an inner diameter of one of at most 1.5 mm and at most 1.0 mm.

3. The double-skin façade element according to claim 1, wherein the at least one capillary element comprises a capillary tube which has a length of up to 200 mm and a membrane or a filter or a strainer at an opening of the capillary tube to the outside atmosphere.

4. The double-skin façade element according to claim 1, wherein the at least one capillary element comprises a capillary tube that is fully integrated into the surrounding frame profile of the façade element or clipped into the surrounding frame profile.

5. The double-skin façade element according to claim 1, wherein
the drying device comprises a desiccant container; and
the at least one capillary element comprises a capillary tube which is integrated into the desiccant container.

6. The double-skin façade element according to claim 1, wherein
the drying device comprises a desiccant container; and
the at least one capillary element comprises a capillary tube which is formed from a groove in the desiccant container and a wall of the surrounding frame profile.

7. The double-skin façade element according to claim 1, wherein the capillary element comprises a groove in the surrounding frame profile and an end profile made of plastic, a cavity being formed between the end profile and at least one inner wall of the groove.

8. The double-skin façade element according to claim 1, wherein
the pressure equalization device comprises a cavity that includes an opening into the façade intermediate space; and
the cavity is filled with the desiccant.

9. The double-skin façade element according to claim 1, wherein an opening in one of the at least one pressure equalization devices is in flow connection with a second opening in a cavity fillable with the desiccant of one of the at least one drying devices.

10. The double-skin façade element according to claim 1, wherein the drying device comprises a desiccant container fillable with the desiccant that is removably attachable to the surrounding frame profile.

11. The double-skin façade element according to claim 1, wherein desiccant consumption over a given period of time is configured to be estimated as a function of a location of the façade element, type of desiccant and design features of the façade element.

12. The double-skin façade element according to claim 1, wherein the at least one drying device is integrated into cavities of the surrounding frame profile arranged vertically in an installation position.

13. The double-skin façade element according to claim 1, further comprising at least one solar shading device in the façade intermediate space between the outer glazing element and the inner glazing element, the solar shading device being designed to be adaptive.

14. The double-skin façade element according to claim 1, wherein the inner glazing element comprises either multi-pane insulating glass with two or three panes, or vacuum insulating glass.

15. The double-skin façade element according to claim 1, wherein the outer glazing element is provided as monoglass, laminated glass or laminated safety glass, and comprises at least one functional layer having a wavelength-selective coating.

16. The double-skin façade element according to claim 1, the drying device comprises a cavity fillable with the desiccant which is an integral part of the surrounding frame profile and the replacement opening that is configured to allow the desiccant to be replaced.

17. The double-skin façade element according to claim 1, wherein the at least one pressure equalization device comprises an elastic profile with at least one opening which is arranged in an air-conducting connection path between the façade intermediate space and the outside atmosphere.

18. The double-skin façade element according to claim 1, further comprising an opaque inner element and an outer element which are held at a distance from one another, the outer element being transparent.

19. The double-skin façade element according to claim 18, characterized in that the opaque inner element and the transparent outer element are held in a further surrounding frame profile.

20. The double-skin façade element according to claim 1, wherein the pressure equalization device and the drying device in the façade intermediate space are configured to be accessed by opening or removing the outer glazing element or an opaque outer element or the inner glazing element or an opaque spandrel element.

21. The double-skin façade element according to claim 1, wherein the double-skin façade element further comprises
means for reducing vapor diffusion, wherein
the means for reducing vapor diffusion comprise
wet glazing and
at least one insulation web for thermal separation in the thermally insulated surrounding frame profile that is at least one of made of a plastic with high vapor tightness or with a coating material with high vapor tightness.

22. The double-skin façade element according to claim 21, wherein the means for reducing vapor diffusion include insulation webs comprising a coating material with high vapor tightness, the coating material being applied all around mitered corners of the surrounding frame profile, the coating material being applied to an entire frame perimeter including the mitered corners.

23. The double-skin façade element according to claim 1, wherein the at least one drying device is configured to be integrated both into cavities of the surrounding frame profile arranged vertically in an installation position and into cavities of the surrounding frame profile arranged horizontally in the installation position.

24. The double-skin façade element according to claim 23, wherein the double-skin façade element further comprises means for reducing vapor diffusion, wherein the means for reducing vapor diffusion comprise wet glazing and at least one insulation web for thermal separation in the thermally insulated surrounding frame profile that is at least one of made of a plastic high vapor tightness or with a coating material with high vapor tightness.

25. The double-skin façade element according to claim 24, wherein the insulation web is coated with a foil of thin stainless steel or butyl, or the insulation web is made of a metalized plastic.

26. The double-skin façade element according to claim 24, wherein the insulation web is made at least partially of polyvinylidene fluoride.

27. The double-skin façade element according to claim 1, wherein, the surrounding frame profile comprises a main frame profile and a sub-frame profile, wherein the main frame profile and the sub-frame profile are detachably connected to each other via connecting means and the sub-frame profile holds the outer glazing element.

28. The double-skin façade element according to claim 27, wherein a gasket is arranged between the main frame profile and the sub-frame profile, the gasket being vapor-tight.

29. The double-skin façade element according to claim 27, wherein the at least one pressure equalization device is arranged in the main frame profile or in the sub-frame profile.

30. A double-skin façade element, comprising:

a planar outer glazing element and a planar inner glazing element which are held at a distance from one another in a thermally insulated surrounding frame profile;

at least one pressure equalization device which is in air-conducting connection with an outside atmosphere and with a façade intermediate space which is provided between the outer glazing element and the inner glazing element;

at least one drying device fillable with desiccant which is either arranged in the façade intermediate space or is integrated into the surrounding frame profile and exchanges air with the façade intermediate space, wherein:

the double-skin façade element further comprises means for reducing vapor diffusion, wherein the means for reducing vapor diffusion comprise wet glazing and at least one insulation web for thermal separation in the thermally insulated surrounding frame profile that is at least one of made of a plastic with high vapor tightness or with a coating material with high vapor tightness;

the pressure equalization device and the drying device are positioned and dimensioned such that the devices do not extend into a transparent region of the façade element; and the at least one drying device is configured to allow the desiccant to be replaced and comprises a replacement opening configured to allow the desiccant to be replaced from a room side.

31. The double-skin façade element according to claim 30, wherein the at least one pressure equalization device comprises a capillary element.

32. A double-skin façade element, comprising:

a planar outer glazing element and a planar inner glazing element which are held at a distance from one another in a thermally insulated surrounding frame profile;

at least one pressure equalization device which is in air-conducting connection with an outside atmosphere and with a façade intermediate space which is provided between the outer glazing element and the inner glazing element, and an air routing device, wherein:

pressure loss of air flow during pressure equalization is determinable and adjustable by at least one of a length, cross-sectional dimensions of the air routing device or the number of deflections of the air flow passing through the air routing device;

at least one drying device fillable with a desiccant bed which is integrated into the surrounding frame profile, the at least one drying device comprises at least one first opening which is in air-conducting connection with the façade intermediate space;

the at least one pressure equalization device and the at least one drying device are positioned and dimensioned such that the pressure equalization and drying devices do not extend into a transparent region of the façade element, and the at least one drying device is configured to allow the desiccant to be replaced and comprises a replacement opening configured to allow the desiccant to be replaced from a room side.

33. The double-skin façade element according to claim 32, wherein the air routing device comprises deflector elements configured to be used to create a winding flow path for the air through the air routing device.

34. The double-skin façade element according to claim 32, wherein the air routing device comprises a cover attachable to the surrounding frame profile which is screwed or clipped onto a sub-frame profile.

35. The double-skin façade element according to claim 34, characterized in that the attachable cover is made of a plastic with water adsorption capacity.

36. A double-skin façade element, comprising:

a planar outer glazing element and a planar inner glazing element which are held at a distance from one another in a thermally insulated surrounding frame profile;

at least one pressure equalization device which comprises an air routing device and is in air-conducting connection with an outside atmosphere and with a façade intermediate space which is provided between the outer glazing element and the inner glazing element;

at least one drying device fillable with a desiccant bed which is integrated into the surrounding frame profile, wherein:

the at least one drying device comprises at least one first opening which is in air-conducting connection with the facade intermediate space, and at least one second opening, which is in air-conducting connection with the air routing device;

pressure loss of air flow during pressure equalization is determinable and adjustable by the pressure loss on flowing through the at least one drying device and the air routing device;

the at least one pressure equalization device and the at least one drying device are positioned and dimensioned such that the pressure equalization and drying devices do not extend into a transparent region of the façade element and the at least one drying device is configured to allow the desiccant to be replaced and comprises a replacement opening configured to allow the desiccant to be replaced from a room side.

* * * * *